US009822611B2

(12) United States Patent
Delzell et al.

(10) Patent No.: US 9,822,611 B2
(45) Date of Patent: Nov. 21, 2017

(54) SELECTIVE MAGNETIC POSITIONING TOOL

(71) Applicant: Halliburton Energy Services Inc., Houston, TX (US)

(72) Inventors: Christopher R Delzell, Plano, TX (US); William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 620 days.

(21) Appl. No.: 14/367,141

(22) PCT Filed: Jul. 31, 2013

(86) PCT No.: PCT/US2013/052856
§ 371 (c)(1),
(2) Date: Jun. 19, 2014

(87) PCT Pub. No.: WO2015/016858
PCT Pub. Date: Feb. 5, 2015

(65) Prior Publication Data

US 2016/0208580 A1 Jul. 21, 2016

(51) Int. Cl.
*H01F 5/00* (2006.01)
*E21B 41/00* (2006.01)
(Continued)

(52) U.S. Cl.
CPC ..... *E21B 41/00* (2013.01); *E21B 33/12* (2013.01); *E21B 34/06* (2013.01); *E21B 34/14* (2013.01);
(Continued)

(58) Field of Classification Search
CPC .... E21B 2034/007; E21B 33/12; E21B 34/06; E21B 34/14; E21B 41/00; E21B 47/00; E21B 47/0905
See application file for complete search history.

(56) References Cited

U.S. PATENT DOCUMENTS 6,076,873 A * 6/2000 Jung ..... H01F 7/04 294/65.5
8,009,001 B1 * 8/2011 Cleveland ..... H02K 1/02 310/156.31
(Continued)

OTHER PUBLICATIONS

International Preliminary Report on Patentability issued in related PCT Application No. PCT/US2013/052856 dated Feb. 11, 2016 (8 pages).
(Continued)

*Primary Examiner* — Bernard Rojas
(74) *Attorney, Agent, or Firm* — Scott Richardson; Baker Botts L.L.P.

(57) ABSTRACT

An actuation device comprises a housing, and a plurality of permanent magnets disposed about the housing. The plurality of permanent magnets is configured to selectively transition between a first position and a second position. The plurality of permanent magnets is configured to provide a stronger magnetic field strength outside the housing than inside the housing in the first position, and wherein the plurality of permanent magnets is configured to provide a stronger magnetic field strength inside the housing than outside the housing in the second.

22 Claims, 27 Drawing Sheets

(51) Int. Cl.

| | |
|---|---|
| ***E21B 34/14*** | (2006.01) |
| ***E21B 47/09*** | (2012.01) |
| ***E21B 33/12*** | (2006.01) |
| ***E21B 34/06*** | (2006.01) |
| ***E21B 47/00*** | (2012.01) |
| *E21B 34/00* | (2006.01) |

(52) U.S. Cl.
CPC ..... *E21B 47/00* (2013.01); *E21B 47/0905* (2013.01); *E21B 2034/007* (2013.01)

(56) References Cited

U.S. PATENT DOCUMENTS

| | | | |
|---|---|---|---|
| 8,322,426 | B2 | 12/2012 | Wright et al. |
| 9,366,134 | B2 * | 6/2016 | Walton ..... E21B 47/122 |
| 2001/0026204 | A1 | 10/2001 | Petro |
| 2004/0216869 | A1 | 11/2004 | Streater et al. |
| 2007/0272411 | A1 | 11/2007 | Lopez de Cardenas et al. |
| 2010/0175867 | A1 | 7/2010 | Wright et al. |
| 2011/0037004 | A1 | 2/2011 | Lake et al. |
| 2011/0120726 | A1 | 5/2011 | Murray et al. |
| 2011/0174504 | A1 | 7/2011 | Wright et al. |
| 2011/0265987 | A1 | 11/2011 | Wright et al. |
| 2012/0119861 | A1 | 5/2012 | Tang et al. |
| 2013/0048290 | A1 | 2/2013 | Howell et al. |

OTHER PUBLICATIONS

International Preliminary Report on Patentability issued in related PCT Application No. PCT/US2013/052857 dated Feb. 11, 2016 (9 pages).

Foreign Communication From a Related Counterpart Application, International Search Report dated Apr. 22, 2014, International Application No. PCT/US2013/052856 filed on Jul. 31, 2013.

Foreign Communication From a Related Counterpart Application, International Search Report dated Apr. 22, 2014, International Application No. PCT/US2013/052857 filed on Jul. 31, 2013.

* cited by examiner

SELECTIVE MAGNETIC POSITIONING TOOL

BACKGROUND

Hydrocarbon wells (for production of hydrocarbons such as oil and gas) typically have a wellbore drilled into a formation in the ground containing the hydrocarbons. Such formations typically have one or more production zones that may be accessed to extract the formation fluids (for example, hydrocarbons) into the wellbore. This is typically accomplished in the producing section as an open hole or uncased completion but it can also be completed by placing a casing along the wellbore and perforating the casing in a position adjacent to a production zone. Often these production zones may be separated/isolated from each other using packers inserted into the wellbore. Fluid in the production zone is then drawn into a completion string (typically comprising tubing for pumping in to and out of the well and one or more downhole tools) in the wellbore that runs to the surface. One or more of the downhole tools in the completion string may have multiple positions. For example, if the downhole tool is a flow control device having a valve, the downhole tool might have an open position and a closed position. Other examples of a downhole tool might include a packer, safety valve, sliding sleeve, adjustable choke, pump, and/or perforating apparatus. During production of the well, it may be desirable to modify the function and/or position of such a downhole tool (e.g. moving a valve from a closed position to an open position or vice versa). It may, however, be quite challenging to interact with downhole tools in a wellbore tubular string.

SUMMARY

Aspects of the disclosure may include embodiments of a downhole tool for use in a completion string.

In an embodiment, an actuation device comprises a housing, and a plurality of permanent magnets disposed about the housing. The plurality of permanent magnets is configured to selectively transition between a first position and a second position. The plurality of permanent magnets is configured to provide a stronger magnetic field strength outside the housing than inside the housing in the first position, and the plurality of permanent magnets is configured to provide a stronger magnetic field strength inside the housing than outside the housing in the second position.

In an embodiment, a magnetic positioning tool system comprises a magnetic positioning tool disposed within an outer mandrel, and an actuable component operably associated with the outer mandrel. The magnetic positioning tool comprises: a housing, and a plurality of magnets disposed about the housing. The plurality of magnets are configured to selectively transition between a first position and a second position, and the magnetic positioning tool is configured to actuate the actuable component based on transitioning the plurality of magnets from the first position to the second position.

In an embodiment, a method of magnetically actuating a downhole component comprises positioning a magnetic positioning tool adjacent an actuable component within a wellbore, where the magnetic positioning tool comprises a plurality of magnets arranged in a first position, transitioning the plurality of magnets from the first position to a second position, magnetically coupling the plurality of magnets with the actuable components, and actuating the actuable component within the wellbore in response to the magnetic coupling.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
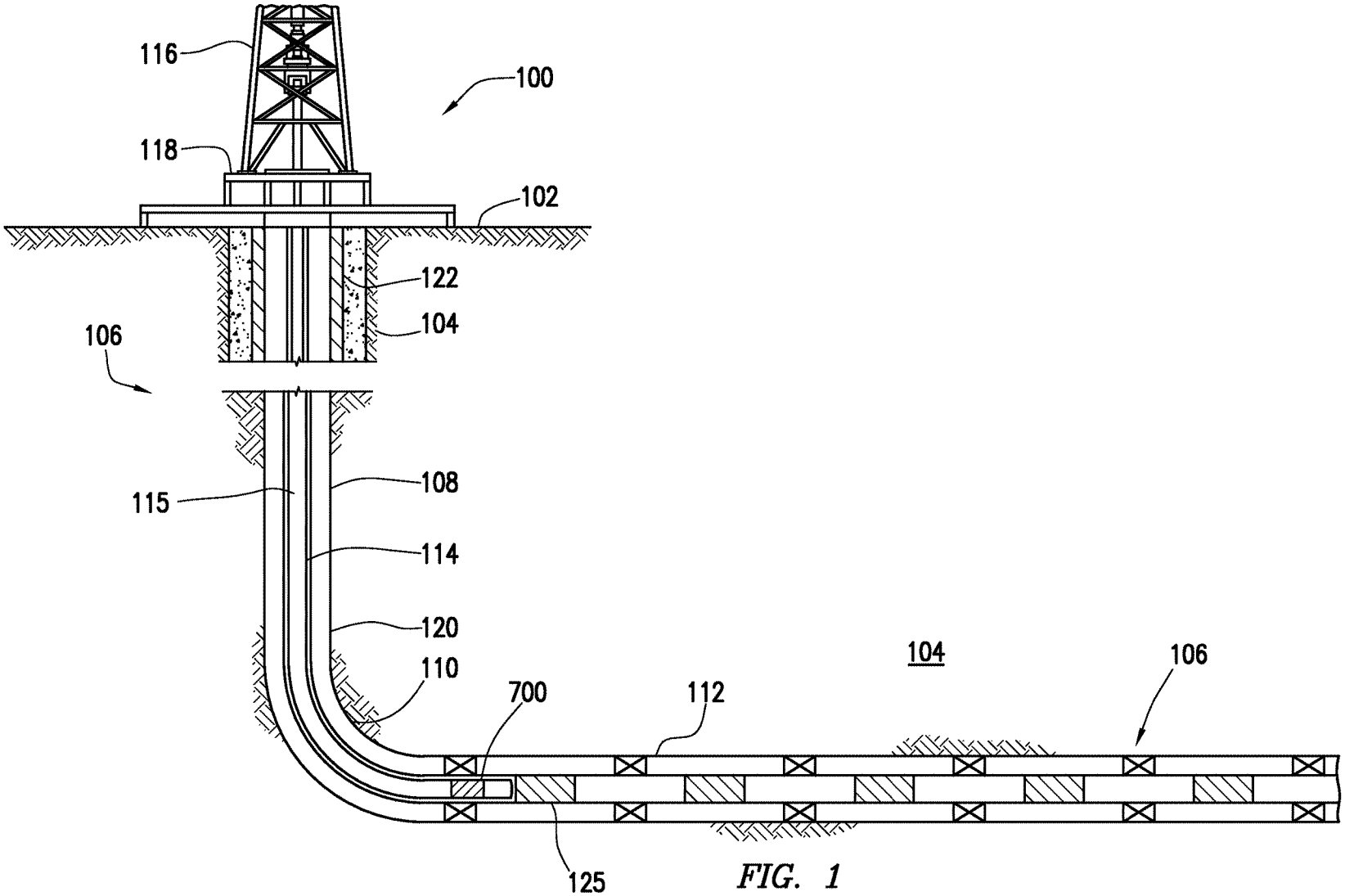
FIG. 1 is a schematic illustration of a well system including a downhole tool according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center of the wellbore in a radial direction (i.e., towards the central axis of the wellbore and/or the hydraulic connection mechanism) and with "out," "outer," or "outward" meaning towards the wall of the well in a radial direction, regardless of the wellbore orientation. As used herein, "service," "servicing," or "servicing operation" refers to any operation or procedure used to drill, complete, work over, fracture, repair, or in any way prepare or restore a wellbore for the recovery of materials residing in a subterranean formation penetrated by the wellbore. A "servicing tool" refers to any tool or device used to service a wellbore or used during a servicing operation. The various characteristics mentioned above, as well as other features and characteristics described in more detail below, will be readily apparent to those skilled in the art with the aid of this disclosure upon reading the following detailed description of the embodiments, and by referring to the accompanying drawings.

As used herein, the terms "downhole tool" and "downhole component" include any tool that might be used in a drilling, completion, production, and/or workover string (e.g., a wellbore tubular string) in a wellbore; typically the tool might be a multi-position tool having a movable component (which in some embodiments might provide control over some aspect of the completion string and the fluid therein). The term "magnetic pattern" includes the location, orientation, spacing, coding, polarity, and/or number of magnets within a key or tool.

Various tools can be used within a wellbore during drilling, completion, and workover operations to control various aspects of the well. For example, various sliding sleeves can be used to open and close ports or valves, lock or unlock various components, and/or open various chambers for piloting larger actuation movements. Additional tools include packers, collets, latches, and the like. The tools can be actuated using a variety of mechanisms. For example, a latch may be disposed in the wellbore on a conveyance mechanism such as a slickline or coiled tubing and engaged with an indicator on a desired sleeve. Upon engaging the desired tool, the latch may be manipulated to actuate the tool. However, more than one tool in the wellbore may have a similar latch due to space limitations. The conveyance of the latch into the wellbore to actuate a desired tool may then inadvertently actuate, either fully or partially, another tool. While mechanisms can be used to help reduce the occurrence of the inadvertent actuation of the downhole tools, the use of the latches may still result in some accidental movement of the downhole tools.

As disclosed herein, a positioning tool may be used that can be placed in the wellbore in a position in which it will not interact with any tools, or in some cases, any undesired tools. The positioning tool can then be actuated within the wellbore to assume a configuration in which it can interact with a desired downhole component. Upon performing a desired action with the downhole tool, the positioning tool can then be actuated back to a state in which is does not interact with any additional tools. The positioning tool can be further actuated to assume a plurality of configurations. This may be advantageous in allowing the positioning tool to be keyed to one or more downhole tools within the wellbore to perform desired operations. The positioning tool can then be re-keyed within the wellbore to further perform an additional operation on another downhole tool.

As described herein, the positioning tool may comprise a plurality of magnets that can magnetically couple to a component in a downhole tool. The use of a magnetic coupling may reduce the inadvertent physical interaction with other components in the wellbore during conveyance of the positioning tool through the wellbore. Further, the use of magnets may allow the positioning tool to assume a variety of magnetic configurations that may be keyed in a number of ways to a desired downhole tool or components. For example, the magnets on the positioning tool may be configured in a Halbach Array as described below. The Halbach Array may allow the magnetic field to be redirected, thereby being directed to interact with a downhole tool when desired and then being directed inward to avoid an interaction with another downhole tool during movement of the positioning tool within the wellbore. Additional embodiments include the use of a plurality of magnets that can assume a variety of magnetic patterns that may act as a key, where the arrangement of magnets may or may not form a Halbach Array. The downhole tool may be configured to only interact with a specific magnetic pattern. The use of a positioning tool with a plurality of available magnetic patterns may allow for specific tools to be selectively engaged within the wellbore. The magnetic patterns may be selectively produced within the wellbore by selectively axially positioning a plurality of magnets and/or selectively rotating the magnets on the positioning tool. These types of movements allow for a variety of keyed patterns and configurations for use in actuating one or more downhole tools or components within a wellbore in addition to allowing for positions in which the positioning tool may not inadvertently actuate other downhole tools Referring to FIG. 1, an example of a wellbore operating environment is shown. As depicted, the operating environment comprises a drilling rig 100 that is positioned on the earth's surface 102 and extends over and around a wellbore that penetrates a subterranean formation 104 for the purpose of recovering hydrocarbons. The wellbore 106 may be drilled into the subterranean formation 104 using any suitable drilling technique. The wellbore 106 extends substantially vertically away from the earth's surface 102 over a vertical wellbore portion 108, deviates from vertical relative to the earth's surface 102 over a deviated wellbore portion 110, and transitions to a horizontal wellbore portion 112. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further the wellbore may be used for both producing wells and injection wells.

A magnetic positioning tool 700 coupled to a wellbore tubular string 115 may be lowered into the subterranean formation 104 for a variety of servicing or treatment procedures throughout the life of the wellbore. The embodiment shown in FIG. 1 illustrates the wellbore tubular string 115 in the form of a workover and/or completion string being lowered into the subterranean formation within an outer tubular string 114, which may comprises one or more magnetically actuatable tools as described in more detail here. In some embodiments, the outer tubular string 114 may be casing disposed within the wellbore 106. It should be understood that the wellbore tubular 115 comprising the magnetic positioning tool 700 is equally applicable to any type of wellbore tubular being inserted into a wellbore, including as non-limiting examples production tubing and coiled tubing. In some embodiments, the magnetic positioning tool 700 may be conveyed within the wellbore 106 using any conveyance mechanisms such as slickline, e-line, wireline, and/or as a plug or dart driven by fluid pressure (e.g., without any other conveyance mechanisms). The magnetic positioning tool 700 may be used to actuate or shift a variety of downhole tools (e.g., sleeves, servicing tools, and the like).

The drilling rig 100 comprises a derrick 116 with a rig floor 118 through which the wellbore tubular 115 and/or the outer tubular string 114 extends downward from the drilling rig 100 into the wellbore 106. The drilling rig 100 comprises a motor driven winch and other associated equipment for extending the wellbore tubular 115 into the wellbore 106 to position the wellbore tubular 115 within the wellbore 106. For example, the wellbore tubular 115 may be coupled with the magnetic positioning tool 700 that is initially extended into the wellbore 106. While the operating environment depicted in FIG. 1 refers to a stationary drilling rig 100 for lowering and positioning the wellbore tubular 115 comprising the magnetic positioning tool 700 within a land-based wellbore 106, in alternative embodiments, mobile workover rigs, wellbore servicing units (such as coiled tubing units), and the like may be used to lower the wellbore tubular 115 comprising the magnetic positioning tool 700 into a wellbore. It should be understood that a wellbore tubular 115 coupled with the magnetic positioning tool 700 may alternatively be used in other operational environments, such as within an offshore wellbore operational environment. In alternative operating environments, a vertical, deviated, or horizontal wellbore portion may be cased and cemented and/or portions of the wellbore may be uncased. For example, uncased section 120 may comprise a section of the wellbore 106 ready for being cased or used as an open-hole production zone. In an embodiment, a wellbore tubular 115 coupled with the magnetic positioning tool 700 may be used in a cased wellbore, such as cased section 122, or an uncased wellbore.

Regardless of the type of operational environment in which the magnetic positioning tool 700 is used, it will be appreciated that the magnetic positioning tool 700 serves to interact with one or more wellbore servicing tools using a magnetic field. The interaction may provide a means to lock and/or unlock one or more wellbore servicing tools and allow for a tool or sleeve to be shifted within the wellbore. In some embodiments, the magnetic interaction may serve to couple the magnetic positioning tool 700 to the wellbore servicing tool 125 with a force that is sufficient to move the wellbore servicing tool 125 along the outer tubular string 114. Various types of magnetic fields may be used. For example, the magnetic positioning tool 700 may selectively orient the plurality of magnets into one or more Halbach Arrays and/or a sequence of north and/or south facing magnetic poles. The magnetic positioning tool 700 may utilize the Halbach Array to selectively interact with one or more locking components on a wellbore servicing tool in order to lock and/or unlock the wellbore servicing tool. The magnetic positioning tool 700 may also utilize the one or more Halbach Arrays to selectively move one or more wellbore servicing tools, for example, from a first position within the wellbore to a second position within the wellbore.

In an embodiment, the magnetic positioning tool 700 may utilize a magnetic field generated by a Halbach Array to interact with various components downhole. In general, a Halbach Array comprises an arrangement of permanent magnets that augments the magnetic field on one side of the array while cancelling the field to near zero on the other side. The arrangement can comprise a spatially rotating pattern of magnetization. Halbach Arrays may be implemented in a variety of shapes such as in sheets and cylinders (e.g., in the form of Halbach Cylinders). When the Halbach Array is used with a cylindrical arrangement, the magnetic field may be augmented either inside or outside the cylinder, with a corresponding decrease in the magnetic field on the opposite side—either outside or inside the cylinder, respectively. The Halbach Cylinder may be implemented using a continuous magnetic material or a discrete series of magnets such that the polarization of the magnetization rotates appropriately to generate the desired magnetic field in the desired direction. In an embodiment, the use of permanent magnets that can change their orientation may allow the rotating pattern of magnetization to be reoriented, thereby relocating the augmented magnetic field from one side of the Halbach Array to the other, which may correspondingly reorient the decreased magnetic field from one side to the other.

Generally, the magnets may be made from a material that is magnetized and creates its own persistent magnetic field. In an embodiment, the magnets of the magnetic positioning tool 700 may be permanent magnets formed, at least in part, from one or more ferromagnetic materials. Suitable ferromagnetic materials useful with the magnets described herein may include, but are not limited to, iron, cobalt, rare-earth metal alloys, ceramic magnets, alnico nickel-iron alloys, rare-earth magnets (e.g., a Neodymium magnet and/or a Samarium-cobalt magnet). Various materials useful with the magnets of the magnetic positioning tool 700 may include those known as Co-netic AA®, Mumetal®, Hipernon®, Hy-Mu-80 ®, Permalloy®, each of which comprises about 80% nickel, 15% iron, with the balance being copper, molybdenum, and/or chromium.

Figure 2:
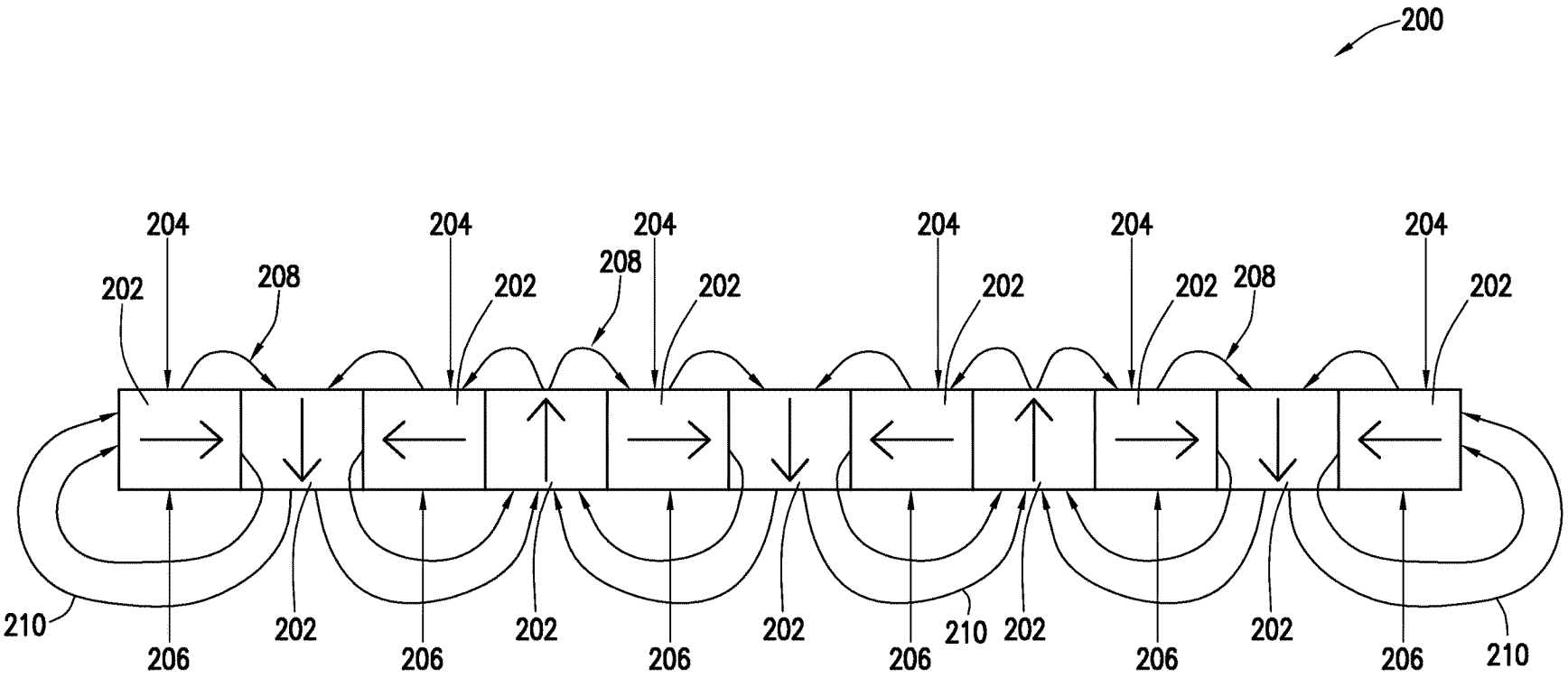
FIG. 2 schematically illustrates an embodiment of a magnetic arrangement of a magnet.

As shown in FIG. 2, a Halbach Array 200 comprising a plurality of magnets 202 may be arranged in a rotating pattern (in this case right, down, left, up, where "up" indicates north). The array 200 may be disposed about a wellbore tubular or other central mandrel on the magnetic positioning tool 700. The rotating pattern of the permanent magnets 202 augments the magnetic field 210 on a first side 206 relative to the decreased field 208 on the second side 204. The degree of augmentation and/or cancellation of the decreased field 208, 210 on each side of the permanent magnets 202 may vary depending on various considerations such as the relative strength of the magnets and/or the alignment and orientation of the magnets. In an embodiment, the augmented magnetic field 210 is greater than the decreased field 208. In some embodiments, the ratio of the magnetic field strength of the decreased field 208 at a given distance from the magnets to the magnetic field strength of the augmented field 210 at the distance from the magnets on an opposite side of the magnets 202 may be in the range of from about 1:1000 to about 1:1.5, from about 1:100 to about 1:2, or from about 1:90 to about 1:4. The difference in the magnetic field strength from the augmented field 210 to the decreased field 208 may allow the selective interaction of the Halbach Array with a downhole component.

Figure 3:
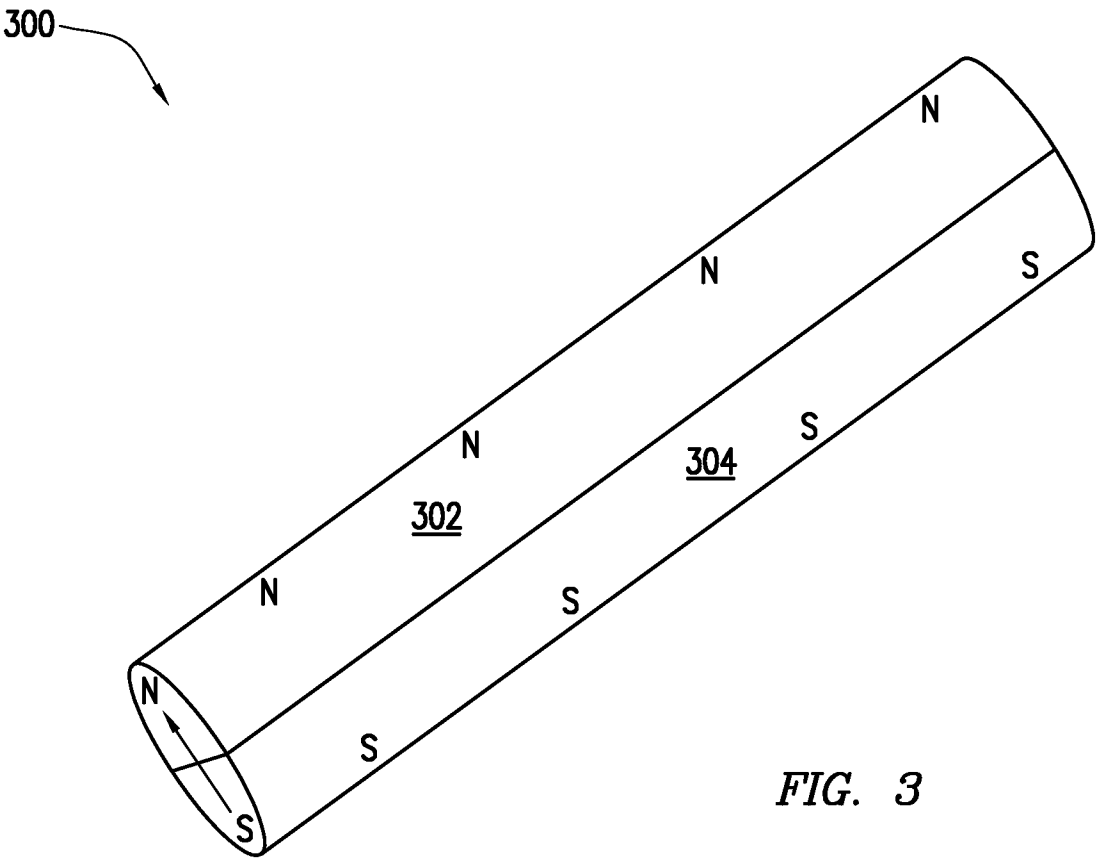
FIG. 3 schematically illustrates an embodiment of a magnet.

An embodiment of a magnet 300 useful with a Halbach Array as described herein is illustrated in FIG. 3. As shown, a magnet 300 can be magnetized with a north pole 302 and a south pole 304. The polarity may be oriented across the longitudinal axis of the magnet 300. In this embodiment, the magnet 300 comprises a side having a single polarity along then entire length of each side. While FIG. 3 depicts a permanent magnet in the shape of a cylindrical rod, the magnets may comprise one or more other shapes including, but not limited to, rods with rectangular cross-sectional shapes and a square cross-sectional shapes, cubic configuration, spherical shape, and the like.

Figure 4A:
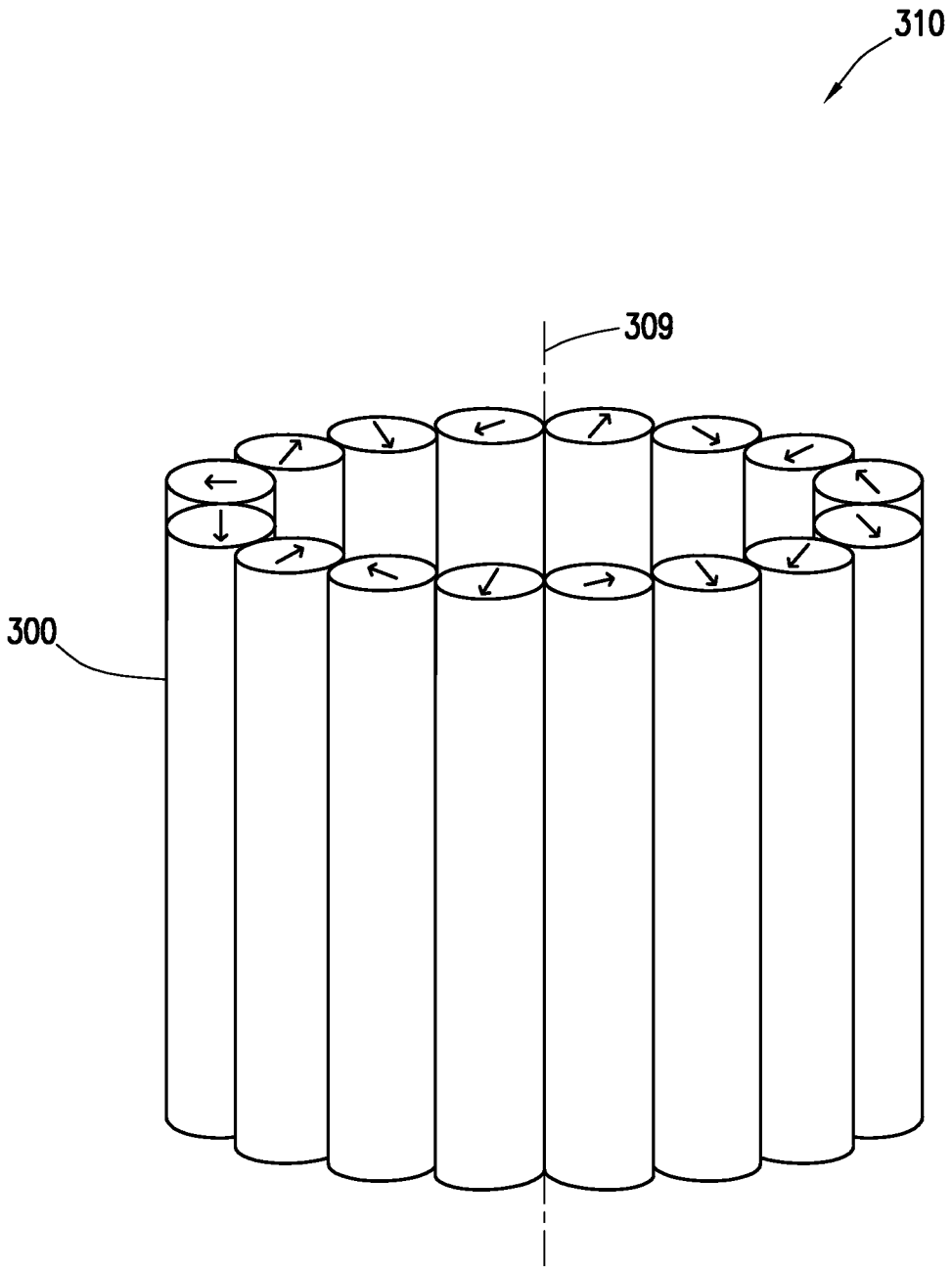
FIGS. 4A and 4B schematically represent an arrangement of a plurality of magnets according to an embodiment.
Figure 4B:
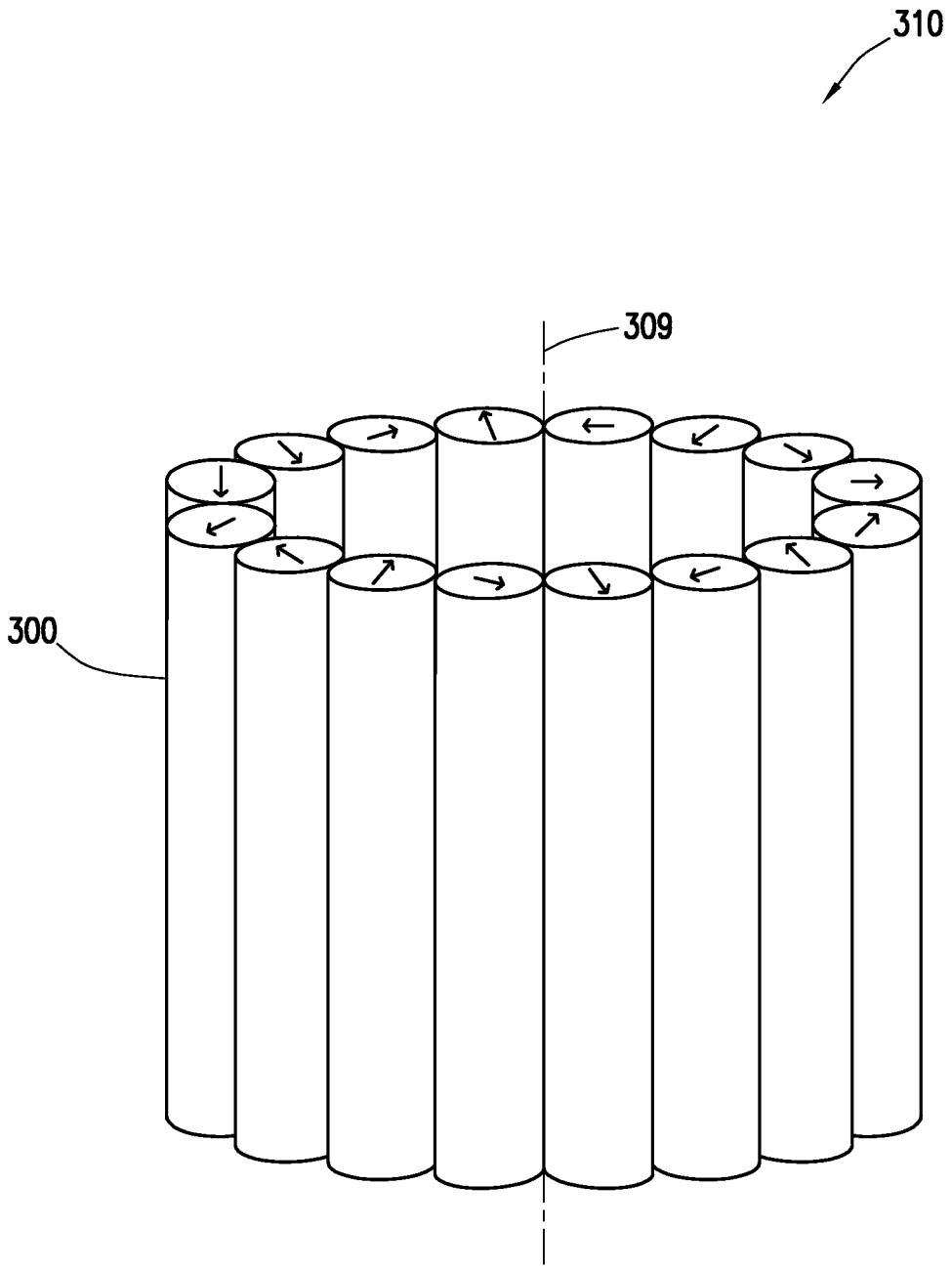

An array of magnets can be arranged as a Halbach Cylinder to provide an augmented field within the array or outside the array. FIG. 4A illustrates a plurality of magnets 300 arranged in a Halbach Cylinder. In this configuration, the longitudinal axis of each magnet 300 is substantially parallel, and the polarity of the plurality of magnets 300 are arranged in a rotating pattern about the central axis 309 of the Halbach Cylinder 310. The magnets comprise a polarity as indicated by the arrows at the top of each magnet 300, where "up" indicates a north pole. The rotating pattern of the magnets 300 illustrated in FIG. 4A comprises an augmented magnetic field inside the Halbach Cylinder 310 relative to the magnetic field outside the Halbach Cylinder 310. The plurality of magnets 300 can be reconfigured to reorient the magnet field from the Halbach Cylinder 310. As shown in FIG. 4B, the Halbach Cylinder 310 is configured with magnets 300 arranged in a rotating pattern relative to the center axis 309, except that the rotating pattern of the magnets 300 augments the magnetic field outside the Halbach Cylinder 310 relative to the magnetic field inside the Halbach Cylinder 310. While illustrated as being disposed in a rotating polarity where each magnet has a magnetic field oriented at approximately 90 degrees from each adjacent magnet in a rotating pattern, various other rotating patterns are also possible. For example, a magnet may have a magnetic field oriented at any angle between about 10 degrees and 170 degrees from each adjacent magnet so long as the overall pattern provides a rotating magnetic polarization. The resulting magnetic field may comprise different field lines based on the magnetic field orientation, but an augmented field (e.g., an additive magnetic field) and a reduced field (e.g., an at least partially canceled magnetic field) will generally be produced in different directions.

In order to transition the Halbach Cylinder 310 from a first configuration in which the magnetic field is augmented within the Halbach Cylinder 310 to a second configuration in which the magnetic field is augmented outside the Halbach Cylinder 310, one or more of the magnets may be rotated about its axis. In an embodiment, one or more of the plurality of magnets may be rotated to reconfigured the pattern from having a stronger magnetic field within the Halbach Cylinder 310 than outside the Halbach Cylinder 310 to having a stronger magnetic field outside the Halbach Cylinder 310 that inside the Halbach Cylinder 310. Various degrees of rotation of a magnet 300 may be used to effect the reorientation. For example, every other magnet 300 may be rotated through 180 degrees while the intervening magnets may remain in place to reorient the magnet field strength. As another example, every other magnet may be rotated through 90 degrees in a first rotational direction while the intervening magnets may rotate through 90 degrees in a second, opposite rotational direction.

Figure 5:
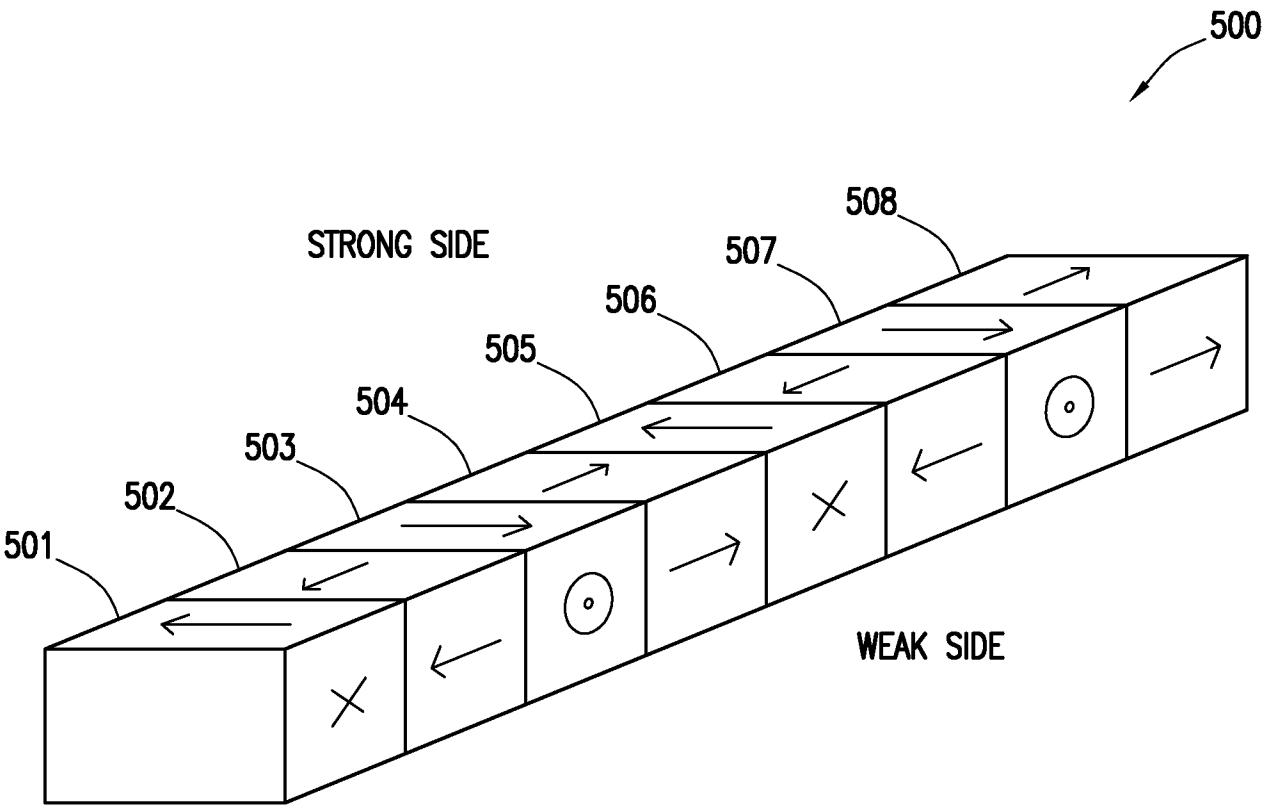
FIG. 5 schematically illustrates another embodiment of a magnetic arrangement of a magnet.

Another embodiment of a magnet 500 useful with a Halbach Array as described herein is illustrated in FIG. 5. As shown, a magnet 500 may comprise a plurality of magnetic zones 501-508. Each zone may comprise a polarization direction that is different than the polarization direction of an adjacent zone. In an embodiment, the plurality of magnetic zones 501-508 may be arranged with a rotating magnetic pattern to create a Halbach Array on the magnet 500. In the embodiment illustrated in FIG. 5, the left side of the magnet 500 may have an augmented magnetic field strength relative to the right side of the magnet 500. Any number of zones 501-508 may be used, and in an embodiment, the number of zones 501-508 may be sufficient to allow the individual magnet to form a Halbach Array. While FIG. 5 depicts a permanent magnet in the shape of a rod having a rectangular or square cross-section, the magnets may comprise one or more other shapes including, but not limited to, rods with circular cross-sectional shapes or an oval cross-sectional shapes, cubic configuration, spherical shape, and the like.

Figure 6:
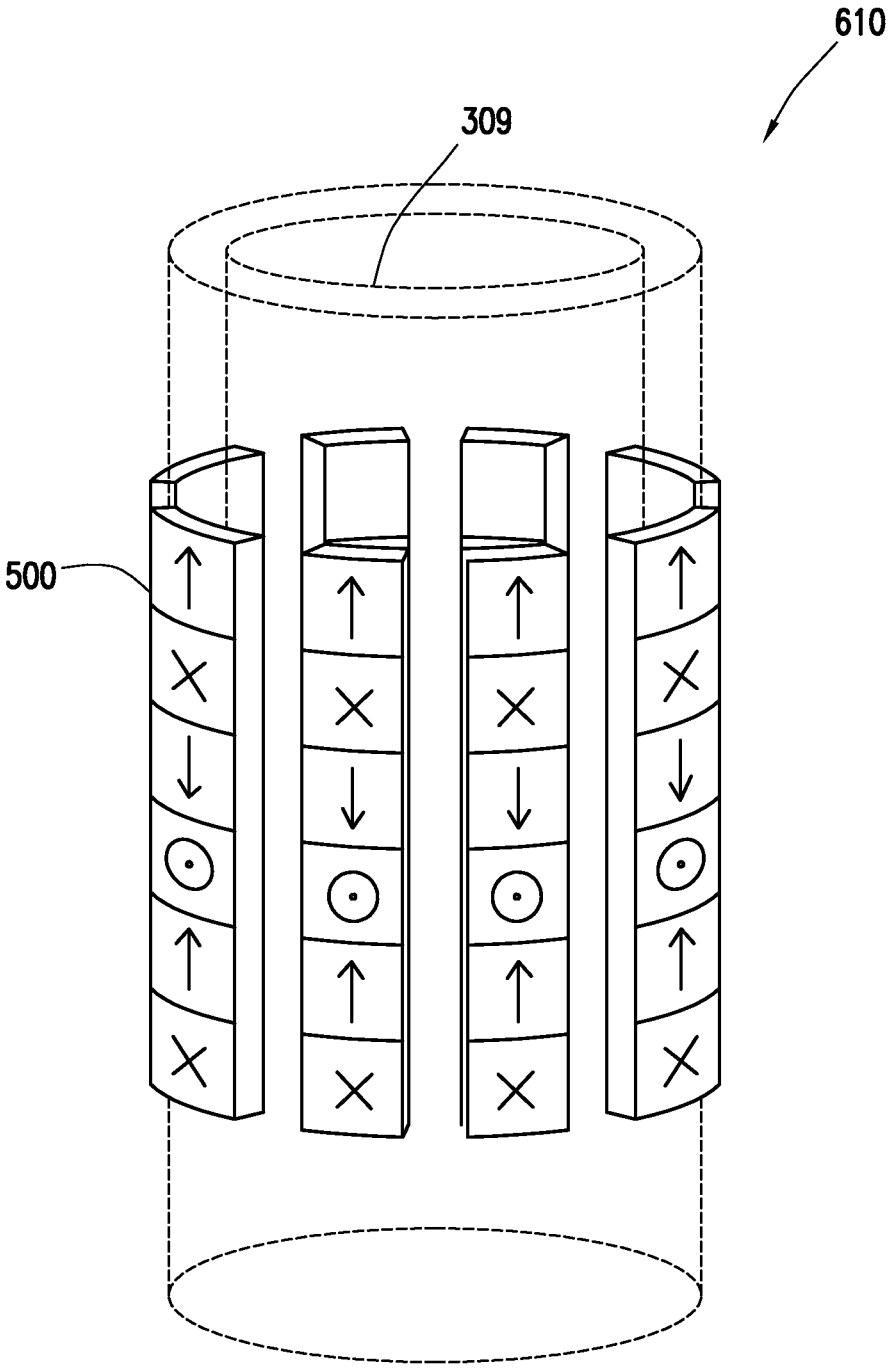
FIG. 6 schematically represents an arrangement of a plurality of magnets according to an embodiment.

The magnet 500 comprising a Halbach Array can be arranged in a cylindrical configuration to provide an augmented magnetic field within the array or outside the array. FIG. 6 illustrates a plurality of magnets 500 arranged about a central mandrel. In this configuration, the longitudinal axis of each magnet 500 is substantially parallel, and each magnet may comprise a rotating polarity of the magnetic zones to form a Halbach Array on each magnet. Each magnet 500 as illustrated in FIG. 6 may comprise an augmented magnet field on the outside of the cylinder 610 relative to the magnetic field inside the cylinder 610. The plurality of magnets 500 can be reconfigured to reorient the magnet field relative to the cylinder 610. For example, the magnets 500 may each be reconfigured so each magnet has an augmented magnetic field inside the cylinder 610 relative to the magnetic field outside the cylinder 610.

In order to transition the cylinder 610 from a first configuration in which the magnetic field is augmented within the cylinder 610 to a second configuration in which the magnetic field is augmented outside the cylinder 610, each of the magnets 500 may be rotated about its axis. In an embodiment, the plurality of magnets may be rotated to reconfigure the pattern from having a stronger magnetic field within the cylinder 610 than outside the cylinder 610 to having a stronger magnetic field outside the cylinder 610 than inside the cylinder 610. In an embodiment example, each magnet 500 may be rotated through 180 degrees to reorient each magnet 500 and provide a change in the orientation of the augmented magnet field.

Figure 7B:
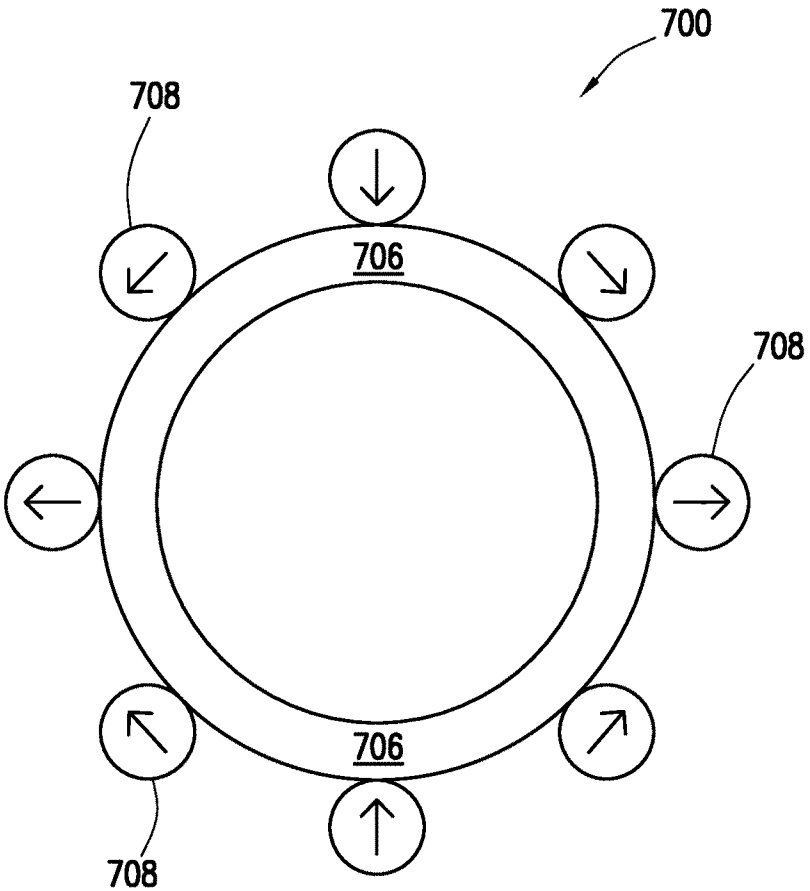
FIGS. 7A and 7B schematically represent an arrangement of a plurality of magnets in a magnetic positioning tool according to an embodiment.
Figure 7A:
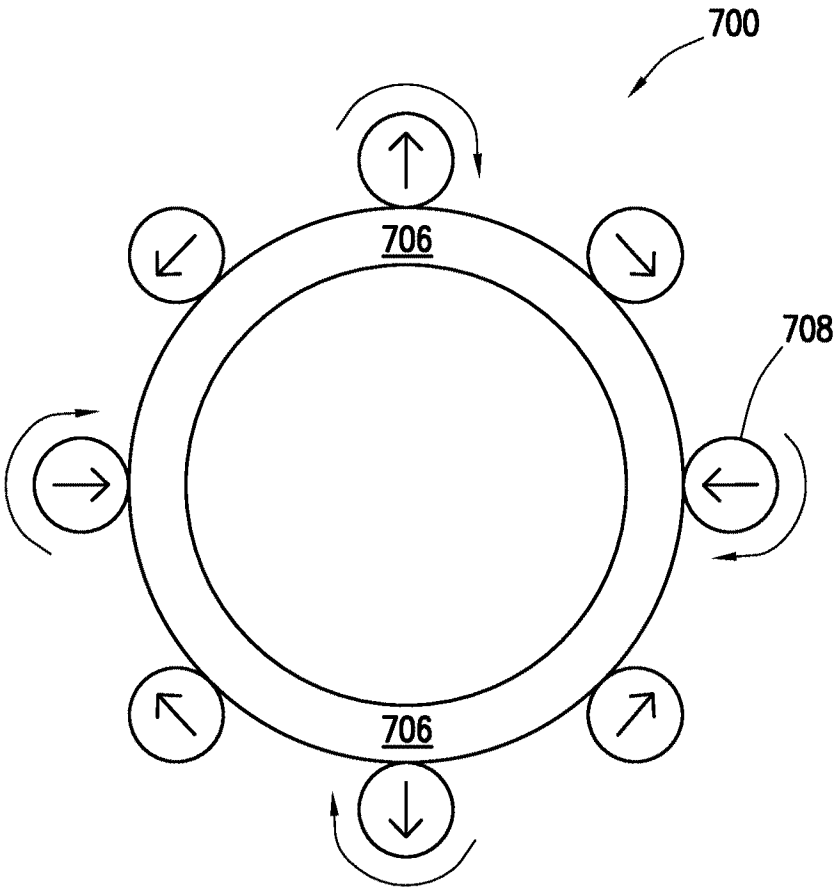

As shown in the embodiment of FIG. 7A, the magnetic positioning tool 700 generally comprises a housing 706 having a bore therethrough forming part of a fluid flow path and a plurality of permanent magnets 708 disposed about the housing 706 in a first configuration. In some embodiments, the housing 706 may not have a bore formed therethrough. For example, when used with a wireline or slickline, the housing 706 may be sealed to fluid flow therethrough and/or seal with the inner surface of an outer tubular to allow the magnetic positioning tool 700 to be conveyed within the wellbore using fluid pressure (e.g., by being pumped into the wellbore). The plurality of permanent magnets 708 may be disposed about the housing 706 with the longitudinal axis of each magnet 708 arranged substantially parallel to each other and the longitudinal axis of the housing 706. The magnets 708 may be similar to the magnets 300 or magnets 500 discussed above, and the magnets 708 may be oriented in any of the configurations described with respect to FIGS. 2-6. Each of the permanent magnets 708 may be configured to rotate about their own center axis. As shown in FIG. 7A, the magnets 708 may be arranged in a Halbach Cylinder with an augmented magnetic field directed inside the housing 706. It can be noted that if the housing 706 is formed from a ferromagnetic material, the magnetic field generated by the magnets 708 may be absorbed or shielded from the interior of the housing 706. While the magnets 708 may not generate a measureable field within the housing 706 in this case, reference to an augmented magnetic field within the housing may still refer to the magnetic field that would exist within the housing 706 in the absence of a ferromagnetic housing.

FIG. 7B depicts the magnetic positioning tool 700 comprising the plurality of permanent magnets 708 radially disposed around the housing 706. Relative to FIG. 7A, the embodiment illustrated in FIG. 7B has several magnets that are rotated about their own center axis and are configured in a second configuration. As illustrated, every other magnet has rotated through about 180 degrees. In the second configuration, the magnets are arranged to provide an augmented magnetic field outside the housing 706. It should be noted that while the embodiments of FIGS. 7A and 7B depict the permanent magnets rotating about their axis approximately 180 degrees, other rotational movements of one or more of the magnets may be used to actuate the magnets 708 from the first configuration (e.g., the configuration of FIG. 7A) to the second configuration (e.g., the configuration of FIG. 7B).

In an embodiment, the magnetic positioning tool 700 may configured between the first configuration and the second configuration. For example, the magnetic positioning tool 700 may move to and/or from a third configuration where a magnetic field is amplified neither inside the housing 706 nor outside the housing. Adding a third position may be useful, for example, when other magnetically sensitive tools may run through bore of the housing 706 as the magnetic positioning tool 700 is moved through the wellbore tubular.

In use, the magnetic positioning tool 700 may be disposed in a wellbore. The magnetic positioning tool 700 may be conveyed within the wellbore so that a reduced magnetic field (e.g., a magnetic field with an insufficient strength to interact with a wellbore tool) is present on the outside of the magnetic positioning tool 700. Thus, as the magnetic positioning tool 700 passes one or more wellbore tools which may be configured to interact with a magnetic field, the magnetic field may be insufficient (e.g., providing a magnetic field below a threshold magnetic field strength) to interact with or actuate one or more wellbore tools. However, when the magnetic positioning tool 700 is near a wellbore tool with which the magnetic positioning tool 700 is intended to interact, the permanent magnets may be reconfigured by rotating one or more of the magnets so that an augmented magnetic field is produced on the outside of the tool. The augmented magnetic field may comprise a magnetic field having a magnetic field strength sufficient to interact with and/or actuate a downhole component. Thus, the magnetic positioning tool may magnetically interact with a particular wellbore tool without interacting with other wellbore tools as the magnetic positioning tool is conveyed into position. After the magnetic positioning tool 700 has interacted with the particular wellbore tool so that the magnetic positioning tool 700 no longer needs to interact with the particular tool, the permanent magnets may again rotate so that an augmented magnetic field is no longer present on the outside of the magnetic positioning tool 700. Thus, the magnetic positioning tool 700 may be conveyed to a different location within the wellbore and/or removed from the wellbore without unintentionally interacting with other wellbore tools.

While described in terms of disposing the magnetic positioning tool 700 within an outer wellbore tubular, the magnetic positioning tool 700 may also be used at the outer wellbore tubular. The magnetic positioning tool 700 can be conveyed outside of an inner wellbore tubular and/or the magnetic positioning tool 700 may form a portion of a stationary outer wellbore tubular through which an inner wellbore tubular is conveyed. In this embodiment, the magnetic positioning tool may interact with a downhole component on the inner wellbore tubular by creating an augmented magnetic field within the magnetic positioning tool. Various components may be actuated by interacting with the augmented magnetic field within the magnetic positioning tool 700, for example, as the downhole components are conveyed past the magnetic positioning tool. Various combinations of the magnetic field orientations and magnetic patterns as described herein may be used with the magnetic positioning tool disposed outside of the downhole component to be actuated.

Figure 8A:
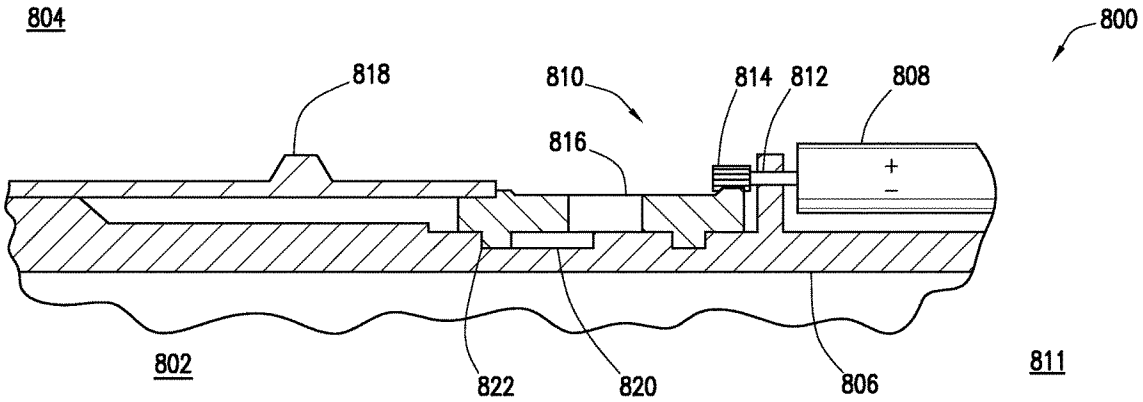
FIGS. 8A and 8B schematically represent a driving system of a magnetic positioning tool according to an embodiment.
Figure 8B:
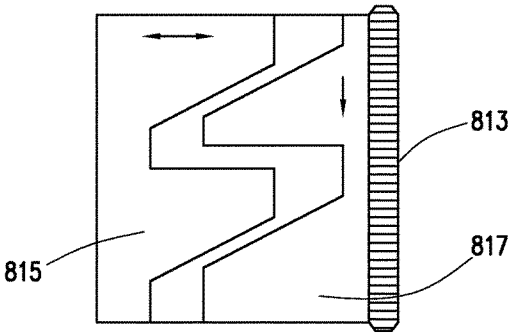

Various mechanisms may be used to effect the rotation of one or more of the magnets to actuate the magnetic positioning tool from a first configuration to a second configuration. An embodiment of a magnetic positioning tool 800 comprising an actuation system is illustrated in FIGS. 8A and 8B. In this embodiment, the magnetic positioning tool 800 comprising a mandrel 806 and plurality of magnets 808. The mandrel 806 may comprise a bore 811 disposed therethrough to provide a fluid flowpath through the mandrel 806. In some embodiments, the mandrel 806 may be configured to slide axially/longitudinally with respect to an outer tubular string, while in other embodiments the mandrel 806 may be operable to rotate circumferentially with respect to an outer tubular string. In an embodiment, the mandrel 806 may comprise a non-magnetic (e.g., a non-ferromagnetic) material. Non-magnetic materials may comprise copper, aluminum, composite materials, polymers, alloys thereof, or any combination thereof. The plurality of magnets 808 may be disposed about the mandrel 806.

The plurality of magnets 808 may be arranged to form a Halbach Array, as described in more detail above. The plurality of permanent magnets 808 may be oriented about the mandrel 806 in order to provide an augmented magnetic field inside 802 or outside 804 the mandrel 806. The plurality of permanent magnets 808 may also be configured to selectively move between at least a first configuration and a second configuration, such that the first configuration provides an augmented magnetic field generated by the plurality of magnets 808 inside 802 the mandrel 806 relative to a magnetic field outside 804 the mandrel 806, and the second configuration provides an augmented magnetic field generated by the plurality of magnets 808 outside 804 the mandrel 806 relative to a magnetic field inside 802 the mandrel 806.

In order to selectively move between positions, the magnetic positioning tool 800 may comprise one or more driving systems 810. In an embodiment, the driving system 810 is configured to convert an axial movement of a component into a rotational motion of one or more of the magnets 808. The driving system 810 may generally comprise a gear 814 coupled to the magnet 808 through a shaft 812 and/or a driving member 816 configured to engage and actuate the gear 814. The shaft 812 may be coupled to at least one end of a permanent magnet 808, for example, by longitudinally extending from the center axis of the permanent magnet 808. One or more gears 814 may engage the shaft 812 and/or the driving member 816. As shown in FIG. 8B, the driving member 816 comprises an indicator 818 coupled to a profiled sleeve 815. The profiled sleeve 815 is configured to axially translate based on the engagement of the indicator 818, which may comprise an indicator on a collet, with a corresponding indicator on the outer wellbore tubular, casing, or wellbore wall. The axial motion of the sleeve 815 may cause the angled profile on the sleeve to engage a corresponding profile on a mating sleeve 817. The mating sleeve 817 is rotatably coupled to the mandrel 806 and restrained from axial movement. A gear profile is provided on an end of the mating sleeve 817 that is configured to mesh with the gear 814 coupled to the magnet 808. The corresponding profiles on the sleeve 815 and the mating sleeve 817 are configured to produce a rotational motion in the mating sleeve 817 as the sleeve 815 moves axially. A biasing member may retain the sleeve 815 axially spaced from the mating sleeve 817 until a force is applied to bias the sleeve 815 towards the mating sleeve 817.

In use, the magnetic positioning tool may be disposed in the wellbore and conveyed to a desired location with the magnets arranged in a first configuration. In this configuration, an augmented magnetic field may be generated by the plurality of magnets 808 inside 802 the mandrel 806 relative to a magnetic field outside 804 the mandrel 806. In order to actuate the magnetic positioning tool, the tool may be repositioned so that the indicator 818 may engage a corresponding indicator profile within the wellbore. A force applied to the magnetic positioning tool may result a biasing force being applied to the sleeve 815 to move the sleeve 815 towards the mating sleeve 817. The sleeve may have a lug 822 disposed on an interior surface that travels in a channel 820 on the outer surface of the mandrel 806. The lug 822 may be configured to engage the channel 820 and maintain the travel of the sleeve 815 in a substantially axial direction. As the sleeve 815 moves in an axial direction towards the mating sleeve 817, the corresponding profiles may result in the mating sleeve 817 rotating about the mandrel 806. The rotation of the mating sleeve 817 may result in a corresponding rotation of the gear profile and the gear 814 associated with one or more of the magnets 808 due to the meshing of gears 813, 814. The resulting rotation of the gear 814 may rotate the magnet a desired amount. The amount of rotation of the magnet 808 may be controlled by the design of the corresponding profiles and/or the use of a stop configured to limit the rotational motion of the magnet 808. Thus, the linear motion along the wellbore tubular from the indicator 818 may cause one or more of the permanent magnets to turn in unison. The resulting rotation of the appropriate magnets 808 may actuate the magnetic positioning tool to the second configuration. In this configuration, an augmented magnetic field may be generated by the plurality of magnets 808 outside 804 the mandrel 806 relative to a magnetic field inside the mandrel 806. The magnetic positioning tool may then be able to interact with a downhole component using the augmented magnetic field provided outside 804 the mandrel 806.

In an embodiment, the magnetic positioning tool 800 may magnetically interact with a wellbore tool by providing a magnetic field with a sufficient strength above a threshold. The magnetic field may interact with and provide a physical attractive force of sufficient magnitude to actuate one or more components of the wellbore tool and/or move the wellbore tool by moving the magnetic positioning tool 800 along the wellbore while the magnetic field interacts with the wellbore tool. After the wellbore tool has been actuated and/or moved to a desired position using the magnets 808, the indicator 818 may be released and moved back into the initial position (e.g., via a spring force acting on the driving member 816) and thus the permanent magnets can return to the initial position where the magnetic field projecting radially outward does not produce a magnetic field strong enough to sufficiently interact with adjacent (e.g., radially aligned) tools. The magnetic positioning tool 800 may be moved again along the wellbore, for example back to the surface or to another wellbore tool.

Figure 9A:
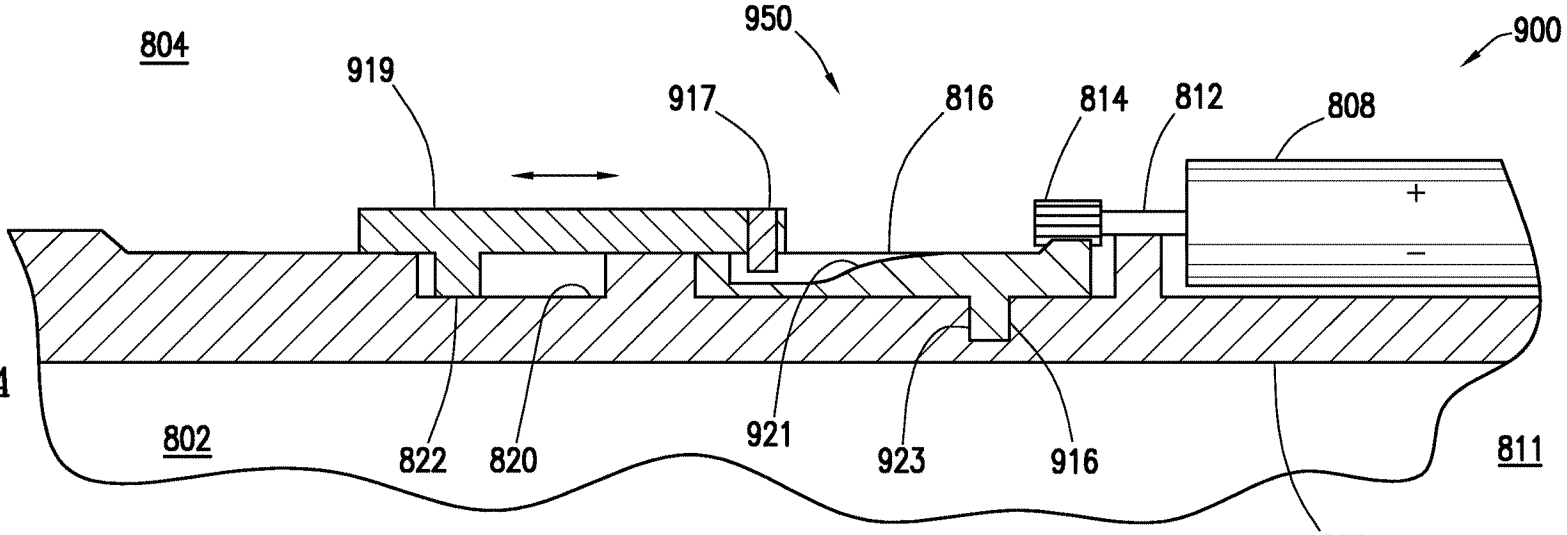
FIGS. 9A and 9B schematically represent another driving system of a magnetic positioning tool according to an embodiment.
Figure 9B:
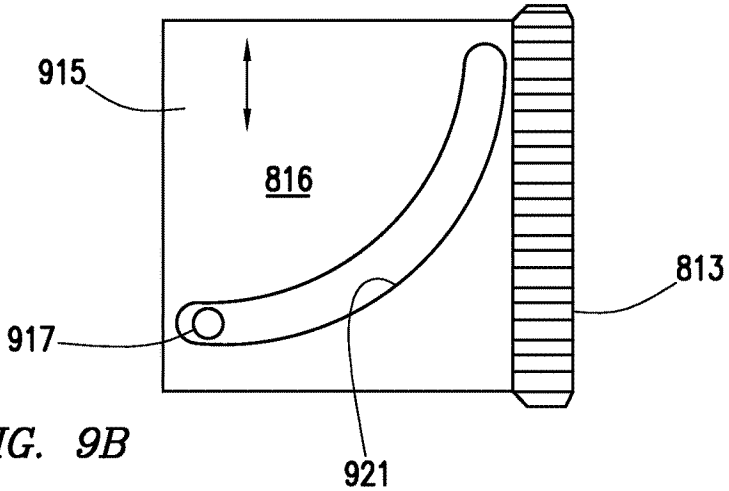

FIG. 9A illustrates an embodiment of a magnetic positioning tool 900 and a driving system 950 similar to the embodiment of the driving system 810 described with respect to FIGS. 8A and 8B. In this embodiment, a piston 919 may be disposed about the mandrel 806. The piston 919 may respond to a pressure supplied to the piston from the interior of the housing, an exterior of the housing, and/or from a control line. The piston may comprise a lug 822 disposed on an interior surface that travels in a channel 820 on the outer surface of the mandrel 806. The lug 822 may be configured to engage the channel 820 and maintain the travel of the piston 919 in a substantially axial direction. The driving system 950 may comprise a sleeve 915 disposed about the housing. A flange 916 may extend inward from the sleeve 915 and engage a corresponding circumferential recess 923 in the mandrel 806. The flange 916 may allow the sleeve 915 to rotate while being restrained from axial movement. The piston 919 may be coupled to a pin 917, which may in turn engage a helical slot 921 (e.g., a j-slot, an angled slot, etc.). As the piston 919 translates axially in response to pressure applied to the piston 919, the pin 917 may engage the side of the helical slot 921 and provide a rotational force to the sleeve 915. The sleeve 915 may rotate in response to the rotational force, thereby rotating the driving member 816 and the gear profile.

The rotation of the sleeve 915 may result in a corresponding rotation of the gear profile and the gear 814 associated with one or more of the magnets 808 due to the meshing of gears 813, 814. The resulting rotation of the gear 814 may rotate the magnet a desired amount. The amount of rotation of the magnet 808 may be controlled by the design of the helical slot 921 and the length of travel of the piston 919 and pin 917. The axial translation of the piston 919 may cause one or more of the permanent magnets to turn in unison. The resulting rotation of the appropriate magnets 808 may actuate the magnetic positioning tool to the second configuration. In this configuration, an augmented magnetic field may be generated by the plurality of magnets 808 outside 804 the mandrel 806 relative to a magnetic field inside 802 the mandrel 806. The magnetic positioning tool may then be able to interact with a downhole component using the augmented magnetic field provided outside 804 the mandrel 806.

Figure 10:
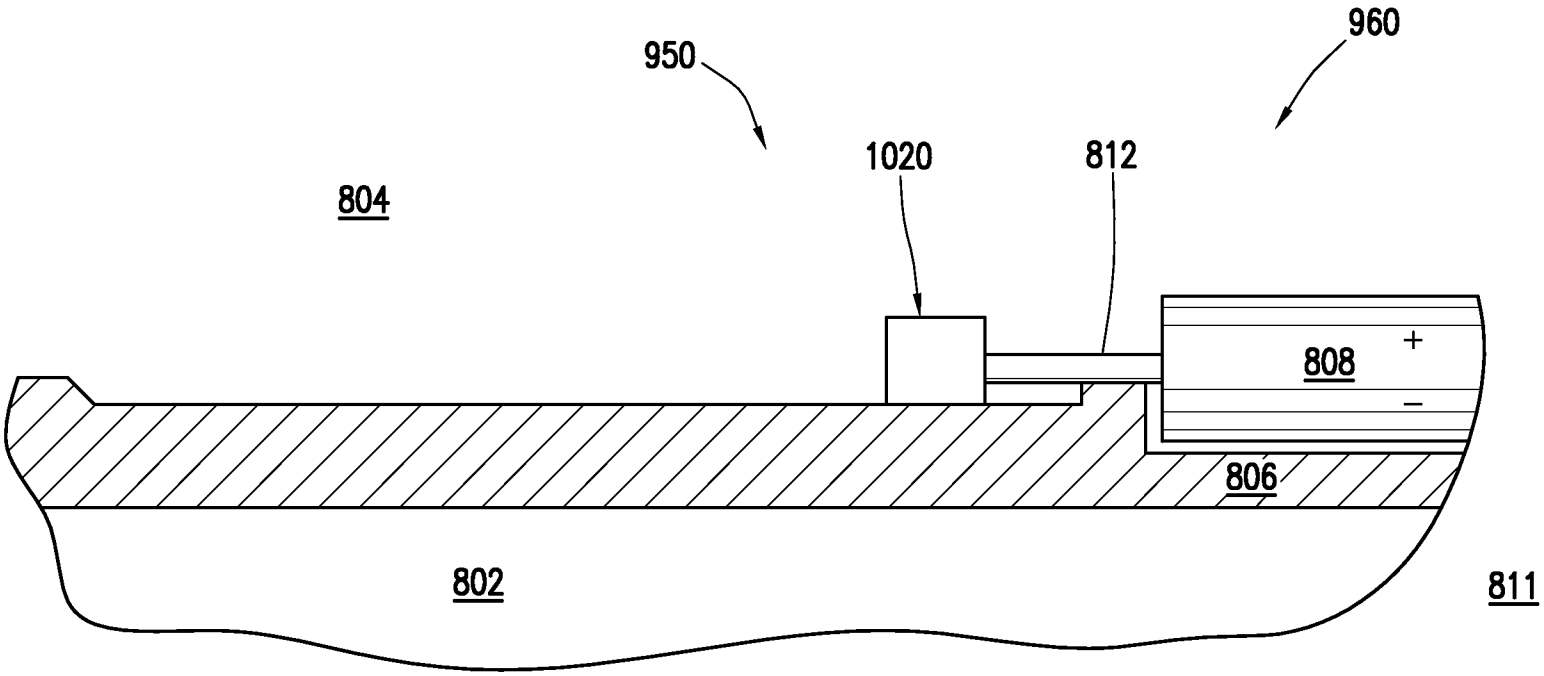
FIG. 10 schematically represents still another driving system of a magnetic positioning tool according to an embodiment.

FIG. 10 illustrates an embodiment of a magnetic positioning tool 960 and a driving system 950 comprising a motor 1020. For example, an electric motor 1020 may directly drive the shaft 812 of each magnet 808. In this embodiment, the individual magnets may be rotate independently, and the degree to which each magnet is rotated may be controlled. In a similar embodiment, an electric motor such as electric motor 1020 may drive a driving member, and the driving member may rotate a gear profile coupled to a gear 814 to rotate one or more magnet 808. A control system that may comprise a power source may be coupled to each electric motor 1020 and used to actuate each electric motor 1020.

In the embodiments illustrated in FIGS. 8A, 8B, 9A, 9B, and 10, the driving systems may be coupled to one or more of the plurality of permanent magnets 808 to selectively rotate at least one of the plurality of magnets 808 from, for example, a first configuration to a second configuration and/or from the second configuration to the first configuration. For example, a driving system may be coupled to each of the plurality of magnets 808 so that one driving system rotates each magnet 808 around the center axis of each of the magnets 808. In some embodiments, the driving system may be configured to move at least one of the plurality of magnets 808, for example, between the first configuration and the second configuration. Additionally, the plurality of magnets 808 may be biased to generate a stronger magnetic field outside the housing compared to the magnetic field inside the housing. The plurality of magnets 808 may be biased to generate a stronger magnetic field inside the housing compared to the magnetic field outside the housing. In yet another embodiment, the plurality of magnets 808 may be biased to generate a weak magnetic field both inside the housing and outside the housing.

Figure 11A:
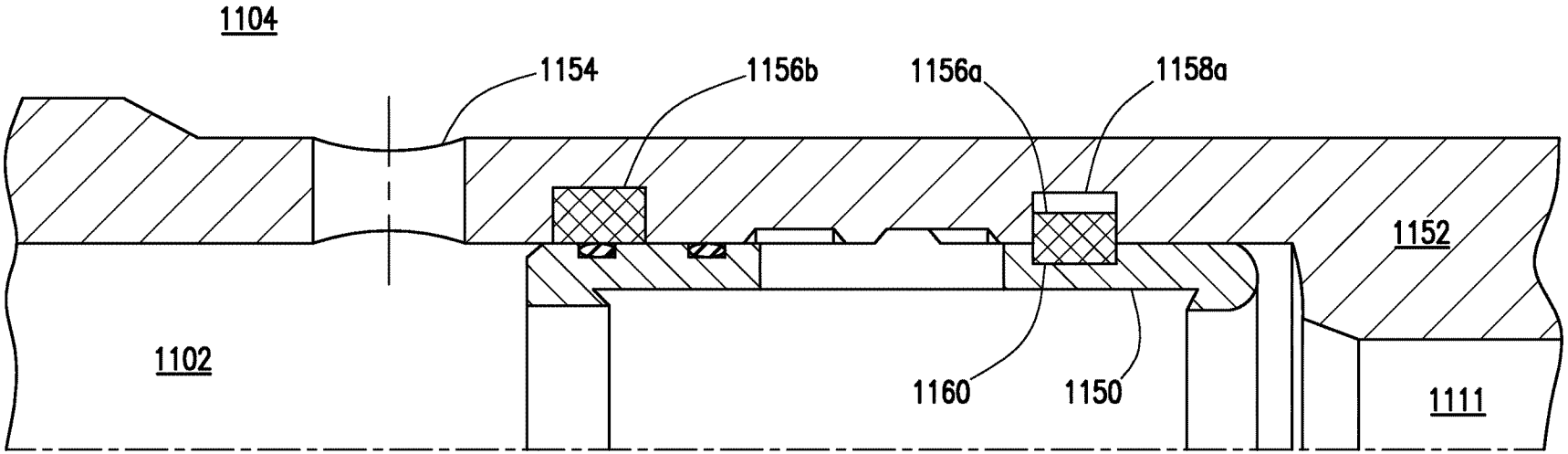
FIGS. 11A-11C schematically represent a magnetic positioning system according to an embodiment.

The magnetic positioning tool may be used for applications which require the locking and/or unlocking of a sleeve or another wellbore tool. FIG. 11A depicts a sleeve 1150 positioned adjacent to an outer housing 1152 within a wellbore tubular 1104. The outer housing 1152 may be part of the wellbore tubular string 1102 and form a throughbore 1111. In some embodiments, the outer housing 1152 may form a portion of a magnetic positioning tool. In an embodiment, the outer housing 1152 comprises a port 1154 which may allow the communication of one or more fluids (e.g., production fluid) through the outer housing 1152. Generally, the sleeve 1150 may comprise a non-ferromagnetic material. A key 1156*a* may be disposed in a circumferential recess in the inner surface of the outer housing 1152. The key 1156*a* may comprise a ferromagnetic material so that a magnetic field may act upon it. In the embodiment of FIG. 11A the key 1156*a* is biased away from the outer housing 1152 to engage the shoulder of the recess 1160 on the outer surface of the sleeve 1150. Alternatively, the key 1156*a* may be disposed in the shoulder of the recess 1160 and biased away from the sleeve 1150.

Figure 11C:
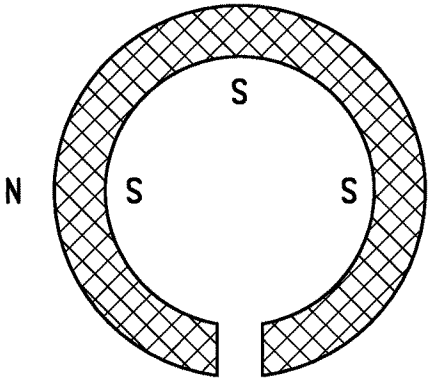
Figure 11B:
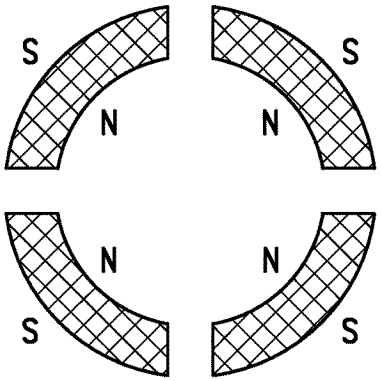

Regardless, because the key 1156*a* is biased (in the embodiment of FIG. 11A away from the outer housing 1152 and into the shoulder of the recess 1160), the key 1156*a* engages the shoulders forming the recess 1158*a* and the shoulder of the recess 1160. This engagement prevents relative movement of the sleeve 1150 with respect to the outer housing 1152. The key 1156*a* may comprise any shape capable of locking the sleeve 1150 in position relative to the outer housing 1152. For example, the key 1156*a* may comprise a pin, a ring, or the like. In an embodiment, the key 1156*a* comprises a ring-like shape as shown in FIGS. 11B and 11C. The key may comprise multiple portions with corresponding breaks between the portions to allow for expansion or contraction. Additionally, the key may be magnetized such that inside portion of the key is, for example, a north pole and the outside portion is, for example, a south pole. In some embodiments, the key may be magnetized such that inside portion of the key is, for example, a south pole and the outside portion is, for example, a north pole. As shown in FIG. 11B, the key may comprise four portions. In the contracted position, the portions of the key may contact each other, and in an expanded position, the four portions may separate to allow the key to expand outwards into contact with the outer housing 1152, thereby disengaging from the sleeve 1150. Similarly, FIG. 11C illustrates a key as a c-ring in which the ring may be biased outwards into contact with the outer housing 1152 upon the application of a sufficient outwards biasing force, which may be provided by a magnetic field with the appropriate field polarity.

Figure 12:
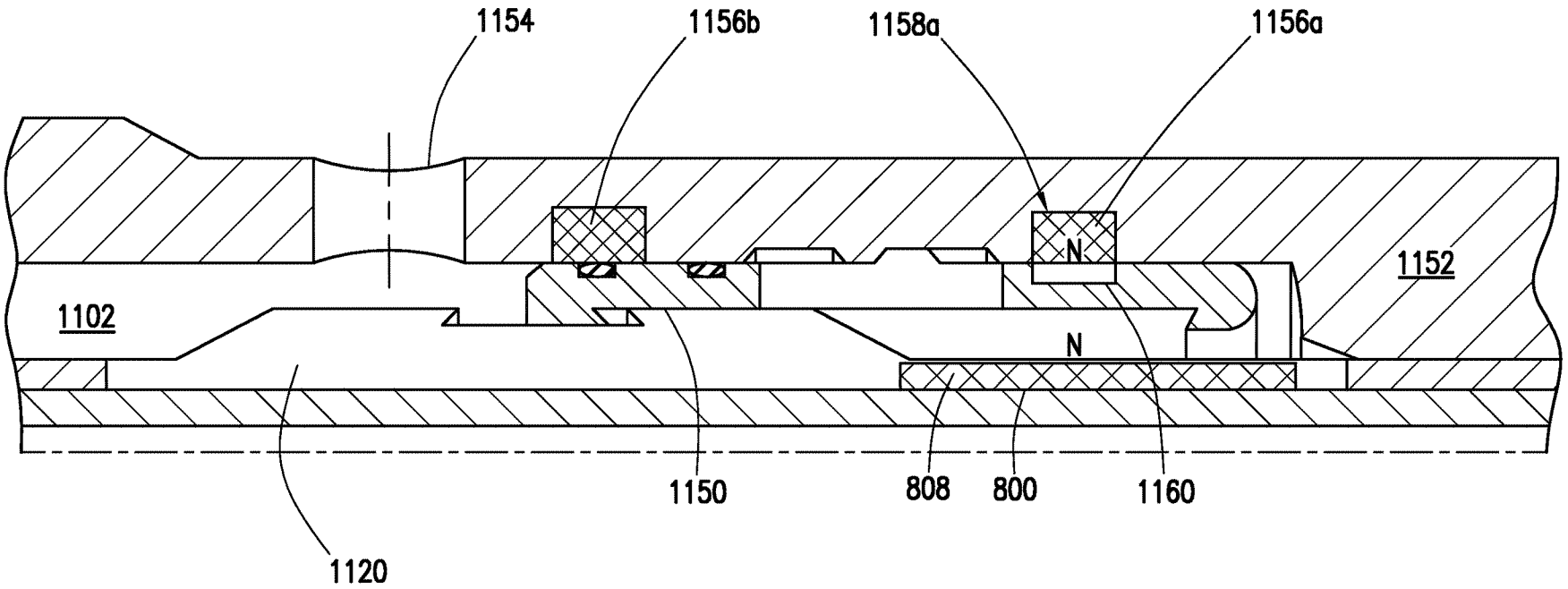
FIG. 12 schematically represents another magnetic positioning system according to an embodiment.

Operation of the magnetic positioning tool can be described with reference to FIGS. 11A and 12. The magnetic positioning tool 800 may be disposed within the throughbore 1111 of the outer housing 1152. The magnetic positioning tool 800 may form a portion of a shifting tool 1120 configured to couple with the sleeve 1150. The shifting tool 1120 may be engaged with an indicator on the sleeve. At this position, the magnetic positioning tool 800 may radially align with a key 1156*a* configured to lock or release the sleeve 1150 for movement. When the magnetic positioning tool 800 radially aligns with the key 1156*a*, the magnetic positioning tool 800 may be activated to produce a magnetic field in the direction of the outer housing 1152 and the key 1156*a*. The magnetic field may disengage the key 1156*a* with either the shoulder of the recess 1158*a* or the shoulder of the recess 1160. In the embodiment illustrated in FIG. 12, because the magnetic positioning tool 800 comprises a plurality of magnets, the north side of at least one of the magnets, for example, may be aligned with the key 1156*a* to repel and/or drive the key 1156*a* towards the outer housing 1152. The key 1156*a* may then disengage from the shoulder of the recess 1160. The disengagement of the key 1156*a* with either the shoulder of the recess 1158*a* or the shoulder of the recess 1160 unlocks the sleeve 1150 so that it may move along the outer housing 1152 within the wellbore tubular 1104. The engagement of the shifting tool 1120 with the sleeve 1150 may then allow the sleeve 1150 to be shifted.

Figure 13:
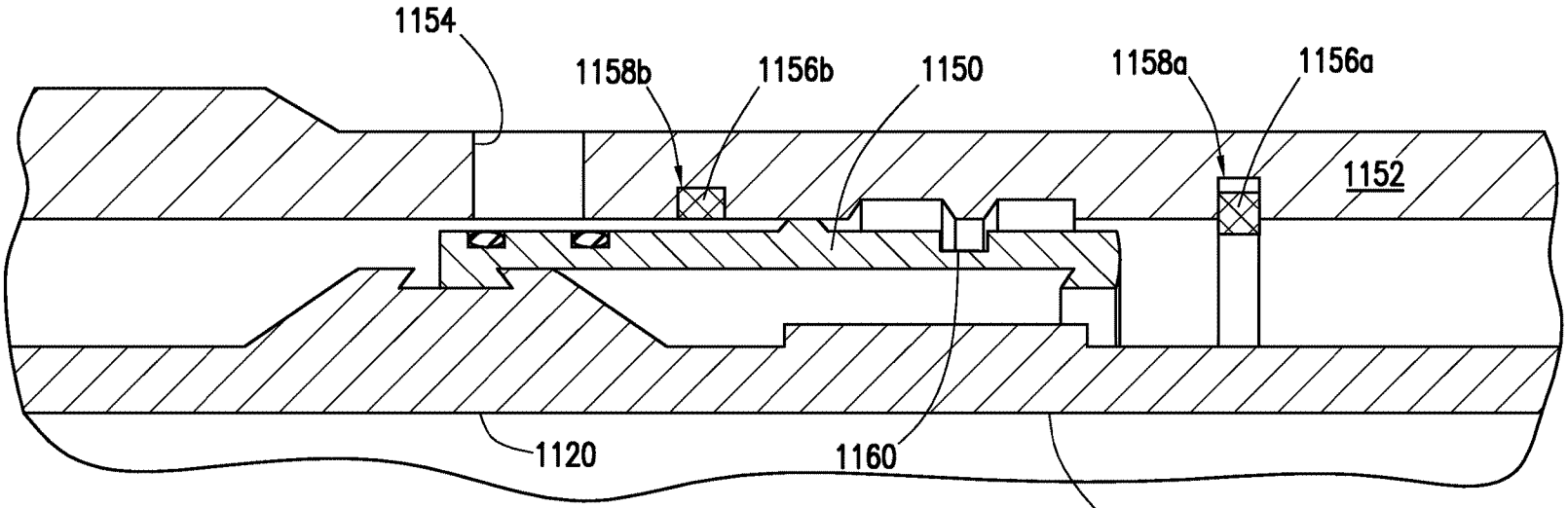
FIG. 13 schematically represents still another magnetic positioning system according to an embodiment.

As the sleeve 1150 continues to translate, the configuration of the sleeve 1150 and the outer housing 1152 may be as illustrated in FIG. 13. At this point, the shifting tool 1120 has engaged and displaced the sleeve 1150 a distance within the outer housing 1152 towards the port 1154. The magnetic positioning tool 800 may move with the shifting tool 1120 and sleeve 1150, thereby moving out of radial alignment with the key 1156*a*. As the sleeve 1150 translates, the sleeve 1150 may block the port 1154. In an embodiment, the sleeve 1150 may sealingly engage the outer housing 1152 about the port 1154 and thereby substantially prevent fluid communication through the port 1154.

Figure 14:
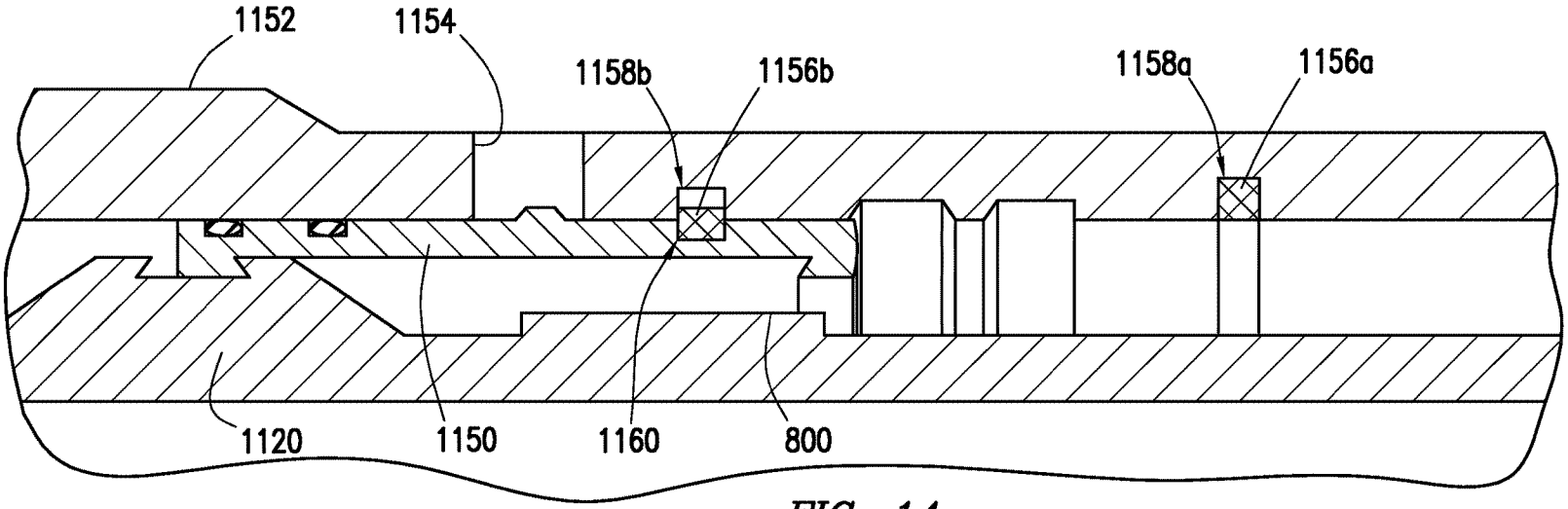
FIG. 14 schematically represents yet another magnetic positioning system according to an embodiment.

As the sleeve 1150 continues to translate, the configuration of the sleeve 1150 and the outer housing 1152 may be as illustrated in FIG. 14. A second key 1156*b* may be disposed in a recess 1158*b* in the outer housing 1152, and the second key 1156*b* may be biased away from the outer housing 1152. The magnetic positioning tool 800 may radially align with a second key 1156*b*. When the second key 1156*b* radially aligns with the shoulder of the recess 1160, the second key 1156*b* may be biased away from the outer housing 1152 and engage both the shoulder of the recess 1158*b* as well as the shoulder of the recess 1160. Furthermore, in this embodiment, the sleeve 1150 may have displaced due to the engagement with the shifting tool 1120 a distance so that the sleeve 1150 blocks the port 1154 preventing fluid communication through the port.

In an embodiment, operation of the magnetic positioning tool 800 may comprise similar actions, interactions, and/or movements to previously disclosed embodiments. The magnetic positioning tool 800 may be radially aligned with a key 1156*a*. After radial alignment, the magnets 808 may rotate as previously disclosed, thereby magnetically interacting with the key 1156*a*. Due to the magnetic interaction, the magnets may push the key 1156*a* into the recess 1158 so that key 1156*a* no longer engages with the shoulder of the recess 1160. A shifting tool 1120 may engage with the sleeve 1150 and axially move along the wellbore pulling the sleeve 1150 and the magnetic positioning tool 800 with it. The magnets 808 of the magnetic positioning tool 800 may then rotate again when the key 1156*a* is out of radial alignment of the shoulder of the recess 1160 so that a magnetic field no longer interacts with the key 1156*a*. As the sleeve 1150 is moved, the surface of the sleeve 1150 holds the keys 1156*a* and 1156*b* in their recesses 1158*a* and 1158*b*. The shifting tool 1120 may move until the second key 1156*b* is radially aligned with the shoulder of the recess 1160 and the shoulder of the recess 1160 so that the sleeve 1150 may no longer axially move along the wellbore. Additionally, because of the engagement of the second key 1156*b* and the shoulder of the recess, the sleeve 1150 may remain positioned over a port 1154. The shifting tool 1120 coupled with the magnetic positioning tool 800 may then be moved to another location within the wellbore and/or removed from the wellbore at the surface.

Figure 15:
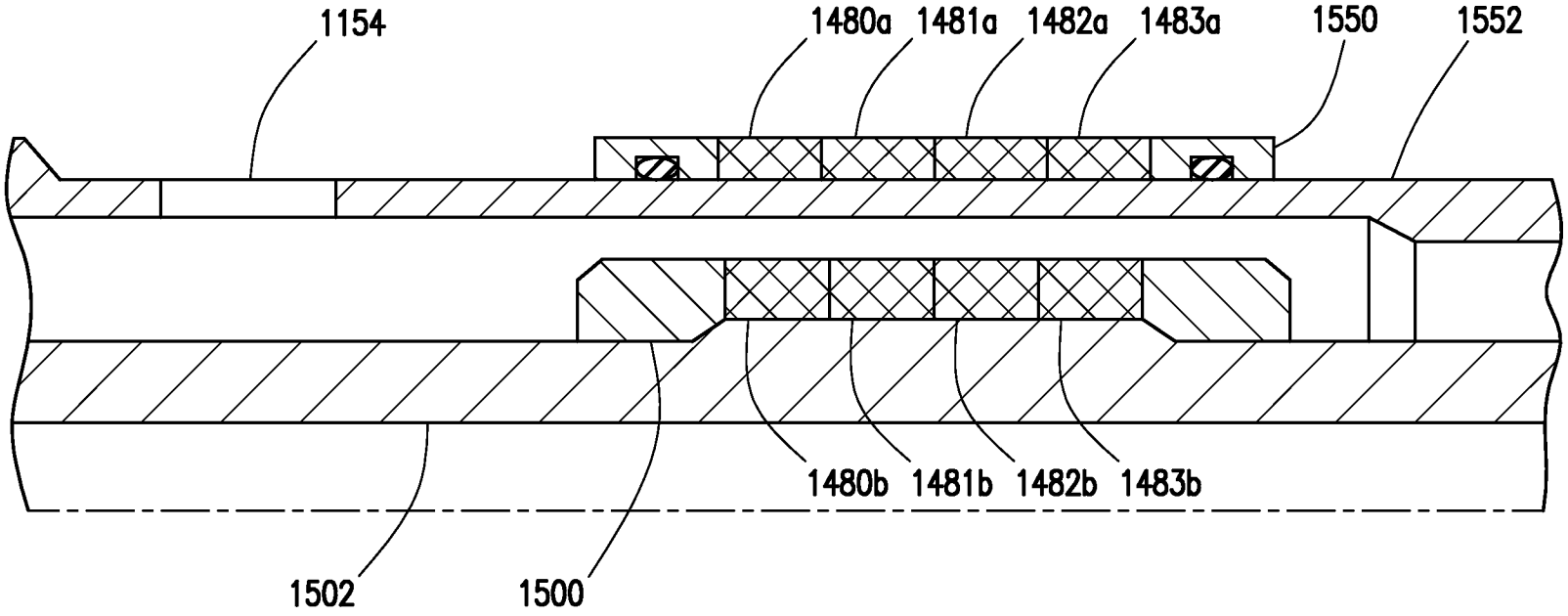
FIG. 15 schematically represents a magnetic positioning system according to an embodiment.

FIG. 15 depicts a magnetic positioning tool 1500 disposed within a housing 1552 and radially aligned with a sleeve 1550 that is slidingly disposed about the outer housing 1552. The magnetic positioning tool 1500 may be disposed about an inner housing 1502 and/or form a portion of a tool string. For example, the magnetic positioning tool 1500 may be coupled at an upper and/or lower end to another component (e.g., using a threaded connection) to allow the magnetic positioning tool 1500 to be conveyed within the wellbore. The sleeve 1550 may comprise a ferromagnetic material and/or one or more magnets such that when the magnetic positioning tool 1500 is actuated, the magnetic field created by the magnetic positioning tool 1500 may interact with the sleeve 1150. In order to allow a magnetic interaction between the sleeve 1550 and the magnetic positioning tool 1500, the outer housing 1552 may comprise a non-ferromagnetic material, thereby providing a magnetic window. When the magnetic positioning tool 1500 is translated within the outer housing 1552, the sleeve 1550 may also be displaced along the wellbore tubular towards the port 1154 due to the magnetic interaction with the magnetic positioning tool 1500. The magnetic positioning tool 1500 may slide the sleeve 1150 along the outer housing 1552, for example, until the sleeve 1150 covers the port 1154. The sleeve 1550 may sealingly engage the outer housing 1552 so that no fluid may communicate through the port from one side of the outer housing 1552 to the other side of the outer housing 1552 when the sleeve 1550 is disposed over the port 1154.

The sleeve 1550 may be configured to translate along the outer housing 1552 over a defined range, for example, using end stops or shoulders disposed on the outer surface of the outer housing 1552. As the magnetic positioning tool 1500 passes the port 1154, the sleeve 1550 may be retained in position over the port 1154 and magnetically decouple from the magnetic positioning tool 1500. In some embodiments, the magnetic positioning tool 1500 may be deactuated to thereby decouple the magnetic positioning tool 1500 from the sleeve 1550. In an embodiment, the sleeve 1550 may be repositioned out of alignment with the port 1154 by using the magnetic positioning tool 1500 to pull the sleeve 1150 away from the port 1154 so that fluid may again communicate through the port 1154. While described in terms of aligning a sleeve 1550 with a port 1154, various other types of movements of sleeves, locking members, and the like may similarly be moved through a magnetic interaction between the magnetic positioning tool 1500 and a component disposed about a mandrel.

The magnetic positioning tool 1500 may be actuated by rotating the magnets associated with the magnetic positioning tool 1500 to create a Halbach Array, a Halbach Cylinder, or simply rotating a plurality of magnets into a pattern configured to interact with the sleeve 1550. When the magnets are rotated to form a Halbach Array or a Halbach Cylinder, the magnetic positioning tool 1500 may be the same or similar to any of the tools described above.

In an embodiment, the magnetic positioning tool 1500 may comprise a plurality of magnets disposed about a housing of the magnetic positioning tool 1500. This configuration may allow for selective sets of magnets to be rotated and/or axially spaced into a desired pattern, which may correlate with corresponding patterns of ferromagnetic and/or magnetized segments on the sleeve 1150. In some embodiments, a magnetic interaction between a magnetic positioning tool 1500 and a sleeve 1550 may be based on an axial pattern of magnet poles in the sleeve 1550 and/or the magnetic positioning tool 1500. For example, as shown in FIG. 15, the sleeve 1550 may comprise a first segment 1480*a*, a second segment 1481*a*, a third segment 1482*a*, and a fourth segment 1483*a*. Each of the segments 1480*a*, 1481*a*, 1482*a*, and 1483*a* may comprise a magnetic material, which may or may not be magnetized with a particular polarity, or a non-magnetic material. Similarly, the magnetic positioning tool 1500 may comprise a plurality of segments 1480*b*, 1481*b*, 1482*b*, and 1483*b* that may comprise a magnetic material, which may or may not be magnetized with a particular polarity, or a non-magnetic material. In order for the magnetic positioning tool 1500 to interact with the sleeve 1550 with a force above a threshold needed to translate the sleeve 1550, the segments 1480*b*, 1481*b*,

1482*b*, and 1483*b* on the magnetic positioning tool 1500 can substantially align and correspond to the segments 1480*a*, 1481*a*, 1482*a*, and 1483*a* on the sleeve 1550. For example, a magnetic segment on the magnetic positioning tool 1500 may align with a ferromagnetic segment on the sleeve 1550. When the segment on the sleeve 1550 is magnetized, the corresponding segment on the magnetic positioning tool 1500 can have a magnetic polarity aligned to interact with the magnetic polarity of the segment on the sleeve. For example, opposite polarities attract. Further, when the segment on the sleeve 1550 does not comprise a ferromagnetic material, the segment on the magnetic positioning tool 1500 may either be non-ferromagnetic or magnetic, but in either case a magnetic interaction will not occur as a result of the alignment of the segments. In some embodiments, less than all of the segments may correspond to provide an attractive force great enough to exceed a threshold needed to translate the sleeve 1550 using the magnetic positioning tool 1500.

The use of a plurality of segments 1480*b*, 1481*b*, 1482*b*, and 1483*b* on the magnetic positioning tool 1500 and a plurality of segments 1480*a*, 1481*a*, 1482*a*, and 1483*a* on the sleeve 1550 may allow the magnetic positioning tool 1500 to be keyed to interact with one or more particular sleeves. Moreover, one or more of the segments 1480*b*, 1481*b*, 1482*b*, and 1483*b* on the magnetic positioning tool 1500 may be individually rotated within the wellbore. This may allow the magnetic positioning tool 1500 to be placed in a neutral position in which the magnetic positioning tool 1500 may not interact with any sleeves within the wellbore. When a particular sleeve is to be actuated to a new position, the segments 1480*a*, 1481*a*, 1482*a*, and 1483*a* on the magnetic positioning tool 1500 may be rotated into a desired key configuration that corresponds to the sleeve to be actuated. The resulting keyed configuration may then be used to interact with the sleeve. The magnetic positioning tool 1500 may then be returned to a neutral position to release the sleeve and convey the magnetic positioning tool 1500 to a new location in the wellbore. While the magnets associated with the magnetic positioning tool 1500 may be permanent magnets that may interact to some degree with the magnets of the sleeve even in the neutral position, the configuration of the segments 1480*b*, 1481*b*, 1482*b*, and 1483*b* on the magnetic positioning tool 1500 may not provide a magnetic force great enough to exceed a threshold needed to translate or otherwise move the sleeve. This may allow the magnetic positioning tool 1500 to be translated in the wellbore without inadvertently actuating a sleeve or other downhole component.

Figure 16:
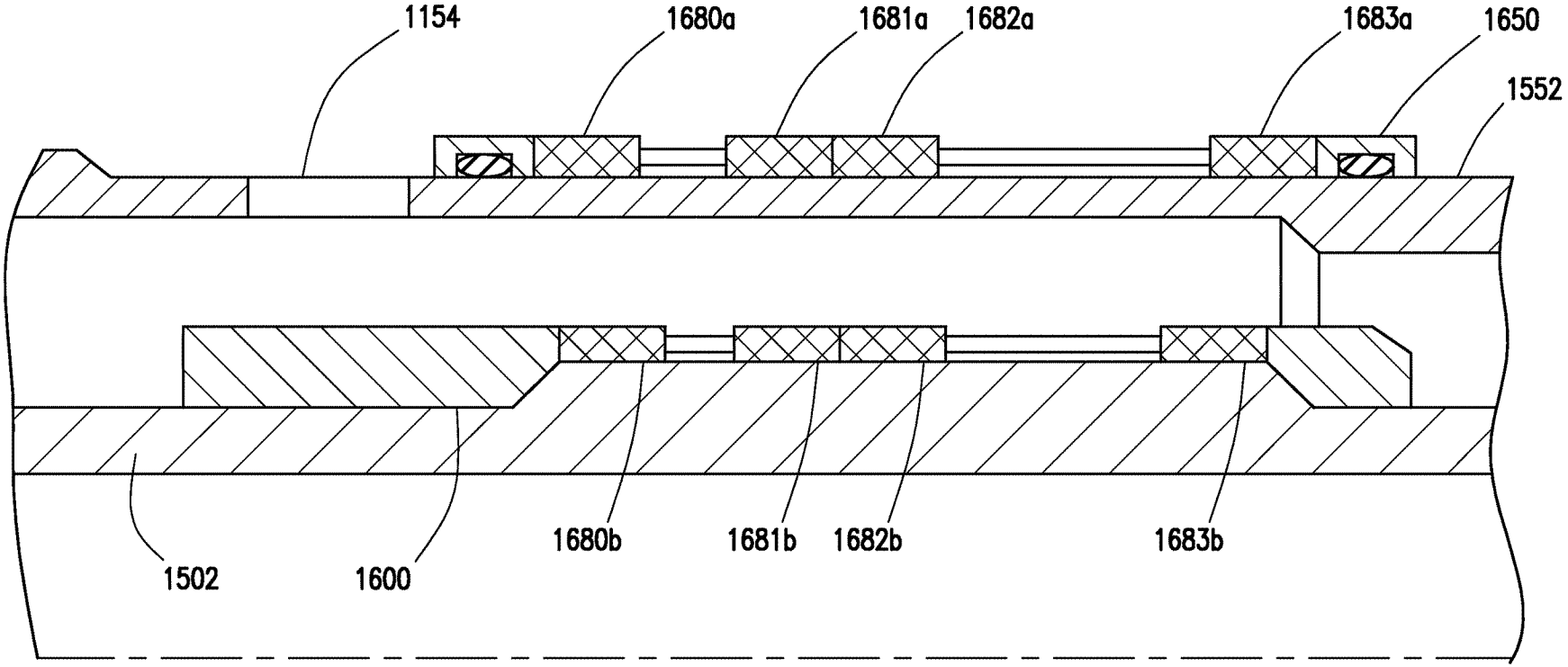
FIG. 16 schematically represents another magnetic positioning system according to an embodiment.

Another embodiment of a magnetic positioning tool 1600 comprising a keyed magnetic pattern is illustrated in FIG. 16. The embodiment of the magnetic positioning tool 1600 illustrated in FIG. 16 is similar to the embodiment of the magnetic positioning tool 1500 illustrated in FIG. 15 and similar components will not be described in the interest of clarity. In this embodiment, a magnetic interaction between a magnetic positioning tool 1600 and a sleeve 1650 may be based on an axial spacing and/or rotation of segments in the sleeve 1550 and/or the magnetic positioning tool 1500. For example, the sleeve 1650 may comprise a first segment 1680*a*, a second segment 1681*a*, a third segment 1682*a*, and a fourth segment 1683*a*. Each of the segments 1680*a*, 1681*a*, 1682*a*, and 1683*a* may comprise a magnetic material, which may or may not be magnetized with a particular polarity, or a non-magnetic material. Further the segments 1680*a*, 1681*a*, 1682*a*, and 1683*a* may be selectively spaced to form a keyed pattern. The pattern may be common to one or more sleeves in a wellbore, or the pattern may be unique to an individual sleeve in the wellbore. The magnetic positioning tool 1600 may comprise a plurality of segments 1680*b*, 1681*b*, 1682*b*, and 1683*b* that may comprise a magnetic material, which may or may not be magnetized with a particular polarity, or a non-magnetic material. In this embodiment, the magnetic positioning tool 1600 may be configured to axially translate one or more of the individual segments 1680*b*, 1681*b*, 1682*b*, and 1683*b* using for example, a liner actuator. The segments 1680*b*, 1681*b*, 1682*b*, and 1683*b* may comprise cylindrical magnetic sections that may allow for axial translation of multiple segments using individual linear actuators for each segment.

In order for the magnetic positioning tool 1600 to interact with the sleeve 1650 with a force above a threshold needed to translate the sleeve 1650, the segments 1680*b*, 1681*b*, 1682*b*, and 1683*b* on the magnetic positioning tool 1600 can be substantially, radially aligned to correspond to the segments 1680*a*, 1681*a*, 1682*a*, and 1683*a* on the sleeve 1650. For example, the magnetic segments may interact based on any of the interactions described above with respect to FIG. 15. Further, the segments 1680*b*, 1681*b*, 1682*b*, and 1683*b* on the magnetic positioning tool 1600 may be translated to having a spacing that is substantially aligned with the spacing of the segments 1680*a*, 1681*a*, 1682*a*, and 1683*a* on the sleeve 1650. In some embodiments, less than all of the segments may correspond to provide an attractive force great enough to exceed a threshold needed to translate the sleeve 1650 using the magnetic positioning tool 1600.

The use of a plurality of segments 1680*b*, 1681*b*, 1682*b*, and 1683*b* on the magnetic positioning tool 1600 and a plurality of segments 1680*a*, 1681*a*, 1682*a*, and 1683*a* on the sleeve 1650 may allow the magnetic positioning tool 1600 to be keyed to interact with one or more particular sleeves based on the axial spacing of the segments. Moreover, one or more of the segments 1680*b*, 1681*b*, 1682*b*, and 1683*b* on the magnetic positioning tool 1600 may be individually axially translated within the wellbore. This may allow the magnetic positioning tool 1600 to be placed in a neutral position in which the magnetic positioning tool 1600 may not interact with any sleeves within the wellbore. When a particular sleeve is to be actuated to a new position, the segments 1680*b*, 1681*b*, 1682*b*, and 1683*b* on the magnetic positioning tool 1600 may be axially translated into a desired key configuration that corresponds to the sleeve to be actuated within the wellbore. The resulting keyed configuration may then be used to interact with the sleeve. The magnetic positioning tool 1600 may then be returned to a neutral position to release the sleeve and convey the magnetic positioning tool 1600 to a new location in the wellbore. While the magnets associated with the magnetic positioning tool 1600 may be permanent magnets that may interact to some degree with the magnets of the sleeve even in the neutral position, the configuration of the segments 1680*b*, 1681*b*, 1682*b*, and 1683*b* on the magnetic positioning tool 1600 may not provide a magnetic force great enough to exceed a threshold needed to translate or otherwise move the sleeve. This may allow the magnetic positioning tool 1600 to be translated in the wellbore without inadvertently actuating a sleeve or other downhole component.

In some embodiments, the magnetic positioning tool may be adjusted using any combination of rotation and axial displacement. For example, a single magnetic positioning tool may comprise a plurality of segments that can rotate and axially translate within the wellbore to provide a keyed pattern to match a downhole component such as a sleeve. The keyed pattern may then be used to actuate the downhole component within the wellbore. While the embodiments of the magnetic positioning tool described with respect to FIGS. 15 and 16 are shown with four segments, any number of segments may be used. For example, two, three, or more than four segments may be used. In general, the number of segments may be selected to provide the number of keyed patterns desired for a wellbore. For example, an appropriate number of segments may be selected to provide at least as many combinations as the number of combinations on the downhole components to be engaged within the wellbore. In some embodiments, the number of segments and combinations may be less than the number of downhole components, and the ability to selectively configure the keyed pattern within the wellbore at or near the downhole components of interest may be relied upon to actuate the various downhole components in the wellbore.

Figure 17:
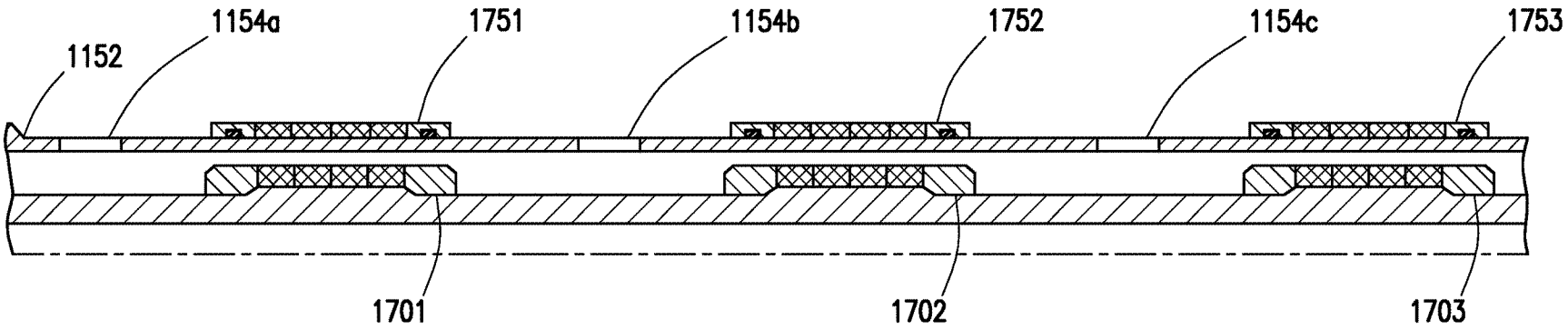
FIG. 17 schematically represents still another magnetic positioning system according to an embodiment.

FIG. 17 illustrates a plurality of magnetic positioning tools 1701, 1702, 1703 disposed within an outer housing 1152, and a plurality of downhole components such as sleeves 1751, 1752, 1753 disposed about the outer housing 1152. The magnetic positioning tools 1701, 1702, 1703 may be similar to any of those magnetic positioning tools described above. The sleeves 1751, 1752, 1753 may be configured to move relative to the outer housing 1152 in response to a force applied above a threshold due to a magnetic coupling with one or more of the magnetic positioning tools 1701, 1702, 1703. The plurality of magnetic positioning tools 1701, 1702, 1703 may each be configured to assume different keyed patterns, thereby providing a greater number of keyed pattern combinations than could be achieved using a single magnetic positioning tool. The plurality of magnetic positioning tools 1701, 1702, 1703 may each be configured to magnetically couple to one or more of the sleeves 1751, 1752, 1753. When multiple magnetic positioning tools 1701, 1702, 1703 can magnetically couple with a plurality of sleeves 1751, 1752, 1753, the additional magnetic positioning tools 1701, 1702, 1703 configure to magnetically couple to any given sleeve 1751, 1752, 1753 may serve as a redundant backup in the event the first magnetic positioning tool fails to properly actuate to the appropriate configuration. Further, the use of a plurality of magnetic positioning tools 1701, 1702, 1703 may allow for more than one sleeve 1751, 1752, 1753 to be actuated at the same time.

Figure 18A:
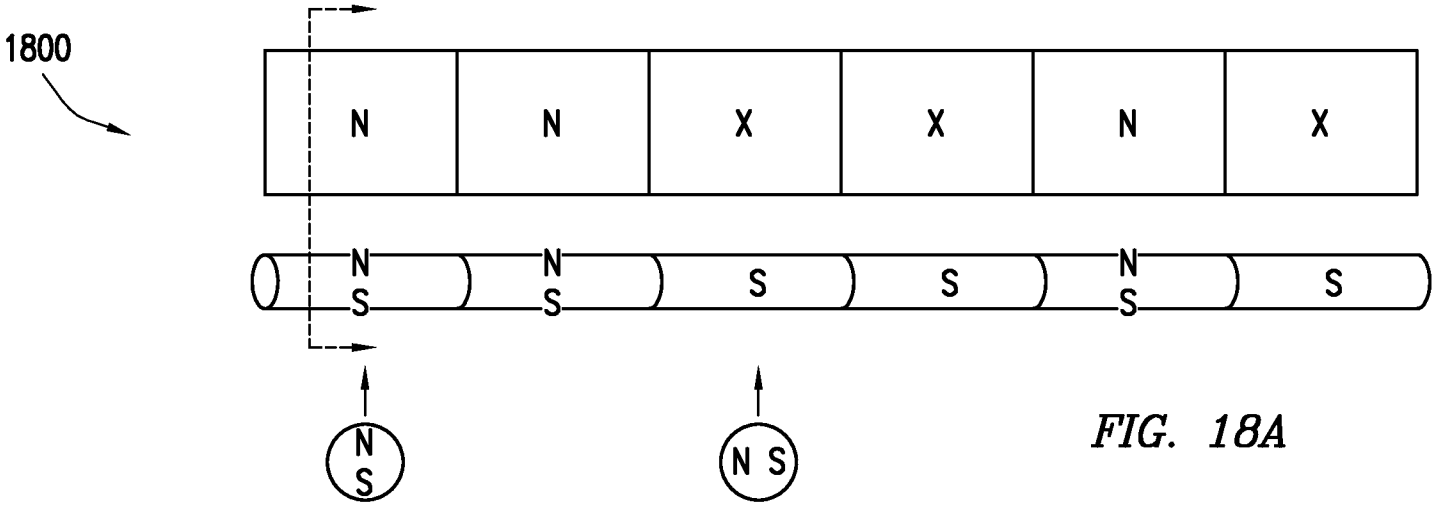
FIGS. 18A-18C schematically represent a patterned arrangement of a plurality of magnetic segments according to an embodiment.
Figure 18B:
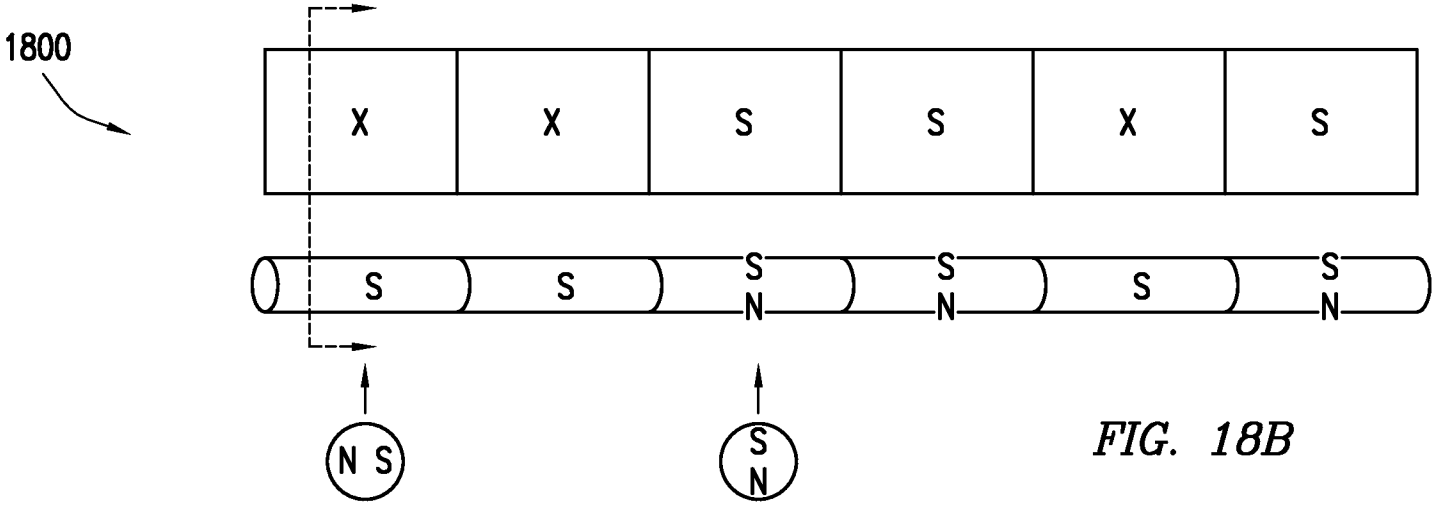
Figure 18C:
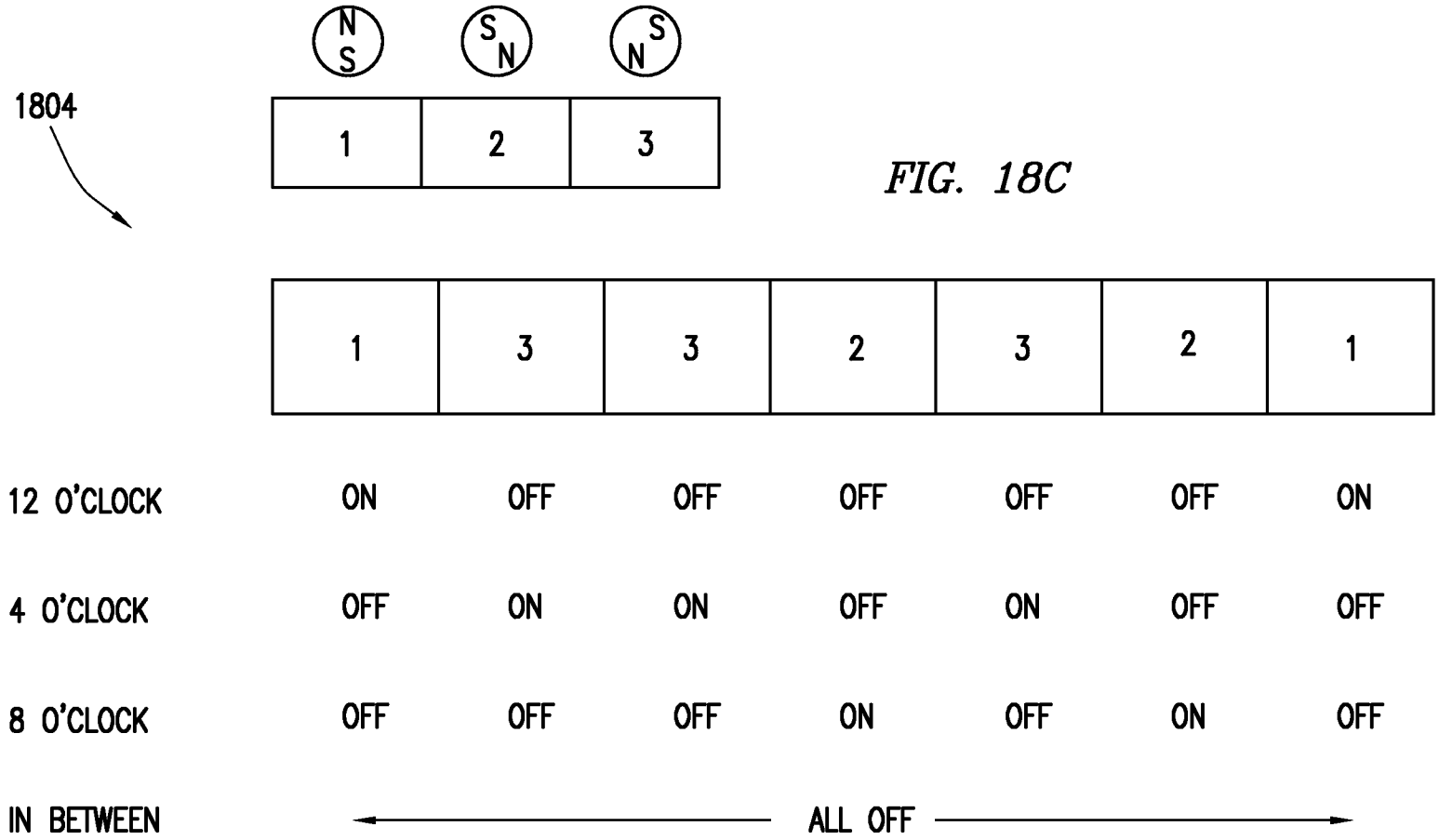

In an embodiment, the magnets within the magnetic positioning tool may be used with a magnetic sensor to provide a keyed pattern that may generate a signal within the wellbore. As shown in FIGS. 18A-18C, the rotation of the magnets to assume a keyed pattern may occur in a number of ways. In general, a magnet may be rotated through a plurality of angular positions to change the relative direction of the magnetic polarization with respect to the axis of the wellbore. The resulting magnetic polarization may then be used to interact with another component by having an appropriate field strength above a threshold, or the magnet may not interact with another component due to the resulting magnetic field having a strength below a threshold. In some embodiments, a magnetic sensor may be used to determine the relative direction of the magnetic polarization with respect to the axis of the wellbore. The magnetic sensors may be sensitive enough to determine the orientation of a magnet in a plurality of positions. Any number of rotational positions are possible when used with a magnetic sensor so long as the sensor is capable of distinguishing between positions of the magnets.

An embodiment of a two position rotational array is illustrated in FIG. 18A. In this embodiment, a first position may be defined as having a north or south pole directed radially outwards, and a second position may be defined as having neither a north or south pole directed radially outwards (e.g., having the north and south aligned perpendicular to the radial direction). Multiple segments may then be oriented on a magnet with each segment having either the first or second positions. The resulting sequence may be considered a magnetic pattern. As shown in FIG. 18A, the plurality of permanent magnets 1800 may comprise a first sequence (from left to right) of first position, first position, second position, second position, first position, and second position. This resulting sequence may be detected by a sensor and used to generate a signal in response to the sequence. For example, a valve may be actuated open or closed in response to the sequence. In some embodiments, the sequence may be used to physically interact with, for example, a tool with a correlating sequence as described above with respect to FIGS. 15 and 16. The magnets 1800 may be rotated as a single unit to provide a different sequence. As shown in FIG. 18B, the magnets 1800 may be rotated through ninety degrees to provide a new pattern of second position, second position, first position, first position, second position, and first position. A sensor may detect the second pattern to generate a signal or a magnetic coupling. The signal may be used to indicate an action for a downhole controller or component, to physically interact with a different tool, and/or to not physically interact with a tool. If the magnets 1800 were to be rotated forty five degrees, all of the segments would be in the second position, which may represent a neutral or "off" pattern.

In an embodiment, more than two positions may be used for the segments of the magnets. As illustrated in FIG. 18C, a three position array could be used. In this embodiment, a first position may be defined as having the north pole directed radially outwards, a second position may be defined as having the north pole rotated 120 degrees with respect to the first position, and a third position may be defined as having the north pole rotated an additional 120 degrees from the second position. The magnet may be configured to interact with a sensor or downhole component when a pole (e.g., the north) pole is directed radially outwards, which may be considered the "on" position. Any position in which a pole is not directed radially outwards may be considered an "off" position. The resulting pattern of the exemplary as shown in FIG. 18C may then be shown in the initial position having a pattern of: on, off, off, off, off, off, and on. A rotation of 120 degrees may generate a pattern of: off, on, on, off, on, off, and off. A rotation of the magnets outside one of the defined positions may result in none of the magnetic poles being directed outwards so that all positions would be considered "off," which may be considered a neutral or "off" configuration. The positional arrays could be further defined with four, five, six, or more positions. The appropriate rotation of the magnets could then be used to generate additional magnetic patterns.

Figure 19:
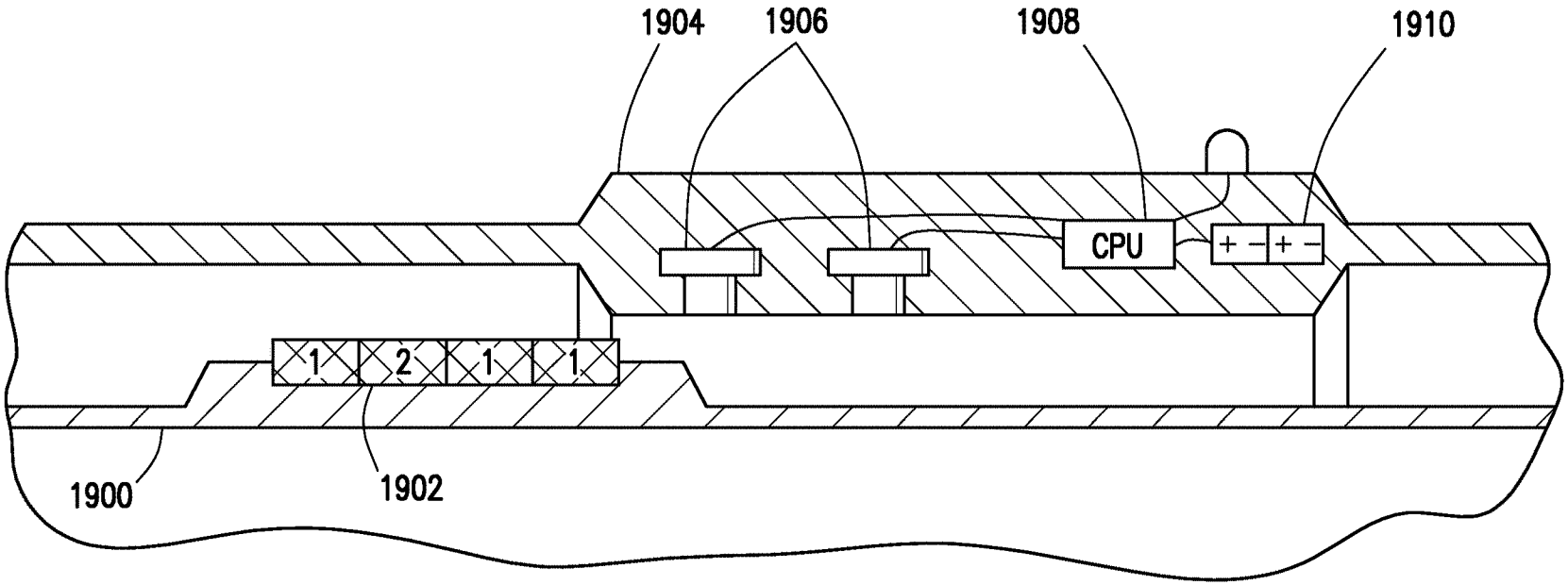
FIG. 19 schematically represents a magnetic positioning system according to an embodiment.

FIG. 19 depicts a magnetic positioning tool 1900 comprising a plurality of permanent magnets 1902 in a selectable sequence. The magnetic positioning tool 1900 may be configured to change the magnetic pattern of the plurality of permanent magnets 1902 by rotating the permanent magnets 1902 as disclosed above. An assembly 1904 comprising at least one sensor 1906 coupled to a controller 1908 may generate a signal in response to detecting one or more magnet patterns of the permanent magnets 1902. The sensor 1906 may detect magnetic fields produced by the sequenced permanent magnets 1902 as the magnets move past the sensor 1906. The sensor 1906 may transmit a signal to the controller 1908. When the controller 1908 receives the signal, the controller 1908 may actuate, for example, an actuatable member. In an embodiment, the controller 1908 may actuate an actuatable member after a time delay from the time the controller 1908 received the signal. This type of actuation may be thought of as an "indirect actuation" in that a signal is first generated and then another component is actuated based on the signal without being directly actuated by the component generating the signal. In an embodiment, the sensor 1906 may comprise a giant magneto-resistive sensor, hall-effect sensor, conductive coils, and/or the like. In an embodiment, the assembly 1904 and any electronic components associated with the assembly 1904 may be powered by a power source 1910 such as a battery, a downhole generator, and/or an electrical line coupled to an external power source (e.g., at the surface or within another component in the wellbore).

The magnetic positioning tool 1900 may be displaced along the wellbore and pass by the assembly 1904. The permanent magnets 1902 may be rotated to provide a desired pattern to the sensor 1906 to generate a signal. The signal may be used to perform any number of actions. For example, the signal may cause the controller to actuate a valve, for example, to an open position or a closed position, activate a hydrostatic chamber to shift a sleeve open or closed, set a hydraulic packer, release a compaction joint, or any other suitable action that can be performed by a sensor and separate actuation device. Once the magnetic positioning tool 1900 passes by the sensor, the permanent magnets 1902 may be rotated to a neutral position to avoid generating any additional signals, or the magnets may be rotated to generate a different signal upon a subsequent pass by the sensor. For example, a first magnetic pattern may be configured to generate a signal to open a valve as the magnetic positioning tool 1900 moves downward in a wellbore. After a wellbore operation is completed, the magnets may be rotated to generate a second signal. As the magnetic positioning tool 1900 moves upwards past the sensor, a second signal based on the rotated pattern may cause the controller to generate a second signal to close the valve. Any number patterns may be used to generate a corresponding number of signals, and the signals may be used to perform a variety of actions within the wellbore.

Additionally, while only one sensor 1906 may be used to detect a magnetic pattern on the magnetic positioning tool 1900, two or more sensors 1906 may be used to determine which direction the magnetic positioning tool 1900 is traveling within the wellbore, and the action of the controller may be further based on the signal generated from the pattern as well as the direction of the magnetic positioning tool 1900.

In an embodiment, a method of signaling a tool in the completion may be performed with a sequence of magnetic fields using, for example, the system depicted in FIG. 19. In this embodiment, the positioning tool may be configured to produce a magnetic signal by aligning and/or configuring the magnets in a particular pattern. A downhole tool or sensor can read the alignment and/or configuration of passing magnets to thereby generate a signal indicative of the alignment and/or configuration. A microprocessor coupled to the tool or sensor can receive the signal and actuate a tool based on the signal indicative of the series of passing magnetic fields produced by the positioning tool. When the signal is not one that the microprocessor is configured to respond to, the microprocessor coupled to the tool or sensor may not actuate any device or tool in response to receiving the signal. In some embodiments, the microprocessor may comprise logic to provide a delayed actuation, a single actuation, and/or a plurality of actuations in response to receiving the signal.

Figure 20:
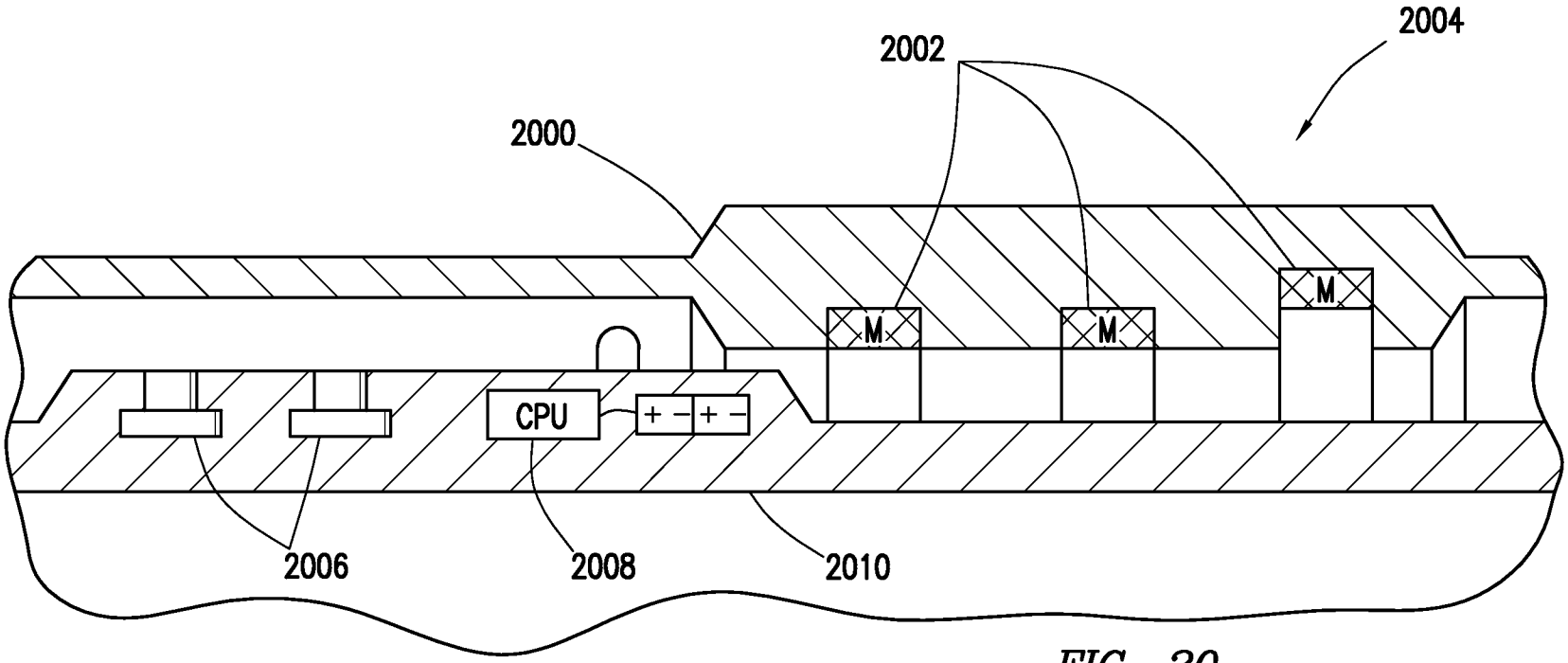
FIG. 20 schematically represents still another magnetic positioning system according to an embodiment.

FIG. 20 depicts an embodiment of the selectable positioning tool 2000 comprising a plurality of magnets 2002 in a sequence. Similar to previous embodiments, the selectable positioning tool 2000 is configured to change the sequence of magnets 2002 by rotating the magnets 2002 as previously disclosed. The selectable positioning tool 2000 may be mounted with an assembly 2004, such as an assembly 2004 which is part of completion equipment. A particular sequence of magnets may indicate the setting of a packer, a release of a packer, the shifting of a production sleeve, the parting of a shear joint, activating a compaction joint, and/or the like. By rotating of the permanent magnets 2002 to provide a particular sequence, the one or more sensors 2006 and the controller 2008 within a passing tool 2010 may detect the magnetic pattern of the magnets in the assembly 2004, which may indicate an action or the status of the assembly 2004. Similar to previous embodiments, the sensor (s) 2006 may comprise a giant magneto-resistive sensor, hall-effect sensor, conductive coils and/or the like. The passing tool 2010 may be used to record the sequence of the magnets to be read at a later time, signaling the sequence to the surface in real time, activating another tool, and/or the like.

In an embodiment, a method of signaling a tool on the tubing string may be performed using, for example, the system depicted in FIG. 20. For example, the system may be used to provide the status of a tool in the completion assembly to the passing tool 2010 moving within the wellbore based on the position of magnets 2002. In an embodiment, the selectable positioning tool 2000 can rotate the set of magnets 2002 to produce a desired magnetic field sequence based on the position of the tool in the completion string; i.e. a sleeve has shifted, packer has set, a valve has closed, and/or any combination thereof. Upon passing the magnets 2002, the passing tool 2010 may record the signal and provide it at the surface of the wellbore for further use and/or transmit the signal to another location in the wellbore or at the surface for further use. For example, the signal may be used to indicate the position of a valve as the passing tool 2010 passes the magnets 2002. If the valve is in the correct position, then no action may be taken. However, if the valve is in the incorrect position, then a workover procedure may be performed to shift the valve from a first position to a second position. A method of selectively directing a magnetic field is disclosed. As previously disclosed, a plurality of permanent magnets may be disposed about a mandrel. One or more of the plurality of permanent magnets may be configured to rotate between at least a first position and a second position. The plurality of magnets may be biased towards the first position. For example, a biasing mechanism (e.g., a spring) may be associated with a j-slot and/or gear system to bias the plurality of permanent magnets towards the first position. The plurality of permanent magnets may rotate from the first position to the second position. In an embodiment, rotating the permanent magnets from a first position to a second position may comprise changing the magnetic field strength generated by the plurality of magnets from being greater within the plurality of magnets than outside the plurality of magnets to being greater outside the plurality of magnets than within the plurality of magnets. The plurality of permanent magnets may rotate from the second position to the first position, which may occur in response to a biasing force provided by a biasing mechanism.

The method may further comprise allowing the magnetic field to interact with a component in a wellbore. For example, the plurality of magnets may in a first position such that the magnetic field strength directed toward the center axis of the mandrel is greater than the magnetic field strength directed away from the center axis of the mandrel. The plurality of magnets may rotate from the first position to the second position such that the magnetic field strength directed away from the center axis of the mandrel is greater than the magnetic field strength directed towards the center axis of the mandrel. In an embodiment, the plurality of magnets disposed about a mandrel may be positioned within an outer housing. A downhole component, for example a lock may be engaged with the outer housing. In response to rotating the plurality of magnets, the magnetic field generated by the plurality of magnets may interact with the component engaged with the outer housing and disengage the component from the outer housing.

In an embodiment, interacting with a downhole component in a wellbore may comprise moving the downhole component longitudinally. In an embodiment, the downhole component may comprise a ferromagnetic material that may or may not be magnetized. For example, the plurality of magnets and housing may be configured to axially translate together along the wellbore. As the plurality of magnets rotate from the first position to the second position, the magnetic field generated by the plurality of permanent magnets may interact with the downhole component. The magnetic field may create a magnetic coupling between the magnets and the downhole component that results in the movement of both components within the wellbore.

In an embodiment, interacting with a component in a wellbore may comprise releasing a locking device to unlock a downhole component. For example, the plurality of magnets may be radially aligned with a downhole component engaged with an outer housing. As the plurality of magnets rotate from the first position to the second position, the magnetic field generated by the plurality of magnets may interact with the locking device within the downhole component. The locking device may, for example comprises a radially translatable pin. The pin may be biased toward a particular radial direction, for example away from the center axis of the wellbore. The magnetic field may interact with the pin and/or key and pull the pin and/or key towards the center axis of the wellbore, thereby unlocking the downhole component.

A method of moving a sliding member along a wellbore tubular is disclosed. The sliding member may be engaged with a housing. The sliding member may comprise one or more segments of ferromagnetic material to allow the sliding member may interact with a magnetic field. For example, the sliding member may be engaged with a housing comprising a port. The sliding member may be engaged with the housing so that the sliding member may be moved over the port to block fluid communication through the port. The sliding member may be engaged with the housing so that the sliding member may move away from the port, for example, after the sliding member is positioned over the port, so that fluid communication may be permitted through the port. In an embodiment, the sliding member may be engaged with the body through a tumbler pin and/or key. The tumbler pin and/or key may be disposed in a slot so that sliding member is longitudinally engaged with the body. In an embodiment, the sliding member may be engaged with the body through a lug and slot. The lug may be engaged with the sliding member and a slot may be disposed along the body so that sliding member is engaged to the body via the lug and slot.

Figure 21:
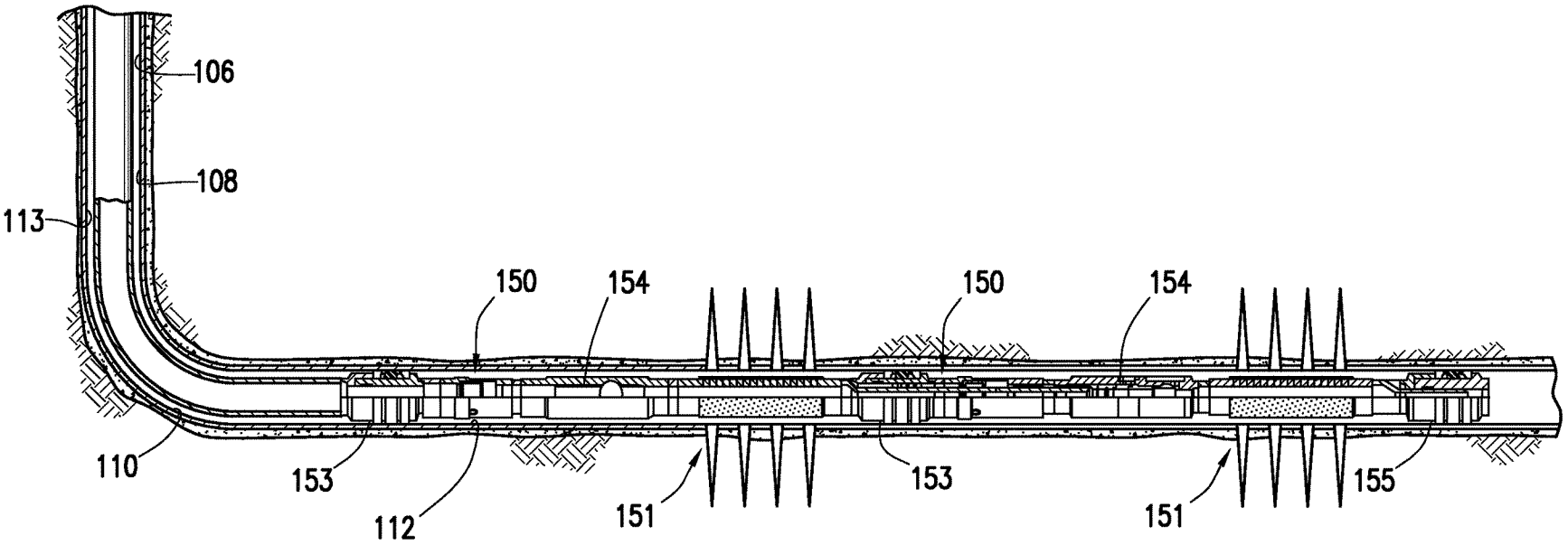
FIG. 21 is a schematic illustration of a well system including a downhole tool according to an embodiment.

The devices and methods described herein may be used in a variety of contexts within a wellbore and/or a wellbore operation. In an embodiment, the devices and methods may be used with a screen assembly in the performance of a variety of procedures such as a gravel or sand packing procedure. FIG. 21 schematically illustrates an example of a wellbore operating environment including a plurality of screen assemblies. The embodiment of FIG. 21 is similar to the embodiment described with respect to FIG. 1, and similar components will not be discussed in the interest of clarity. The wellbore 106 extends substantially vertically over a vertical wellbore portion 108, deviates from vertical relative to the earth's surface over a deviated wellbore portion 110, and transitions to a horizontal wellbore portion 112. In alternative operating environments, all or portions of a wellbore may be vertical, deviated at any suitable angle, horizontal, and/or curved as described in more detail above.

In the embodiment illustrated in FIG. 21, the wellbore tubular 115 comprises a completion assembly comprising a plurality of screen assemblies 151 and a plurality of sleeve assemblies 150. Optional components may also be present such as one or more zonal isolation devices (e.g., packers 153), one or more valves 154, a lower sump packer 155, and any number of circulating sleeves, etc. The additional components may comprise a number of components suitable for aiding in the installation of the wellbore tubular 115 and screen assemblies 151 and/or for use in controlling the production or injection of fluids through the screen assemblies 151. For example, the valves 154 may comprise one or more fluid safety valves, annular safety valves, etc. Additional sleeves may be present for various purposes such as opening or closing annular ports, fluid channels, or the like. The zonal isolation devices such as packers 153 (e.g., production packers, gravel pack packers, frac-pac packers, etc.) may be used to separate the plurality of screen assemblies 151 into one or more production zones (e.g., gravel pack zones or intervals) along the length of the wellbore 106. The magnetic positioning tool 700 may be used to actuate or shift a variety of downhole tools such as one or more components of the sleeve assemblies 150.

In use, the screen assemblies 151 and sleeve assemblies 150 can be positioned in the wellbore 106 as part of the wellbore tubular string 115 adjacent a hydrocarbon bearing formation. An annulus is formed between each screen assembly 151 and the wellbore 106. Upon positioning of wellbore tubular 115 and assemblies 150, 151 within the wellbore 106, a gravel slurry (e.g., gravel particulates suspended in a carrier fluid) may travel through the annulus between the well screen assembly 151 and the wellbore 106 wall as it is pumped down the wellbore around the screen assembly 151. The slurry may then separate on the surface of the screen assemblies 151, with the particulates forming a gravel pack in the annulus and the carrier fluid passing through the screen and into the wellbore tubular string 115 to be returned to the surface. In a multi-zone completion, the gravel slurry may be used to form a gravel pack around each of the screen assemblies 151. For example, the gravel slurry may be pumped to the lowest screen assembly 151 first. Once the gravel pack is formed around the lowest screen assembly 151, the lowest circulating sleeve 150 may be closed followed by the lowest control valve 154. The gravel slurry may then be passed to the next screen assembly 151 to form a gravel pack. Once all of the gravel packs have been formed around the screen assemblies 151, any remaining gravel in the interior of the screen assemblies 150 may be washed out, and the completion assembly may be placed on production.

A variety of structures can be used to pass fluid (e.g., the gravel slurry, a fracturing fluid, completion fluid, etc.) between the interior of the wellbore tubular and the annulus, and the magnetic positioning tool may be used to actuate one or more structures to an open position, a closed position, or any position in between. Further, the magnetic positioning tool may be used to allow one or more structures to be retained in a selected position upon being actuated.

Figure 22:
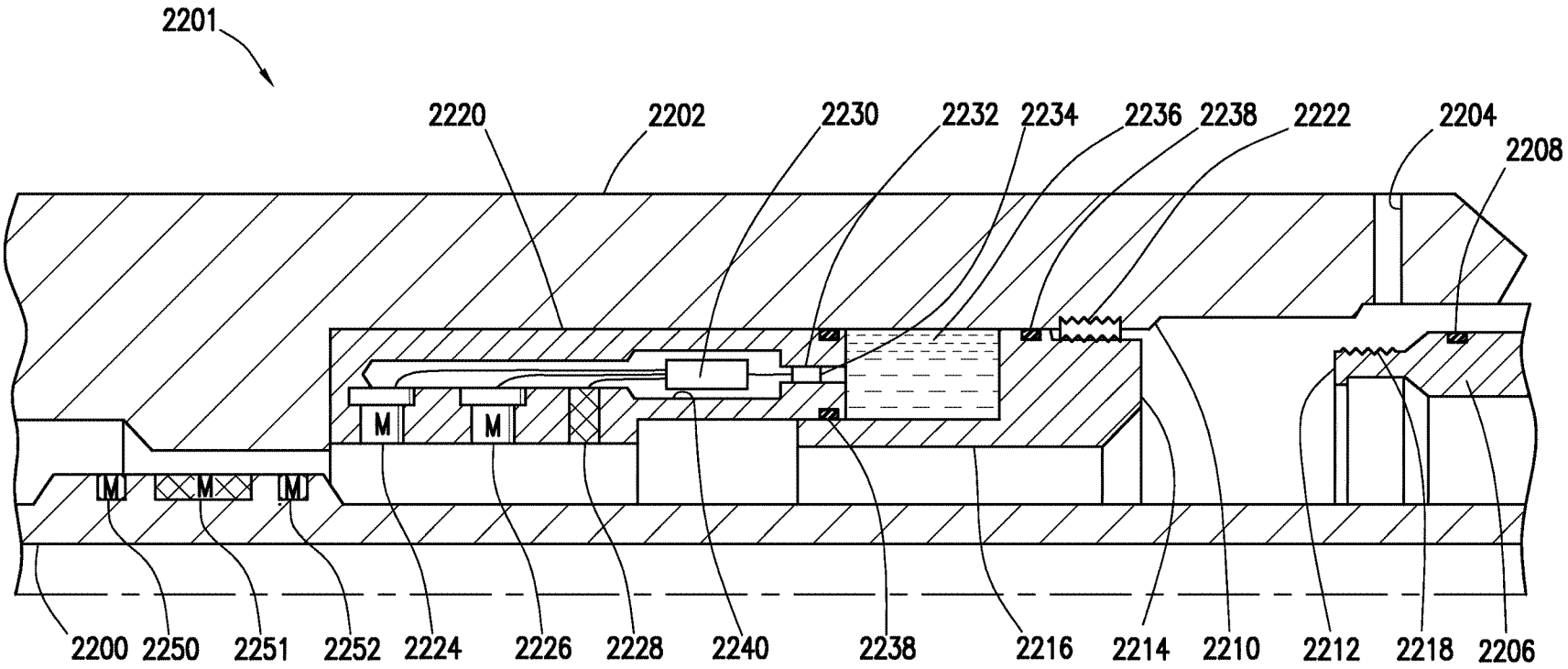
FIG. 22 illustrates a schematic cross-sectional view of a locking mechanism according to an embodiment.

As shown in FIG. 22, a sleeve assembly 2201, which may be one of the sleeve assemblies 150 as shown and described with respect to FIG. 21, may comprise one or more ports 2204 disposed through an outer housing 2202 and a sliding sleeve 2206 configured to selectively provide fluid communication through the port 2204. The outer housing 2202 may be part of the wellbore tubular string (e.g., wellbore tubular 115 of FIG. 21) and comprise a generally cylindrical body having a flow bore disposed therethrough. The one or more ports 2204 allow fluid communication through the outer housing 2202 between an exterior of the outer housing 2202 and the flow bore through the outer housing 2202. In an embodiment, the port 2204 is in fluid communication with the annulus between an exterior of the outer housing 2202 and the wellbore wall.

The sliding sleeve 2206 comprises a generally cylindrical body disposed concentrically with the outer housing 2202. One or more seals 2208 (e.g., o-ring seals, T-seals, chevron seals, etc.) may be disposed between the inner surface of the outer housing 2202 and the outer surface of the sliding sleeve 2206 to provide a sealing engagement between the sliding sleeve 2206 and the outer housing 2202. The sliding sleeve 2206 can be configured to axially translate along the interior of the outer housing 2202. In a closed position, the sliding sleeve 2206 may radially align with the port 2204 and sealingly engage the outer housing 2202, thereby substantially preventing fluid communication through the port 2204. In the closed position, the sliding sleeve 2206 may engage an end stop or shoulder to prevent further movement of the sliding sleeve 2206 in a first axial direction. For example, an end 2212 of the sliding sleeve 2206 may engage a shoulder 2210 formed on an inner surface of the outer housing 2202 and/or the end 2212 may engage an end 2214 of a release piston 2216. In an open position, the sliding sleeve 2206 may be axially translated out of radial alignment with the port 2204, thereby providing a route of fluid communication between the flow bore and the exterior of the outer housing 2202 (e.g., providing fluid communication through the port 2204). In the open position, the sliding sleeve 2206 may engage an end stop or shoulder to prevent further movement of the sliding sleeve 2206 in a second axial direction. For example, a second shoulder or release shoulder may engage the sliding sleeve 2206 to limit the axial movement.

In general, the sliding sleeve 2206 may selectively axially translate between the open position and the closed position during use. In some embodiments, it may be useful to retain the sliding sleeve 2206 in a fixed position (e.g., a closed position or an open position) at a desired time. As shown in FIG. 22, a release mechanism 2220 may be used to allow a locking feature 2218 on the sliding sleeve 2206 to engage a locking feature 2222 coupled to the outer housing 2202, thereby retaining the sliding sleeve 2206 in a desired position. The release mechanism 2220 may comprise one or more sensors 2224, 2226 and/or receivers 2228, a controller 2230, and an actuator 2232 configured to provide selective fluid communication between a first chamber 2236 and a second chamber 2240. The sensors 2224, 2226 and/or receivers 2228 may be configured to detect a magnetic pattern from a magnetic tool disposed in the flowbore and actuator 2232 and allow the release piston 2216 to axially translate, thereby allowing the locking feature 2218 on the sliding sleeve 2206 to engage a locking feature 2222 coupled to the outer housing 2202.

The release piston 2216 comprises a generally cylindrical body disposed concentrically with the outer housing 2202. The release piston 2216 may engage the outer housing 2202 and the release mechanism 2220 to form a chamber 2236 (e.g., an annular chamber) defined by the inner surface of the outer housing 2202, the release piston 2216, and a surface of the release mechanism 2220. One or more seals 2238 (e.g., o-ring seals, T-seals, chevron seals, etc.) may be disposed between the release piston 2216 and the inner surface of the outer housing 2202 and/or the release mechanism 2220 to provide the substantially sealed chamber 2236. As described in more detail below, the actuator 2232 may be disposed in a fluid pathway between the first chamber 2236 and a second chamber 2240 (e.g., an annular chamber, a cylindrical chamber, etc.) formed within the release mechanism 2220. In the initial position, the actuator 2232 may substantially seal the first chamber 2236 from the second chamber 2240. A fluid within the first chamber 2236 forms a fluid lock that substantially prevents axial movement of the release piston 2216 until the fluid is allowed to flow out of the first chamber 2236. In the initial position, the release piston 2216 is disposed in radial alignment with the locking feature 2222, thereby preventing the locking feature 2218 on the sliding sleeve 2206 from engaging the locking feature 2222 on the outer housing 2202. When the fluid is allowed to flow out of the first chamber 2236, the release piston 2216 can axial translate out of radial alignment with the locking feature 2222, thereby allowing the locking feature 2218 on the sliding sleeve 2206 to engage the locking feature 2222 on the outer housing 2202.

The one or more sensors 2224, 2226 may detect magnetic fields produced by the sequenced permanent magnets 2250, 2251, 2252 as the magnets move past the sensors 2224, 2226. In an embodiment, the sensors 2224, 2226 may comprise any of those sensors discussed herein including, but not limited to, a giant magneto-resistive sensor, hall-effect sensor, conductive coils, and/or the like. Additional sensors 2224, 2226 and/or receivers may be associated with the release mechanism 2220. Suitable sensors may include, pressure sensors, temperature sensors, seismic sensors (e.g., a hydrophone, geophone, etc.), electromagnetic sensors (e.g., wired and/or wireless), pulse detectors, flow meters, and the like. In an embodiment, the receiver 2228 may comprise a pressure sensor configured to detect an acoustic signal within a fluid in the flow bore and/or in a wellbore tubular.

In an embodiment, the release mechanism 2220 may further comprise an optional controller 2230 in signal communication with and configured to receive one or more signals from the sensors 2224, 2226 and/or receiver 2228 and selectively trigger or actuate the actuator 2232. For example, the controller 2230 may be configured to receive a variety of signals, determine if the signal corresponds to a desired action, and output an electrical signal (e.g., an analog voltage, an analog current) in response to a determination that the signal corresponds to a desired action. In an embodiment, the controller 2230 may comprise any suitable configuration, for example, comprising one or more printed circuit boards, one or more integrated circuits (e.g., an ASIC), a one or more discrete circuit, one or more active devices, one or more passive devices components (e.g., a resistor, an inductor, a capacitor), one or more microprocessors, one or more microcontrollers, one or more wires, an electromechanical interface, a power supply and/or any combination thereof. As noted above, the controller 2230 may comprise a single, unitary, or non-distributed component capable of performing the functions disclosed herein; alternatively, the receiving circuit may comprise a plurality of distributed components capable of performing the functions disclosed herein.

In an embodiment, the release mechanism 2220 and any electronic components associated with the release mechanism 2220 may be powered by a power source. For example, release mechanism 2220 may further comprise an on-board battery, be coupled to a power generation device, be coupled to a power source within the wellbore, be coupled to a power source outside the wellbore, or any combination thereof. In such an embodiment, the power source and/or power generation device may supply power to the sensors 2224, 2226, the receiver 2228, the controller 2230, and/or combinations thereof, for example, for the purpose of operating the sensors 2224, 2226, the receiver 2228, the controller 2230, and/or combinations thereof. An example of a power source and/or a power generation device is a Galvanic cell, a molten salt battery, and the like. In an embodiment, the power source and/or power generation device may be sufficient to power the components to which it is connected.

In an embodiment, the actuator 2232 may generally be configured to provide selective fluid communication in response to an activation signal (e.g., a voltage and/or current). For example, the actuator 2232 may allow or disallow a fluid to communicate between two or more chambers 2236, 2240 in response to an activation signal. In an embodiment, at least a portion of the actuator 2232 may be positioned adjacent to and/or between the chambers 2236, 2240. In such an embodiment, the actuator 2232 may be configured to provide fluid communication between the first chamber 2236 and the second chamber 2240 in response to an activation signal. In an embodiment, the second chamber 2240 may have a pressure below that of the first chamber 2236 during use within the wellbore (e.g., in response to an application of a hydrostatic pressure within the flow bore on the release piston 2216). Upon providing fluid communication between the first chamber 2236 and the second chamber 2240, fluid in the first chamber 2236 may flow into the second chamber 2240, thereby allowing the release piston 2216 to shift.

In an embodiment as illustrated in FIG. 22, the actuator 2232 may comprise a piercing member such as a punch or needle. In such an embodiment, the punch may be configured, when activated, to puncture, perforate, rupture, pierce, destroy, disintegrate, combust, or otherwise cause an actuable member 2234 to cease to form a seal between the first chamber 2236 and the second chamber 2240. In such an embodiment, the punch may be electrically driven, for example, via an electrically-driven motor or an electromagnet. Alternatively, the punch may be propelled or driven via a hydraulic means, a mechanical means (such as a spring or threaded rod), a chemical reaction, an explosion, or any other suitable means of propulsion, in response to receipt of an activating signal. Suitable types and/or configuration of actuators 2232 are described in U.S. Patent Pub. No. 2011/0174504 entitled "Well Tools Operable Via Thermal Expansion Resulting from Reactive Materials" to Adam D. Wright, et al., U.S. Patent Pub. No. 2010/0175867 entitled "Well Tools Incorporating Valves Operable by Low Electrical Power Input" to Wright et al., and U.S. Pat. No. 8,322,426 entitled "Downhole Actuator Apparatus Having a Chemically Activated Trigger" to Wright et al., the entire disclosures of which are incorporated herein by reference. In an alternative embodiment, the actuator may be configured to cause combustion of the actuable member. For example, the actuable member may comprise a combustible material (e.g., thermite) that, when detonated or ignited may burn a hole in the actuable member 2234. In an embodiment, the actuator 2232 (e.g., the piercing member) may comprise a flow path (e.g., ported, slotted, surface channels, etc.) to allow hydraulic fluid to pass therethrough. In an alternative embodiment, the actuator 2232 may comprise an activatable valve. In such an embodiment, the valve may be integrated within a housing between the first chamber 2236 and the second chamber 2240.

The actuable member 2234 may be configured to contain the hydraulic fluid within the first chamber 2236 until a triggering event occurs (e.g., an activation signal), as disclosed herein. For example, the actuable member 2234 may be configured to be punctured, perforated, ruptured, pierced, destroyed, disintegrated, combusted, or the like, for example, when subjected to a desired force or pressure. In an embodiment, the actuable member 2234 may comprise a fluid barrier, a rupture disk, a rupture plate, or the like, which may be formed from a suitable material. Examples of such a suitable material may include, but are not limited to, a metal, a ceramic, a glass, a plastic, a composite, or combinations thereof.

Upon actuation of the actuable member 2234, the hydraulic fluid within the first chamber 2236 may be free to flow out of the first chamber 2236 via the pathway previously obstructed by the actuable member 2234. For example, in the embodiment of FIG. 22, upon actuation of the actuable member 2234, the fluid may be free to flow out of the first chamber 2236 and into the second chamber 2240. In alternative embodiments, the release mechanism 2220 may be configured to allow the fluid to flow into a secondary chamber (e.g., an expansion chamber), out of the well tool (e.g., into the wellbore), into the flow passage, or combinations thereof upon actuation of the actuable member 2234.

Additionally or alternatively, the release mechanism 2220 may be configured to allow the fluid to flow from the first chamber 2236 at a predetermined or controlled rate. In an embodiment, the first chamber 2236 and/or the second chamber 2240 comprise a fluid meter, a fluidic diode, a fluidic restrictor, or the like. For example, the fluid may flow from the first chamber 2236 via a fluid aperture, for example, a fluid aperture which may comprise or be fitted with a fluid pressure and/or fluid flow-rate altering device, such as a nozzle or a metering device such as a fluidic diode. In an embodiment, such a fluid aperture may be sized to allow a given flow-rate of fluid, and thereby provide a desired opening time or delay associated with flow of fluid exiting the first chamber 2236 and, as such, provide a controlled movement of the release piston 2216.

The actuation of the actuable member 2234 may allow the sliding sleeve 2206 to assume a locked position. In an embodiment, the actuation of the actuable member 2234 may allow the fluid to flow out of the first chamber 2236 and into the second chamber 2240. The release piston 2216 may then translate out of radial alignment with the locking feature 2222. For example, the release piston 2216 may translate towards the release mechanism 2220 to thereby expose the locking feature 2222. Upon translation of the sliding sleeve 2206, the locking feature 2218 on the sliding sleeve 2206 can engage the locking feature 2222 on the outer housing 2202. The engagement between the locking features 2218, 2222 can be configured to retain the sliding sleeve 2206 in position relative to the outer housing 2202. By selectively locating the locking feature 2222 with respect to the outer housing, the sliding sleeve 2206 may be retained or locked in an open position and/or a close position. In some embodiments, a plurality of release pistons and release mechanisms may be present in the sleeve assembly 2201 to allow the sliding sleeve 2206 to be selectively retained in a desired position based upon a suitable actuation signal from a magnetic positioning tool as described herein.

Various types of corresponding locking features can be used. In an embodiment, the locking features 2218, 2222 may comprise engaging protrusions and/or recesses (e.g., body locks). For example, the engaging features may comprise interlocking threads or teeth. One of the components, for example, the end of the sliding sleeve 2206 may comprise one or more channels or cuts (e.g., an axial cut, a helical cut, etc.) to allow the locking features 2218 to contract inwards to ratchet or pass over the locking features 2222 on the outer housing 2202. Additional suitable locking features may comprise a corresponding snap ring on one component and a groove on the corresponding portion, a corresponding collet indicator and groove, and the like. The locking features 2218, 2222 may be configured to allow the locking features to engage in a first direction using a force that is less than the force required to disengage the features in a second direction. For example, the locking feature 2218 on the sliding sleeve 2206 may engage the locking feature 2222 on the outer housing 2202 with relatively little force while being capable of withstanding a reverse force that is significantly greater than the engagement force. In an embodiment, the ratio of the engagement force to the disengagement force may be between about 1:1.5 to about 1:100, or about 1:2 to about 1:50.

In use, the sleeve assembly 2201 may be used during a drilling, drill-in, completion, and/or workover operation. The sliding sleeve 2206 may be used to control the fluid communication between the flow bore through the outer housing 2202 and the exterior of the outer housing 2202. For example, the sliding sleeve 2206 may be used selectively control a gravel packing circulating sleeve during a gravel packing operation.

In general, the sliding sleeve 2206 may be axially translated using a shifting tool to engage a profile associated with the sliding sleeve 2206 and then shift the sliding sleeve in response to a force applied to the shifting tool. The sliding sleeve 2206 may engage a shoulder or stop at either the open position or the closed position to allow the shifting tool to be disengaged from the sliding sleeve 2206. The sliding sleeve 2206 may be selectively shifted between the open position and the closed position as needed during the operation in which it is used.

At a desired time, for example upon completion of the operation or completion of a zone in a multi-zone well, the sliding sleeve may be retained in a locked position. In an embodiment, the sleeve may be retained in a closed position (e.g., locked closed), though in other embodiments, a sliding sleeve may be retained in an open position (e.g., locked open). The sliding sleeve 2206 may be retained in position by passing a magnetic positioning tool 2200 by the release mechanism 2220. As illustrated in FIG. 22, a magnetic positioning tool 2200 comprising a plurality of magnets 2250, 2251, 2252 may be passed by the release mechanism 2220. The magnetic positioning tool 2200 may be disposed in the wellbore as part of a workover string. Alternatively or in addition thereto, the magnetic positioning tool 2200 may be disposed in the wellbore on a separate conveyance means or as a separate component (e.g., as part of a ball or dart) to trigger the actuation of the actuator 2232.

The magnetic positioning tool 2200 may be configured to change the magnetic pattern of the plurality of magnets 2250, 2251, 2252 using rotation according to any of the embodiments disclosed herein. The magnetic positioning tool may be reconfigured within the wellbore to provide a magnetic pattern configured to trigger the actuation of the actuator 2232. In some embodiments, the magnetic positioning tool may be configured with a magnetic pattern that will not trigger the actuation of the actuator 2232, for example when the sliding sleeve 2206 is not to be retained in a fixed position.

Upon passing the magnetic positioning tool 2200 past the one or more sensors 2224, 2226 and/or receivers 2228, the sensors and/or receivers may detect the magnetic pattern associated with the magnetic positioning tool 2200. A signal may be generated by the one or more sensors 2224, 2226 and/or receivers 2228 in response to detecting the magnetic pattern. In some embodiments, an additional signal may be received by the one or more sensors 2224, 2226 and/or receivers 2228. For example, an acoustic signal may be received by the receiver 2228 and a signal may be generated by the receiver 2228 in response to receiving the acoustic signal. The signal may be passed to the controller 2230 along with the signal generated by the sensors 2224, 2226.

The controller 2230 may compare a received signal with a stored set of signal and response data. If the received signal corresponds to an action, the controller 2230 may then generate a signal to actuate the actuator 2232. The received signal may be compared based on the magnetic pattern, a direction of travel of the magnetic pattern, a speed of the passing magnetic positioning tool 2200, and the like. In an embodiment, the action may be based on receiving a plurality of signals. For example, a signal generated in response to a magnetic pattern on a passing magnetic positioning tool 2200 may be received a plurality of times (e.g., two times, three times, four times, etc.) before the controller generates and sends a signal to the actuator 2232. Alternatively, the controller may wait until a signal generated based on a magnetic pattern is received as well as a signal generated based on an acoustic signal to generate and send a signal to the actuator 2232. In some embodiments, the action generated by the controller may be delayed in time from receiving the appropriate signal from the one or more sensors 2224, 2226 and/or receivers 2228. Further, in some embodiments, a plurality of actions may result from the receipt of the one or more signals by the controller. In some embodiments, the signal generated by the one or more sensors 2224, 2226 and/or receivers 2228 may be directly communicated to the actuator 2232 to trigger actuation of the actuator 2232.

Upon the generation of the signal by the controller, the actuator 2232 may actuate. In an embodiment, the actuator 2232 may open a route of fluid communication between the first chamber 2236 and the second chamber 2240 in response to receiving the signal. For example, the actuator 2232 may be configured to puncture, perforate, rupture, pierce, destroy, disintegrate, combust, open, or otherwise form a fluid passage through an actuable member 2234. Upon opening a route of fluid communication, fluid contained within the first chamber 2236 may flow into the second chamber 2240. In response to the fluid flowing into the second chamber 2240, the release piston 2216 may shift out of radial alignment with the locking feature 2222 on the outer housing 2202. For example, the release piston 2216 may shift towards the release mechanism 2220.

When the release piston 2216 no longer blocks the sliding sleeve 2206 from translating into engagement with the locking feature 2222, the sliding sleeve 2206 may be shifted as described above into the appropriate position. Rather than being restricted by a shoulder or an end stop, the locking feature 2218 on the sliding sleeve 2206 may then shift into engagement with the locking feature 2222 on the outer housing 2202. Upon engaging, the locking features 2218, 2222 may retain the sliding sleeve 2206 in position. The engagement may be permanent. In some embodiments, the sliding sleeve 2206 may be disengaged from the locking feature 2222 with a sufficient force, however, this force may be greater than the force generally expected to be applied to the sliding sleeve 2206. In an embodiment, the sliding sleeve 2206 may be retained in a closed position. Once the sliding sleeve 2206 is retained in the desired position, additional operations and/or production may be performed.

Figure 23A:
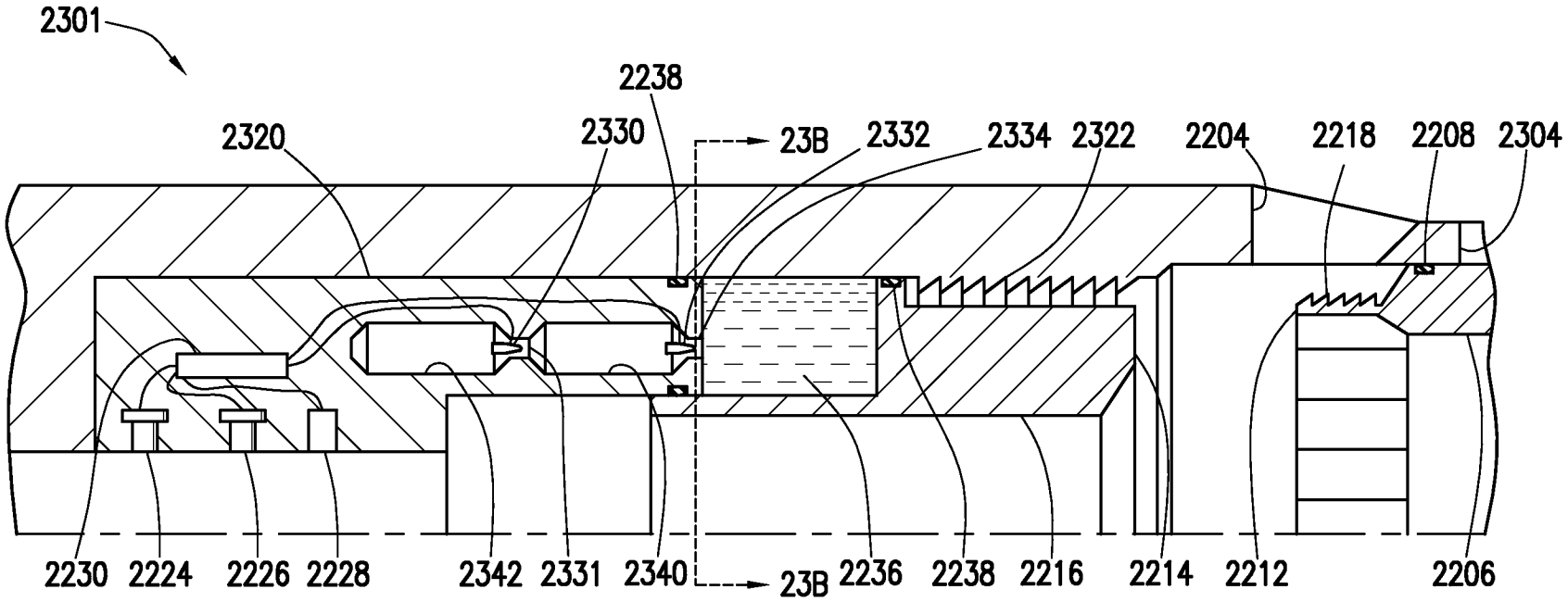
FIG. 23A illustrates another schematic cross-sectional view of a locking mechanism according to an embodiment.

As shown in FIG. 23A, a sleeve assembly 2301 may comprise a multi-position locking system. The sleeve assembly 2301 may be similar to the sleeve assembly 2201 described with respect to FIG. 22, and the similar components will not be described in detail in the interest of clarity. Rather than provide a single locking position, the sleeve assembly 2301 of FIG. 23A may allow the release piston 2216 to assume a plurality of axial positions. In each position, the sliding sleeve 2206 may engage the locking features and be retained in position. As the release piston 2216 is allowed to further axially translate, the sliding sleeve may be further axially translated while being retained against reverse translation using the locking features. The result of this configuration is to allow the sleeve assembly 2301 to provide a plurality of locked positions for the sliding sleeve 2206. Thus, the sliding sleeve 2206 may be reconfigured between an open and closed position, and subsequently placed into one or more locked positions. This may be useful in first locking the sliding sleeve into a position in which the sleeve assembly 2301 is partially closed (e.g., blocking a first flow port). The sliding sleeve may then be translated to a second locked position in which the sleeve assembly 2301 is fully closed (e.g., blocking any remaining flow ports). Any number of ports and positions may be used with this configuration.

Structurally, the sleeve assembly 2301, which may be one of the sleeve assemblies 150 as shown and described with respect to FIG. 21, may comprise one or more ports 2204, 2304 disposed through a housing 2202 and a sliding sleeve 2206 configured to selectively provide fluid communication through the ports 2204, 2304. The one or more ports 2204, 2304 allow fluid communication through the outer housing 2202 between an exterior of the outer housing 2202 and the flow bore through the outer housing 2202.

When not in a locked position, the sliding sleeve 2206 may assume an open position and one or more closed or partially closed positions relative to the outer housing 2202. For example, the sliding sleeve 2206 may engage an end stop or shoulder to prevent further movement of the sliding sleeve 2206 in a first axial direction. For example, an end 2212 of the sliding sleeve 2206 may engage a shoulder formed on an inner surface of the outer housing 2202 and/or the end 2212 may engage an end 2214 of a release piston 2216. In each position, the sliding sleeve 2206 may be axially translated into and/or out of radial alignment with one or more of the ports 2204, 2304, thereby providing selectively variable routes of fluid communication between the flow bore and the exterior of the outer housing 2202 (e.g., providing fluid communication through a first port 2204, through a second port 2304, etc.). In the open position, the sliding sleeve 2206 may engage an end stop or shoulder to prevent further movement of the sliding sleeve 2206 in a second axial direction, where all of the ports 2204, 2304 may be open for flow. For example, a second shoulder or release shoulder may engage the sliding sleeve 2206 to limit the axial movement.

In general, the sliding sleeve 2206 may selectively axially translate between the open position and one or more partially closed positions during use without being disposed in a locked position. In some embodiments, it may be useful to retain the sliding sleeve 2206 in one of several locked (e.g., fixed) positions (e.g., a closed position or an open position) at a desired time. As shown in FIG. 23A, a release mechanism 2320 may be used to allow a locking feature 2218 on the sliding sleeve 2206 to engage a locking feature 2322 coupled to the outer housing 2202, thereby retaining the sliding sleeve 2206 in a desired position. The release mechanism 2320 may comprise one or more sensors 2224, 2226 and/or receivers 2228, a controller 2230, and a plurality of actuators 2330, 2332 configured to provide selective fluid communication between a first chamber 2236 and a plurality of secondary chambers 2340, 2342. The controller 2230 may be configured to trigger one or more of the actuators 2330, 2332 and allow the release piston 2216 to axially translate a selected amount, thereby allowing the locking feature 2218 on the sliding sleeve 2206 to engage the locking feature 2322 coupled to the outer housing 2202 at one or more axial positions.

Figure 23B:
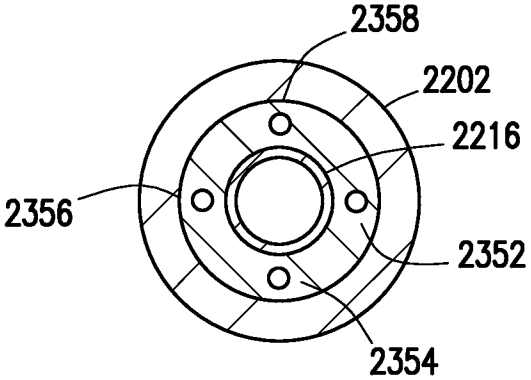
FIG. 23B illustrates a schematic cross-sectional view of a locking mechanism according to an embodiment.

As described in more detail herein, each of the actuators 2330, 2332 may be disposed in fluid pathways between the first chamber 2236 and one or more secondary chambers 2340, 2342 (e.g., an annular chamber, a cylindrical chamber, etc.) formed within the release mechanism 2320. The secondary chambers 2340, 2342 may be disposed in series and/or parallel. As shown in FIG. 23A, the secondary chambers 2340, 2342 are disposed in series, with any fluid passing into the secondary chamber 2342 first passing through the secondary chamber 2340. In some embodiments, the secondary chambers 2340, 2342 may be disposed in parallel about the axis of the outer housing 2202. For example, FIG. 23B illustrates the secondary chambers 2352, 2354, 2356, and 2358 as being disposed about the longitudinal axis of the outer housing 2202, where each secondary chamber 2352, 2354, 2356, and 2358 are in selective fluid communication with the first chamber 2236. Returning to FIG. 23A, the actuator 2332 may substantially seal the first chamber 2236 from the secondary chamber 2340. Similarly, the actuator 2330 may substantially seal the secondary chamber 2340 from the secondary chamber 2342.

In the initial position, the release piston 2216 can be disposed in radial alignment with the locking feature 2322, thereby preventing the locking feature 2218 on the sliding sleeve 2206 from engaging the locking feature 2322 on the outer housing 2202. When the fluid is allowed to flow out of the first chamber 2236 into the secondary chamber 2340, the release piston 2216 can axially translate a distance determined by the relative volumes of the first chamber 2236 and the secondary chamber 2340. The initial translation may allow the release piston 2216 to partially translate out of radial alignment with the locking feature 2322, thereby allowing the locking feature 2218 on the sliding sleeve 2206 to engage the locking feature 2322 on the outer housing 2202 in a first locked position. In this position, the sliding sleeve 2206 may prevent fluid communication through at least one of the ports 2204, 2304.

When the fluid is allowed to flow out of the first chamber 2236 into both of the secondary chambers 2340, 2342, the release piston 2216 can further axially translate a distance determined by the relative volumes of the first chamber 2236 and the combined volumes of the secondary chambers 2340, 2342. This translation may allow the release piston 2216 to continue to translate out of radial alignment with the locking feature 2322, thereby allowing the locking feature 2218 on the sliding sleeve 2206 to further engage the locking feature 2322 on the outer housing 2202 in a second locked position. In this position, the sliding sleeve 2206 may prevent fluid communication through both of the ports 2204, 2304.

In an embodiment, the actuators 2330, 2332 may generally be configured to provide selective fluid communication in response to one or more activation signals (e.g., a voltage and/or current). For example, the actuators 2330, 2332 may allow or disallow a fluid to communicate between chambers 2236, 2340, 2342 in response to the activation signal or signals. For example, a single magnetic pattern on a magnetic positioning tool may be used to actuate a single actuator 2332, thereby allowing the sliding sleeve 2206 to assume a first locked position. A subsequent magnetic pattern may then be used to actuate the next actuator 2330, thereby allowing the sliding sleeve 2206 to assume a second locked position (e.g., a fully locked position). The magnetic pattern may be the same or different in each instance. For example, a single pattern may be used to serially actuate the actuators 2332, 2330 based on the number of times the magnetic pattern is sensed by the sensors 2224, 2226. In some embodiments, a different magnetic pattern may be used to actuate one or more of the actuators 2330, 2332. In some embodiments, a single magnetic pattern may be used to actuate one or more of the actuators 2330, 2332 substantially simultaneously.

In use, the sleeve assembly 2301 may operate similarly to the sleeve assembly 2201 described with respect to FIG. 22. In general, the sliding sleeve 2206 may be axially translated using a shifting tool to engage a profile associated with the sliding sleeve 2206 and then shift the sliding sleeve in response to a force applied to the shifting tool. The sliding sleeve 2206 may engage a shoulder or stop at the open position, the closed position, or one or more partially closed positions to allow the shifting tool to be disengaged from the sliding sleeve 2206.

At a desired time, the sliding sleeve 2206 may be retained in one of a plurality of locked positions. In an embodiment, the sliding sleeve 2206 may be retained in a partially or fully closed position, though in other embodiments, a sliding sleeve may be retained in a partially or fully open position (e.g., locked open). The sliding sleeve 2206 may be retained in position by passing a magnetic positioning tool by the release mechanism 2320. The magnetic positioning tool comprising a plurality of magnets may be passed by the release mechanism 2320 as described above with respect to FIG. 23A. The magnetic positioning tool may be configured to change the magnetic pattern of the plurality of magnets using rotation according to any of the embodiments disclosed herein. The magnetic positioning tool may be reconfigured within the wellbore to provide a magnetic pattern configured to trigger the actuation of one or more of the actuators 2330, 2332. In some embodiments, the magnetic positioning tool may be configured with a magnetic pattern that will not trigger the actuation of any of the actuators 2330, 2332, for example when the sliding sleeve 2206 is not to be retained in a fixed position.

Upon passing the magnetic positioning tool past the one or more sensors 2224, 2226 and/or receivers 2228, the sensors and/or receivers may detect the magnetic pattern associated with the magnetic positioning tool. A signal may be generated by the one or more sensors 2224, 2226 and/or receivers 2228 in response to detecting the magnetic pattern. In some embodiments, an additional signal may be received by the one or more sensors 2224, 2226 and/or receivers 2228. For example, an acoustic signal may be received by the receiver 2228 and a signal may be generated by the receiver 2228 in response to receiving the acoustic signal. The signal may be passed to the controller 2230 along with the signal generated by the sensors 2224, 2226.

The controller 2230 may compare a received signal with a stored set of signal and response data. If the received signal corresponds to an action, the controller may then generate a signal to actuate one or more of the actuators 2330, 2332. Any of the considerations discussed above may be used to generate one or more signals to actuate one or more of the actuators 2330, 2332.

Upon the generation of the signal by the controller 2230, one or more of the actuators 2330, 2332 may actuate. In an embodiment, the actuators 2330, 2332 may open serially to provide a route of fluid communication between the first chamber 2236 and the secondary chambers 2340, 2342 in response to receiving one or more signals. For example, the actuator 2332 may be configured to puncture, perforate, rupture, pierce, destroy, disintegrate, combust, open, or otherwise form a fluid passage through an actuable member 2334. Upon opening a route of fluid communication, fluid contained within the first chamber 2236 may flow into the secondary chamber 2340. In response to the fluid flowing into the second chamber 2340, the release piston 2216 may shift partially out of radial alignment with the locking feature 2322 on the outer housing 2202. For example, the release piston 2216 may shift towards the release mechanism 2320.

When the release piston 2216 translates, the locking feature 2218 on the sliding sleeve 2206 may then shift into engagement with the locking feature 2322 on the outer housing 2202 while being limited by the end 2214 of the release piston 2216. Upon engaging, the locking features 2218, 2322 may retain the sliding sleeve 2206 in position. The engagement may be permanent. In some embodiments, the sliding sleeve 2206 may be disengaged from the locking feature 2322 with a sufficient force, however, this force may be greater than the force generally expected to be applied to the sliding sleeve 2206. Once the sliding sleeve 2206 is retained in the desired position, additional operations and/or production may be performed.

When the sliding sleeve 2206 translates into engagement with the locking feature 2322 into the first position, flow through the port 2304 may be substantially blocked while the port 2204 may remain uncovered to thereby allow fluid flow. The closure of a portion of the ports 2204, 2304 may be used to alter the flow through the sleeve assembly 2301. In an embodiment, the closure of the port 2304 may reduce the available flow area through the sleeve assembly 2301, thereby reducing the total flow into and/or out of the sleeve assembly 2301. In some embodiments, each port 2204, 2304 may be in fluid communication with a different flow path between the flowbore and the exterior of the sleeve assembly 2301. For example, each port 2204, 2304 may be coupled to a different flow path having a different fluid restriction. By selectively closing one or more ports, but less than all of the ports, the fluid flow and/or resistance to fluid flow through the sleeve assembly 2301 can be selectively altered.

Upon the generation of a subsequent signal by the controller 2230, one or more of the remaining actuators 2330 and actuable member 2331 may be actuated. Upon opening a route of fluid communication into the secondary chamber 2342, fluid contained within the first chamber 2236 and the secondary chamber 2340 may flow into the secondary chamber 2342. In response to the fluid flowing into the secondary chamber 2342, the release piston 2216 may shift further out of radial alignment with the locking feature 2322 on the outer housing 2202. When the release piston 2216 translates, the locking feature 2218 on the sliding sleeve 2206 may then continue to shift into engagement with the locking feature 2322 on the outer housing 2202. The end 2214 of the release piston 2216 may limit the extent of the axial translation of the sliding sleeve 2206. The locking features 2218, 2322 may continue to retain the sliding sleeve 2206 in position. Once the sliding sleeve 2206 is retained in the desired position, additional operations and/or production may be performed.

When the sliding sleeve 2206 further translates into engagement with the locking feature 2322 into the second position, flow through both ports 2204, 2304 may be substantially blocked. In an embodiment, the closure of both ports 2204, 2304 may substantially block flow into and/or out of the sleeve assembly 2301. Closing off all of the ports 2204, 2304 through the sleeve assembly 2301 may be used selectively isolate one or more zones and/or adjust a flow into the wellbore tubular string by closing off one or more sleeve assemblies 2301, but not necessarily all of the sleeve assemblies in a string.

While described in terms of two positions, any number of actuators and secondary chambers may be used to provide a corresponding number of locked positions. For example, three, four, five, or more secondary chambers may be used to provide a corresponding number of locked configurations. Further, any number of ports and/or fluid pathways may be used. The plurality of configurations may include partially open positions, partially closed positions, a fully closed position, and/or a fully open position. In addition, the sliding sleeve may be reconfigured between the various positions in any order. For example, the sleeve assembly 2301 may transition from a partially open position to a fully closed position, back to a partially or fully open position. The order of the various positions may be based on the particulars of the procedures being conducted in the wellbore. While described in terms of using a magnetic positioning tool, one or more of the sleeve assemblies comprising a locking mechanism may also be used with alternative sensors and/or receivers. For example, a sleeve assembly 2301 may not have any magnetic sensors. Rather one or more acoustic sensors, electronic receivers, or the like may be used to receive and initiate the actuation mechanism to trigger the locking mechanism.

In an embodiment, the sleeve assembly 2301 of FIG. 23 may be used in a multi-zone completion such as the one described with respect to FIG. 21. In some embodiments, a gravel pack may be formed adjacent one or more of the screen assemblies 151. If a zone is determined to need an additional process, the remaining zones may need to be closed to allow the process to be performed. If a sleeve in a zone is inadvertently partially opened during the process, the seal may be eroded by fluid flowing through the partial opening. It may be difficult to have the sleeve form a seal if the seal is damaged or eroded. Accordingly, the locking mechanisms described above may be used to retain the sleeve in a locked closed position. For example, a magnetic positioning tool may be disposed in the wellbore with the appropriate magnetic pattern to close the corresponding sleeves, while leaving the desired sleeve in an unlocked configuration. The sleeves that are locked closed may be permanently closed. The ability to selectively actuate one or more sleeves may allow for a selective completion or workover in a completion zone.

Figure 24:
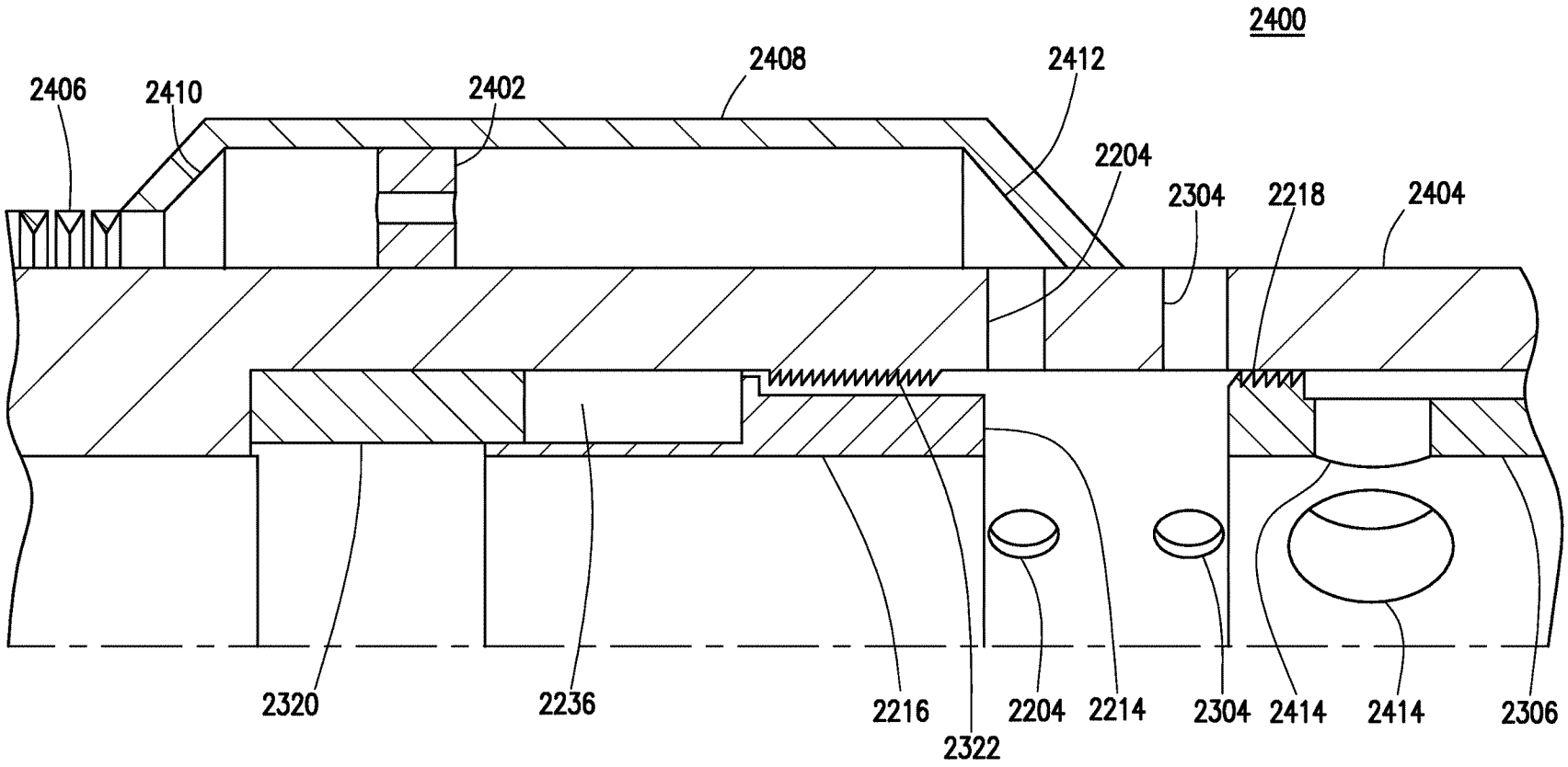
FIG. 24 illustrates a schematic cross-sectional view of an embodiment of a locking mechanism used with an embodiment of a flow control device.

In some embodiments, the sleeve assembly 2201 and/or the sleeve assembly 2301 may be used with or as part of a flow control device. Flow control devices can be used where fluids are produced from intervals of a formation penetrated by a wellbore in order to aid in balancing the production of fluid along the interval, which can lead to reduced water and gas coning, and more controlled conformance. Flow control devices, which can be referred to as inflow control devices (ICD's) in some contexts, can allow for the resistance to flow and/or the flow rate through the flow control device to be selectively adjusted using, for example, the selectively locked sleeve described above with respect to the screen assemblies 2201, 2301. As shown in FIG. 24, a flow control device 2400 may comprise a flow restriction 2402 disposed in a fluid pathway between an exterior of a wellbore tubular 2404 and an interior of the wellbore tubular 2404. The flow control device 2400 can be coupled to a filter element 2406 to produce a fluid through the filter element 2406 and into the wellbore tubular through the flow restriction 2402.

The filter element 2406 is used to filter at least a portion of any sand and/or other debris from a fluid that generally flows from an exterior to an interior of the wellbore tubular 2404. The filter element 2406 is depicted in FIG. 24 as being of the type known as "wire-wrapped," since it is made up of a wire closely wrapped helically about a wellbore tubular 2404, with a spacing between the wire wraps being chosen to keep sand and the like that is greater than a selected size from passing between the wire wraps. Other types of filter elements (such as sintered, woven and/or non-woven mesh, pre-packed, expandable, slotted, perforated, etc.) may also be used. The filter element 2406 may also comprise one or more layers of the filter material. A fluid pathway can be disposed between the filter element 2406 and the wellbore tubular 2404 to allow a fluid passing through the filter element 2406 to flow along the outer surface of the wellbore tubular 2404 to the flow control device 2400.

The flow control device 2400 may perform several functions. In an embodiment, the flow control device 2400 is an ICD which functions to restrict flow therethrough, for example, to balance production of fluid along an interval. The flow control device 2400 generally comprises a flow restriction 2402 disposed within a fluid pathway between an exterior of the wellbore tubular 2404 and an interior throughbore of the wellbore tubular 2404. In an embodiment, the flow restriction 2402 is disposed within a housing 2408. The housing 2408 can comprise a generally cylindrical member disposed about the wellbore tubular 2404. The housing 2408 may be fixedly engaged with the wellbore tubular 2404 and one or more seals may be disposed between the housing 2408 and the exterior surface of the wellbore tubular 2404 to provide a substantially fluid tight engagement between the housing 2408 and the wellbore tubular 2404. A first housing chamber 2410 may be defined between the interior surface of the housing 2408, the outer surface of the wellbore tubular 2404, the flow restriction 2402, and the filter element 2406. A second housing chamber 2412 may be defined between the interior surface of the housing 2408, the outer surface of the wellbore tubular 2404, and the flow restriction 2402. One or more ports 2204 may be disposed in the wellbore tubular 2404 to provide fluid communication between the second housing chamber 2412 and the interior of the wellbore tubular 2404. The ports 2204 may generally comprise apertures with square, rounded, slotted, or other configurations.

In some embodiments, a second set of one or more ports 2304 may also be disposed in the wellbore tubular 2404. The one or more ports 2304 may provide fluid communication between the interior throughbore of the wellbore tubular 2404 and the exterior of the flow control device 2400. The ports 2304 may generally comprise apertures with square, rounded, slotted, or other configurations. The direct pathway may bypass the flow restriction 2402 and or the flow control device 2400 altogether. In some embodiments, the ports 2304 may provide fluid communication to the chamber 2410 and/or the filter element 2406 to bypass the flow restriction 2402 while still providing a flow path through the filter element 2406.

Any fluid passing through the filter element 2406 and into the first housing chamber 2410 may pass through the flow restriction 2402 before passing into the second housing chamber 2412 and the one or more ports 2204. The flow restriction 2402 is configured to provide a desired resistance to fluid flow through the flow restriction 2402. The flow restriction 2402 may be selected to provide a resistance for balancing the production along an interval. Various types of flow restrictions 2402 can be used with the flow control device 2400 described herein. In the embodiment shown in FIG. 24, the flow restriction 2402 comprises a nozzle that comprises a central opening (e.g., an orifice) configured to cause a specified resistance and pressure drop in a fluid flowing through the flow restriction 2402. The central opening may have a variety of configurations from a rounded cross-section, to cross section in which one or more edges comprises a sharp-squared. In general, the use of a squared edge may result in a greater pressure drop through the orifice than other shapes. Further, the use of a squared edge may result in a pressure drop through the flow restrictor that depends on the viscosity of the fluid passing through the flow restriction. The use of a squared edge may result in a greater pressure drop through the flow restrictor for an aqueous fluid than a hydrocarbon fluid, thereby presenting a greater resistance to flow for any water being produced relative to any hydrocarbons (e.g., oil) being produced. Thus, the use of a central opening comprising a squared edge may advantageously resist the flow of water as compared to the flow of hydrocarbons. In some embodiments described herein, a plurality of nozzle type flow restrictions may be used in series and/or in parallel.

In some embodiments, other designs of the flow restriction 2402 may also be used. The flow restrictions 2402 may also comprise one or more restrictor tubes. The restrictor tubes generally comprise tubular sections with a plurality of internal restrictions (e.g., orifices). The internal restrictions are configured to present the greatest resistance to flow through the restrictor tube. The restrictor tubes may generally have cylindrical cross-sections, though other cross-sectional shapes are possible. The plurality of internal restrictions may then provide the specified resistance to flow.

Other suitable flow restrictions may also be used including, but not limited to, narrow flow tubes, annular passages, bent tube flow restrictors, helical tubes, and the like. Narrow flow tubes may comprise any tube having a ratio of length to diameter of greater than about 2.5 and providing for the desired resistance to flow. Similarly, annular passages comprise narrow flow passages that provide a resistance to flow due to frictional forces imposed by surfaces of the fluid pathway. A bent tube flow restrictor comprises a tubular structure that forces fluid to change direction as it enters and flows through the flow restrictor. Similarly, a helical tube flow restrictor comprises a fluid pathway that forces the fluid to follow a helical flow path as it flows through the flow restrictor. The repeated change of momentum of the fluid through the bent tube and/or helical tube flow restrictors increases the resistance to flow and can allow for the use of a larger flow passage that may not clog as easily as the narrow flow passages of the narrow flow tubes and/or annular passages. Each of these different flow restriction types may be used to provide a desired resistance to flow and/or pressure drop for a fluid flow through the flow restrictor. Since the resistance to flow may change based on the type of fluid, the type of flow restriction may be selected to provide the desired resistance to flow for one or more type of fluid.

When the sliding sleeve 2206 is in the initial or open position, fluid would typically flow from the exterior of the well bore tubular 2404 and flow through port 2304 bypassing the more restrictive flow path under the filter element 2406 and through restriction 2402. The sliding sleeve 2206 can be configured to interact with a shifting tool disposed within the wellbore. The shifting tool can selectively engage the sliding sleeve 2206 and move it to the second position to substantially close the port 2304 and direct any flow through port 2204. The resulting restricted position can control the flow rate of fluid from the wellbore to balance production. The sleeve may be opened and closed multiple times with the shifting tool.

When the port 2304 is closed off by the sliding sleeve 2206, the fluid would typically flow from the exterior of the wellbore tubular 2404 to the screen assembly, through the filter element 2406, and to the flow control device 2400. Within the flow control device, the fluid can flow through the chamber 2410, through the flow restriction 2402, which may provide a resistance to the flow of the fluid, through the second housing chamber 2412, and then through the one or more ports 2204 disposed in the wellbore tubular 2404. The fluid can then flow into the interior throughbore of the wellbore tubular 2404, which extends longitudinally through the flow control device as part of the tubular string. The fluid can be produced through the tubular string to the surface. The fluid may also flow outwardly through the filter element 2406. In an embodiment, the fluid may flow from the interior throughbore of the wellbore tubular 2404 outwardly towards the exterior of the wellbore tubular 2404. For example, a treatment fluid may be injected into the wellbore and/or the wellbore may comprise an injection wellbore to promote production in a field. While described in terms of the specific arrangement of the filter element 2406 and the flow control device 2400, the flow control device 2400 could be upstream of the filter element 2406 relative to a fluid flowing from the exterior of the wellbore tubular 2404 to the interior throughbore.

In an embodiment, the flow control device may comprise a single or multi-position locking system as described above with respect to FIGS. 22, 23A, and 23B. While described with respect to a muli-position locking system below, it should be understood that the single position locking system would be equally applicable to use with the flow control device 2400 in blocking one or more of the ports 2204, 2304. The result of this configuration is to allow the sleeve 2206 to provide a plurality of locked positions. Thus, the sliding sleeve 2206 may be reconfigured between an open and closed position, and subsequently placed into one or more locked positions, which may determine the flow configuration and flow resistance between the interior throughbore of the wellbore tubular 2404 and the exterior of the wellbore tubular 2404. The release mechanism 2320 may be the same as described above and will therefore not be discussed in detail with respect to FIG. 24.

In use, the sliding sleeve 2206 may be axially translated using a shifting tool to engage a profile associated with the sliding sleeve 2206 and then shift the sliding sleeve in response to a force applied to the shifting tool. The sliding sleeve 2206 may engage a shoulder or stop at the open position, the closed position, or one or more partially closed positions to allow the shifting tool to be disengaged from the sliding sleeve 2206.

At a desired time, the sliding sleeve 2206 may be retained in one of a plurality of locked positions. In an embodiment, the sliding sleeve 2206 may be retained in a partially or fully closed position, though in other embodiments, a sliding sleeve may be retained in a partially or fully open position (e.g., locked open). The sliding sleeve 2206 may be retained in position by passing a magnetic positioning tool by the release mechanism 2320. The magnetic positioning tool comprising a plurality of magnets may be passed by the release mechanism 2320 as described above with respect to any of FIG. 22. 23A, 24, 25 or 26. The magnetic positioning tool may be configured to change the magnetic pattern of the plurality of magnets using rotation according to any of the embodiments disclosed herein. The magnetic positioning tool may be reconfigured within the wellbore to provide a magnetic pattern configured to trigger the actuation of one or more of the actuators in the release mechanism 2320.

Upon passing the magnetic positioning tool past the one or more sensors and/or receivers in the release mechanism 2320, the sensors and/or receivers may detect the magnetic pattern associated with the magnetic positioning tool. A signal may be generated in response to detecting the magnetic pattern, and the signal may be passed to the controller in the release mechanism 2320. The controller may compare a received signal with a stored set of signal and response data. If the received signal corresponds to an action, the controller may then generate a signal to actuate one or more of the actuators in the release mechanism 2320. Any of the considerations discussed above may be used to generate one or more signals to actuate one or more of the actuators in the release mechanism 2320.

Upon the generation of the signal by the controller, one or more of the actuators in the release mechanism 2320 may actuate and open a route of fluid communication with the chamber 2236. Upon opening a route of fluid communication, fluid contained within the first chamber 2236 may flow into a secondary chamber in the release mechanism 2320. In response to the fluid flowing into the second chamber, the release piston 2216 may shift partially out of radial alignment with the locking feature 2322 on the wellbore tubular 2404, which may form an outer housing for the release mechanism 2320. For example, the release piston 2216 may shift towards the release mechanism 2320.

When the release piston 2216 translates, the locking feature 2218 on the sliding sleeve 2206 may then shift into engagement with the locking feature 2322 on the wellbore tubular 2404 while being limited by the end 2214 of the release piston 2216. Upon engaging, the locking features 2218, 2322 may retain the sliding sleeve 2206 in a restricted position. When the sliding sleeve 2206 translates into engagement with the locking feature 2322 into the restricted position, flow through the port 2304 may be substantially blocked while the port 2204 may be radially aligned with the port 2414 in the sliding sleeve, thereby permitting flow through the ports 2204. In this embodiment, the flow control device may initially be in a bypassed configuration in which fluid flow is relatively unrestricted through the ports 2304. By substantially blocking the ports 2304, fluid may be forced through the flow control device 2400 and the flow restriction 2402. Fluid may then be produced and/or injected through the flow control device 2400 for a desired period of time.

If the flow control device 2400 is to be shut off, the magnetic positioning tool may be passed by the release mechanism 2320 a second time, resulting in the generation of a subsequent signal by the controller. Upon the generation of the subsequent signal, one or more of the remaining actuators in the release mechanism 2320 may be actuated. Upon opening a route of fluid communication into a secondary chamber, fluid contained within the first chamber 2236 and the initially opened secondary chamber may flow into the newly opened secondary chamber. The release piston 2216 may then shift further out of radial alignment with the locking feature 2322 on the wellbore tubular 2404. When the release piston 2216 translates, the locking feature 2218 on the sliding sleeve 2206 may then continue to shift into engagement with the locking feature 2322 on the wellbore tubular 2404. The end 2214 of the release piston 2216 may limit the extent of the axial translation of the sliding sleeve 2206. The locking features 2218, 2322 may continue to retain the sliding sleeve 2206 in position.

When the sliding sleeve 2206 further translates into engagement with the locking feature 2322 into the second position, flow through both ports 2204, 2304 may be substantially blocked. In an embodiment, the closure of both ports 2204, 2304 may substantially block flow into and/or out of the flow control device 2400, thereby closing off the flow control device 2400 to production. Closing off all of the ports 2204, 2304 through the flow control device 2400 may be used selectively isolate one or more zones and/or adjust a flow into the wellbore tubular string. Once the sliding sleeve 2206 is retained in the desired position, additional operations and/or production may be performed.

In an embodiment, a plurality of actuators may be actuated in the release mechanism 2320 based on the initial pass of the magnetic positioning tool. As a result, the sliding sleeve 2206 may be allowed to transition from the bypassed configuration directly to the fully closed configuration. While described in terms of transitioning from a bypassed (e.g., open or unrestricted) configuration, to a restricted configuration, to a closed configuration, any order of these three configurations may be possible. In addition, any number of restricted configurations may also be used. For example, a plurality of flow restrictions may be selectively opened or closed to provide a plurality of restricted configurations. In some embodiments, a plurality of flow control devices may be present in a zone of a multi-zone completion, thereby providing flexibility in determining the resistance to flow from one production zone to the next.

Figure 25:
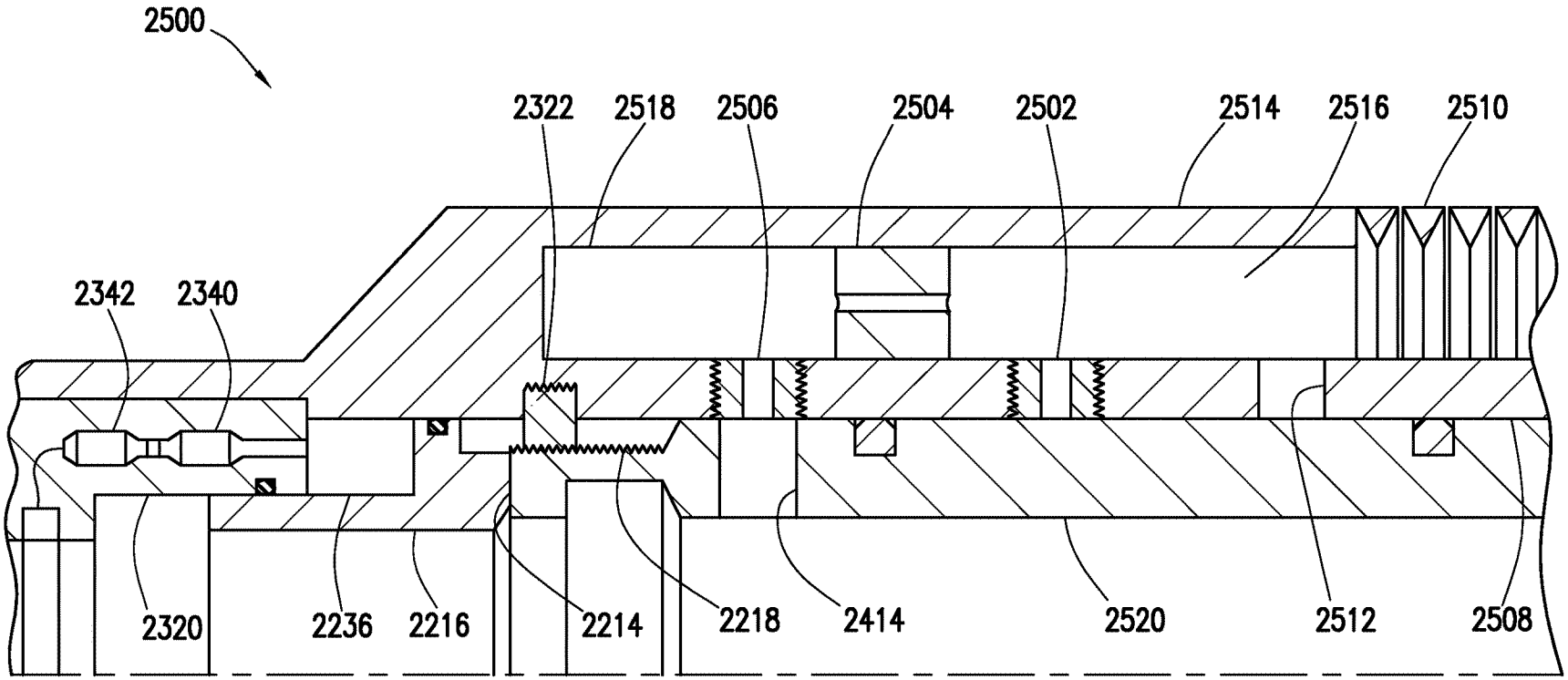
FIG. 25 illustrates a schematic cross-sectional view of another embodiment of a locking mechanism used with an embodiment of a flow control device.

In some embodiments, the sleeve assembly 2201 and/or the sleeve assembly 2301 may be used with or as part of flow control devices having alternative configurations. FIG. 25 illustrates another embodiment of a flow control device 2500. The flow control device 2500 may be similar in several aspects to the flow control device 2400 described with respect to FIG. 24, and similar elements will not be described in detail in the interest of clarity. As shown in FIG. 25, a flow control device 2500 may comprise a port 2512, and a plurality of flow restrictions 2502, 2504, 2506 disposed in a fluid pathway between an exterior of a wellbore tubular 2508 and an interior of the wellbore tubular 2508. The flow control device 2500 can be coupled to a filter element 2510 to produce a fluid through the filter element 2510 and into the wellbore tubular through the port 2512, and flow restrictions 2502, 2504, 2506.

The filter element 2510 is used to filter at least a portion of any sand and/or other debris from a fluid that generally flows from an exterior to an interior of the wellbore tubular 2508. The filter element 2510 may be the same or similar to the filter element described above with respect to FIG. 24. The flow control device 2500 may perform several functions. In an embodiment, the flow control device 2500 is an ICD which functions to restrict flow therethrough, for example, to balance production of fluid along an interval. As shown in FIG. 25, the flow control device 2500 generally comprises a port 2512, flow restrictions 2502, 2504, and 2506 disposed in one or more fluid pathways between an exterior of the wellbore tubular 2508 and an interior throughbore of the wellbore tubular 2508. In an embodiment, the port 2512 and the flow restrictions 2502, 2504, and 2506 are disposed within a housing 2514. The housing 2514 can comprise a generally cylindrical member disposed about the wellbore tubular 2508. The housing 2514 may be fixedly engaged with the wellbore tubular 2508 and one or more seals may be disposed between the housing 2514 and the exterior surface of the wellbore tubular 2508 to provide a substantially fluid tight engagement between the housing 2514 and the wellbore tubular 2508. A first housing chamber 2516 may be defined between the interior surface of the housing 2514, the outer surface of the wellbore tubular 2508, the flow restriction 2504, and the filter element 2510. A second housing chamber 2518 may be defined between the interior surface of the housing 2514, the outer surface of the wellbore tubular 2508, and the flow restriction 2504. A flow restriction 2502 may be disposed in the wellbore tubular 2508 to provide fluid communication between the first housing chamber 2516 and the interior of the wellbore tubular 2508. A flow restriction 2506 may be disposed in the wellbore tubular 2508 to provide fluid communication between the second housing chamber 2518 and the interior of the wellbore tubular 2508. In an embodiment, the flow restrictions 2502, 2506 comprise an orifice or nozzle type restriction.

In some embodiments, a second set of one or more ports 2512 may also be disposed in the wellbore tubular 2508. The one or more ports 2512 may provide fluid communication between the interior throughbore of the wellbore tubular 2508 and the interior of the first housing chamber 2516. In an embodiment, the ports 2512 may not comprise flow restrictions and may allow for fluid flow through the ports 2512 in a relatively unrestricted manner. For example, the resistance to flow through the ports 2512 may be less than about half, less than about a quarter, or less than about a tenth of the resistance through any of the flow restrictions 2502, 2504, 2506. The ports 2512 may generally comprise apertures with square, rounded, slotted, or other configurations. The ports 2512 provide fluid communication to the first housing chamber 2516 and/or the filter element 2510.

When the release piston 2216 is in the initial position, the sliding sleeve 2520 can be configured to engage a shifting tool and be selectively shifted open and closed. In the closed position, the sliding sleeve 2520 can prevent flow through port 2512, while allowing flow through the flow restrictions 2502 and/or flow restrictions 2506. In the open position, the sliding sleeve 2520 may be shifted to allow flow through port 2512.

When the sliding sleeve 2520 is shifted to the closed position, any fluid passing through the filter element 2510 and into the first housing chamber 2516 may pass through the flow restriction 2502 before flowing into the throughbore of the wellbore tubular 2508. The flow restriction 2502 is configured to provide a desired resistance to fluid flow through the flow restriction 2502. The flow restriction 2502 may be selected to provide a resistance for balancing the production along an interval. Various types of flow restrictions 2502 can be used with the flow control device 2500 described herein including any of those described above.

During operation, the fluid would typically flow from the exterior of the wellbore tubular 2508 to the screen assembly, through the filter element 2510, and to the flow control device 2500. Within the flow control device 2500, the fluid can flow through the first housing chamber 2516, and through the port 2512 which does not significantly restrict the flow. The fluid can also flow through flow restriction 2502, which may provide a resistance to the flow of the fluid, and/or the fluid can flow through restriction 2504 and into the second housing chamber 2518 before passing through the restriction 2506 disposed in the wellbore tubular 2508. While various flow paths are available, the relative flow rates may be related to the relative flow resistance through each flow path and the majority of the fluid may flow through the path with the lowest resistance, which may be the ports 2512. The fluid can then flow into the interior throughbore of the wellbore tubular 2508, which extends longitudinally through the flow control device 2500 as part of the tubular string. The fluid can then be produced through the tubular string to the surface. The fluid may also flow outwardly through the filter element 2510. For example, the fluid may flow from the interior throughbore of the wellbore tubular 2508 outwardly towards the exterior of the wellbore tubular 2508. While described in terms of the specific arrangement of the filter element 2510 and the flow control device 2500, the flow control device 2500 could be upstream of the filter element 2510 relative to a fluid flowing from the exterior of the wellbore tubular 2508 to the interior throughbore.

In an embodiment, the flow control device may comprise a single or multi-position locking system as described above with respect to FIGS. 22, 23A, and 23B. While described with respect to a multi-position locking system below, it should be understood that the single position locking system would be equally applicable to use with the flow control device 2500 in blocking one or more of the ports 2512, and restrictions 2502, 2506. The result of this configuration is to allow the sleeve 2520 to provide a plurality of locked positions. Thus, the sliding sleeve 2520 may be reconfigured between an open and closed position, and subsequently placed into one or more locked positions, which may determine the flow configuration and flow resistance between the interior throughbore of the wellbore tubular 2508 and the exterior of the wellbore tubular 2508. The release mechanism 2320 may be the same as described above and will therefore not be discussed in detail with respect to FIG. 25.

In use, the sliding sleeve 2520 may be axially translated using a shifting tool to engage a profile associated with the sliding sleeve 2520 and then shift the sliding sleeve in response to a force applied to the shifting tool. The sliding sleeve 2520 may engage a shoulder or stop at the open position, the closed position, or one or more partially closed positions to allow the shifting tool to be disengaged from the sliding sleeve 2520.

At a desired time, the sliding sleeve 2520 may be retained in one of a plurality of locked positions. In an embodiment, the sliding sleeve 2520 may be retained in a partially or fully closed position, though in other embodiments, a sliding sleeve may be retained in a partially or fully open position (e.g., locked open). The sliding sleeve 2520 may be retained in position by passing a magnetic positioning tool by the release mechanism 2320. The magnetic positioning tool comprising a plurality of magnets may be passed by the release mechanism 2320 as described above with respect to any of FIGS. 21, 22A, and 23B. The magnetic positioning tool may be configured to change the magnetic pattern of the plurality of magnets using rotation according to any of the embodiments disclosed herein. The magnetic positioning tool may be reconfigured within the wellbore to provide a magnetic pattern configured to trigger the actuation of one or more of the actuators in the release mechanism 2320.

Upon passing the magnetic positioning tool past the one or more sensors and/or receivers in the release mechanism 2320, the sensors and/or receivers may detect the magnetic pattern associated with the magnetic positioning tool. A signal may be generated in response to detecting the magnetic pattern, and the signal may be passed to the controller in the release mechanism 2320. The controller may compare a received signal with a stored set of signal and response data. If the received signal corresponds to an action, the controller may then generate a signal to actuate one or more of the actuators in the release mechanism 2320. Any of the considerations discussed above may be used to generate one or more signals to actuate one or more of the actuators in the release mechanism 2320.

Upon the generation of the signal by the controller, one or more of the actuators in the release mechanism 2320 may actuate and open a route of fluid communication with the chamber 2236. Upon opening a route of fluid communication, fluid contained within the first chamber 2236 may flow into a secondary chamber 2340 in the release mechanism 2320. In response to the fluid flowing into the secondary chamber 2340, the release piston 2216 may shift partially out of radial alignment with the locking feature 2322 on the wellbore tubular 2508, which may form an outer housing for the release mechanism 2320. For example, the release piston 2216 may shift towards the release mechanism 2320.

When the release piston 2216 translates, the locking feature 2218 on the sliding sleeve 2520 may then shift into engagement with the locking feature 2322 on the wellbore tubular 2508 while being limited by the end 2214 of the release piston 2216. Upon engaging, the locking features 2218, 2322 may retain the sliding sleeve 2520 in position. When the sliding sleeve 2520 translates into engagement with the locking feature 2322 into the first position, flow through the port 2512 and restriction 2502 may be substantially blocked while the flow restriction 2506 may be radially aligned with the port 2414 in the sliding sleeve 2520, thereby permitting flow through the ports 2506. In this embodiment, the flow control device 2500 may initially be in a bypassed configuration in which fluid flow is relatively unrestricted through the ports 2512. By substantially blocking the ports 2512, fluid may be forced through the flow control device 2500 and the flow restrictions 2502 and 2506. In some embodiments, the sliding sleeve 2520 may only be shifted to align the port 2414 with the flow restrictions 2502 in the wellbore tubular 2508. This position may provide a resistance to fluid flow through the flow control device 2500 that is greater than the bypassed configuration but less than the resistance through the flow restrictions 2504 and 2506. Fluid may then be produced and/or injected through the flow control device 2500 for a desired period of time.

If the flow control device 2500 is to be substantially closed off, the magnetic positioning tool may be passed by the release mechanism 2320 a second time, resulting in the generation of a subsequent signal by the controller. Upon the generation of the subsequent signal, one or more of the remaining actuators in the release mechanism 2320 may be actuated. Upon opening a route of fluid communication into a secondary chamber 2342, fluid contained within the first chamber 2236 and the initially opened secondary chamber 2340 may flow into the newly opened secondary chamber 2342. The release piston 2216 may then shift further out of radial alignment with the locking feature 2322 on the wellbore tubular 2508. When the release piston 2216 translates, the locking feature 2218 on the sliding sleeve 2520 may then continue to shift into engagement with the locking feature 2322 on the wellbore tubular 2508. The end 2214 of the release piston 2216 may limit the extent of the axial translation of the sliding sleeve 2206. The locking features 2218, 2322 may continue to retain the sliding sleeve 2520 in position.

When the sliding sleeve 2520 further translates into engagement with the locking feature 2322 into the second position, flow through the ports 2512 and restrictions 2502 and 2506 may be substantially blocked. In an embodiment, the closure of both ports 2512 and restrictions 2502 and 2506 may substantially block flow into and/or out of the flow control device 2500, thereby closing off the flow control device 2500 to production. Closing off all of the ports 2512 and restrictions 2502 and 2506 through the flow control device 2500 may be used selectively isolate one or more zones and/or adjust a flow into the wellbore tubular string. Once the sliding sleeve 2520 is retained in the desired position, additional operations and/or production may be performed.

In an embodiment, a plurality of actuators may be actuated in the release mechanism 2320 based on the initial pass of the magnetic positioning tool. As a result, the sliding sleeve 2520 may be allowed to transition from the bypassed configuration directly to the fully closed configuration. While described in terms of transitioning from a bypassed (e.g., open or unrestricted) configuration, to one or more restricted configurations, to a closed configuration, any order of these three configurations may be possible. For example, a fully opened position may be desirable in some embodiments to allow for a relatively unrestricted fluid flow at or near the end of the life of the wellbore. Accordingly, the last position may correspond with a bypassed configuration as described with respect to FIG. 24. In some embodiments, a plurality of flow control devices may be present in a zone of a multi-zone completion, thereby providing flexibility in determining the resistance to flow from one production zone to the next.

In some embodiments, a shear joint may be used in the completion assembly to allow for relative movement between the completion assembly components during production. The shear joint is initially installed in the wellbore in a locked configuration to prevent relative movement during the installation procedures that can result, for example, from the high pressures associated with the fluids used during the installation process (e.g., the gravel slurry, fracturing fluids, etc.). A shear joint may be installed in each zone as shown in FIG. 21, for example between the sleeve assemblies 150 and the screen assemblies 151.

Figure 26:
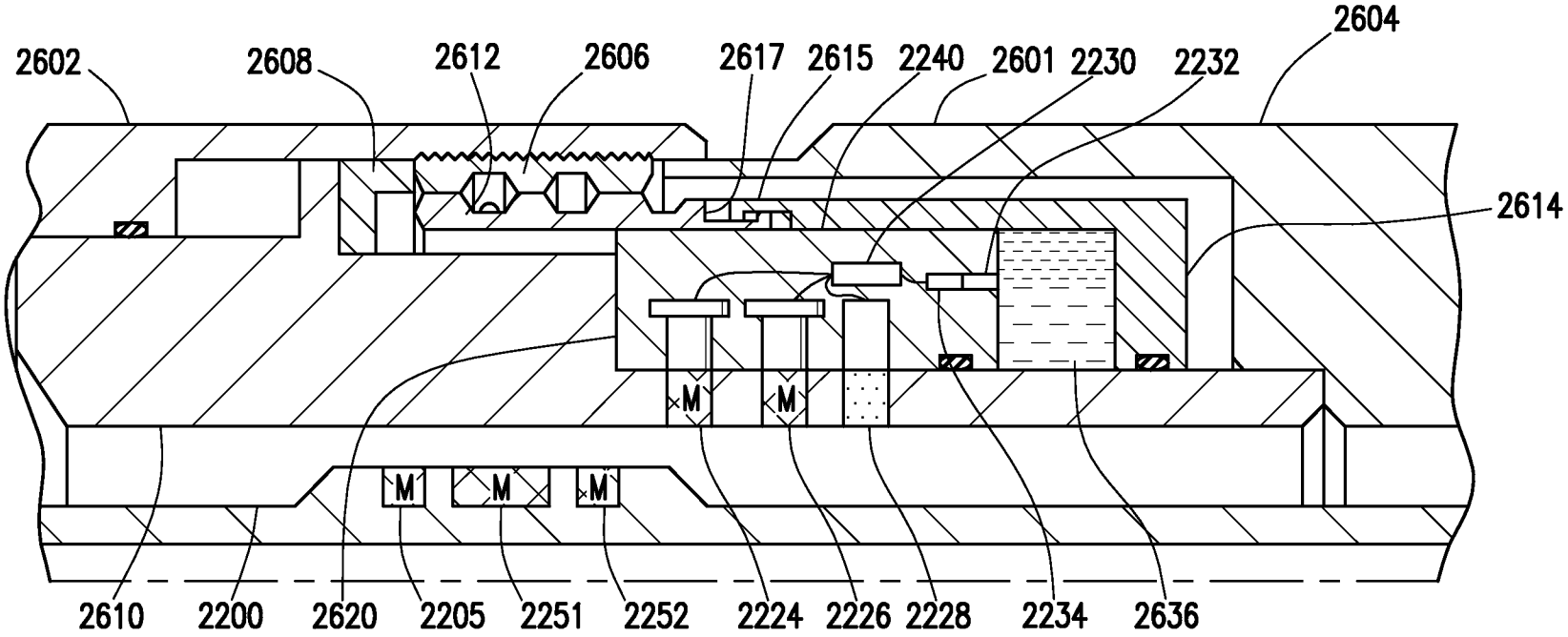
FIG. 26 illustrates a schematic cross-sectional view of a release mechanism according to an embodiment.

An embodiment of a locking mechanism 2601 for a shear joint is shown in FIG. 26. The shear joint locking mechanism 2601 comprises a load ring 2606 engaging an upper sub 2602. The load ring 2606 is maintained in an engaged position by a piston prop 2612 that engages and/or forms a portion of a piston 2614. When engaged with the upper sub 2602, the load ring 2606 retains the upper sub 2602 in a relatively fixed position with respect to a lower sub 2604. An inner mandrel 2610 may form a portion of a chamber 2636 containing a fluid. The piston 2614 may be prevented from moving due to the fluid within the chamber 2536.

The upper sub 2602 may form a portion of the wellbore tubular string (e.g., wellbore tubular 115 of FIG. 21) and comprise a generally cylindrical body having a flow bore disposed therethrough. An upper end of the upper sub 2602 may be coupled to the wellbore tubular string, using for example threads or any other coupling means. Similarly, the lower sub 2604 may form a portion of the wellbore tubular string (e.g., wellbore tubular 115 of FIG. 21) and comprise a generally cylindrical body having a flow bore disposed therethrough. A lower end of the lower sub 2604 may be coupled to the wellbore tubular string, using for example threads or any other coupling means. When locked, the upper sub 2602 may be relatively fixed to axial and/or rotational motion with respect to the lower sub 2604. When unlocked, the upper sub 2602 may be free to telescope over a certain range with respect to the lower sub 2604, thereby allowing for relative movement of the wellbore tubular string.

The load ring 2606 generally comprises a cylindrical or circular ring or a set of lugs that is configured to radially expand into engagement with the upper sub 2602. In order to provide the radial contraction and/or expansion, the load ring 2606 may comprise one or more longitudinal cuts or grooves to form a C-ring or snap ring. The load ring 2606 may comprise one or more locking features configured to engage corresponding locking features on the upper sub 2602 when expanded. The resulting engagement between the locking features may prevent relative axial translation between the load ring 2606 and the upper sub 2602. A variety of corresponding locking features may be present on the load ring 2606 and the upper sub 2602. For example, the locking features may comprise engaging protrusions and/or recesses such as threads, castellations, corrugations, teeth, or the like. The load ring 2606 may be biased inwards while being retained or propped in an expanded position by the piston prop 2612. The inner surface of the load ring 2606 and the outer surface of the piston prop 2612 may comprise surface features comprising protrusions and recesses such as corrugations. The load ring 2606 may be retained in an expanded position when the peaks of the surface features align, and the load ring 2606 may be allowed to radially contract when the peaks of the surface features on the load ring 2606 align with the valleys of the surface features on the piston prop 2612. In the contracted position, the load ring 2606 may disengage from the upper sub 2602.

In the expanded position, the load ring 2606 may engage the upper sub 2602. A retaining ring 2608 may be disposed between the inner mandrel 2610 and the upper sub 2602, and be retained by an extension on the inner mandrel 2610. The load ring 2606 may be axially retained between the retaining ring 2608 and the lower sub 2604. The engagement between the load ring 2606 and the upper sub 2602 along with the axial engagement between the load ring 2606 and the retaining ring 2608 and the lower sub 2604 prevents relative movement between the upper sub 2602 and the lower sub 2604. In some embodiments, one or more shear pins or screws may be configured to limit or prevent relative rotational motion between the upper sub 2602 and the lower sub 2604. For example, a shear pin may pass through the upper sub 2602 and into the lower sub 2604 to rotationally lock the upper sub 2602 to the lower sub 2604. In some embodiments, a shear pin may engage the upper sub 2602 or the lower sub 2604 and ride in an axial slot in the other component. This configuration may allow the shear pin to axially translate in the slot to some degree but prevent rotational motion due to the engagement of the pin with the side walls of the slot. Various other configurations could also be used to limit or prevent rotational motion between the upper sub 2602 and the lower sub 2604 when the upper sub 2602 is locked with respect to the lower sub 2604.

While a load ring 2606 is illustrated as being disposed between the inner mandrel 2610 and the upper sub 2602, other suitable locking mechanisms may also be used. For example, a collet having an indicator configured to engage the upper sub 2602 may also be used. In this embodiment, the piston prop 2612 would prop the collet into engagement with the upper sub 2602 until shifted to allow the collet and/or collet indicator to disengage from the upper sub 2602.

The inner mandrel 2610 may be coupled to the lower sub 2604 (e.g., by a threaded connection). The inner mandrel 2610 generally comprises a cylindrical body disposed coaxially with the lower mandrel 2604 and having a flow bore disposed therethrough. A chamber may be formed between the inner mandrel 2610 and the lower sub 2604 and/or the upper sub 2602. The piston 2614 may be disposed in the chamber between the inner mandrel 2610 and the upper sub 2602 and/or the lower sub 2604. The piston 2614 comprises a generally cylindrical body disposed concentrically with the lower sub 2604. The piston 2614 may engage the inner mandrel 2610 to form a chamber 2636 (e.g., an annular chamber) defined by the inner surface of the piston 2614, a surface of the release mechanism 2620, and the inner mandrel 2610. One or more seals (e.g., o-ring seals, T-seals, chevron seals, etc.) may be used substantially seal the chamber 2636.

The piston prop 2612 engages and/or forms a portion of the piston 2614. In an embodiment, the piston 2614 and the piston prop 2612 are separated components that engage to allow for a relatively minor amount of relative axial motion. The axial motion may allow the piston to axial translate in response to a change in hydrostatic pressure incident upon the piston 2614. The axial movement of the piston 2614 may allow the hydrostatic pressure acting on the lower surface of the piston to be balanced by the pressure of the fluid within the chamber 2636. As shown in FIG. 26, the upper end of the piston 2614 may comprise an indicator 2615 configured to engage a slot 2617 in the piston prop 2612. The indicator 2615 can axially translate within the slot 2617 over a short distance but is constrained from unlimited upwards axial motion due to the engagement of the end of the indicator with the end of the slot 2617. The indicator is constrained from unlimited downwards axial motion due to the engagement of the inward extension on the indicator 2615 with the outwards extension at the lower end of the slot 2617. Further, rotational motion can be limited or prevented due to the engagement of the indicator 2615 with the side walls of the slot 2617. In some embodiments, the indicator and slot 2617 may not be present, and the upper end of the piston 2614 may be configured to engage a lower end of the piston prop 2612. In this embodiment, the piston may axially translate below the piston prop 2612 and engage the piston prop 2612 upon actuation of the release mechanism 2620 as described below. This configuration may be referred to as a floating piston in some settings. In some embodiments, the piston 2614 and the piston prop 2612 may form an integrated, unitary component.

A release mechanism 2620, which may be similar to the release mechanism 2220 described with respect to FIG. 22, may be used to release the piston 2614 for movement, thereby triggering the release of the upper sub 2602 relative to the lower sub 2604. As described in more detail below, an actuator 2232 may be disposed in a fluid pathway between the first chamber 2636 and a second chamber 2240 (e.g., an annular chamber, a cylindrical chamber, etc.) formed within the release mechanism 2620. In the initial position, the actuator 2232 may substantially seal the first chamber 2636 from the second chamber 2240. A fluid within the first chamber 2636 forms a fluid lock that substantially prevents axial movement of the piston 2614 until the fluid is allowed to flow out of the first chamber 2636. In the initial position, the piston prop 2612 is disposed in radial alignment with the load ring 2606, thereby maintaining the upper sub 2602 in position relative to the lower sub 2604. When the fluid is allowed to flow out of the first chamber 2636, the piston 2614 can axially translate, thereby translating the piston prop 2612 with respect to the load ring 2606.

The one or more sensors 2224, 2226, the optional controller 2230, the actuator 2232, and/or actuable member 2234 may be the same or similar to those elements described with respect to FIG. 22. As described above, the actuation of the actuable member 2234 in response to a signal (e.g., a magnetic signal) may allow the piston 2614 to shift, thereby shifting the piston prop 2612 and releasing the load ring 2606. In an embodiment, the actuation of the actuable member 2234 may allow the fluid to flow out of the first chamber 2636 and into the second chamber 2240. The piston 2614 may then translate and shift the piston prop 2612. As the piston prop 2612 shifts, the surface features on the inner surface of the load ring 2606 and the outer surface of the piston prop 2612 may align to allow the load ring 2606 to contract inwards. When the load ring 2606 contracts inward, the load ring 2606 may disengage and release from the upper sub 2602. The upper sub 2602 may then be free to telescope with respect to the lower sub 2604 and the inner mandrel 2610.

In use, the shear joint comprising the locking mechanism 2601 may form a portion of a completion assembly and may be used during a drilling, drill-in, completion, and/or workover operation. The shear joint may be used to provide relative movement between the portions of the completion assembly after the assembly is installed within the wellbore. The locking mechanism 2601 may be used to retain the shear joint in position during the installation and various completion procedures used to install the completion assembly. For example, the locking mechanism 2601 may be used to maintain the upper sub 2602 in a substantially fixed relationship to the lower sub 2604 during conveyance of the completion assembly into the wellbore and/or the performance of a gravel packing and/or a fracturing operation.

Once the various completion procedures have been performed (e.g., completion assembly installation, gravel packing, fracturing procedures, etc.) in one or more zones, the shear joint locking mechanism 2601 may be released to provide relative movement between portions of the completion assembly. At a desired time, for example upon completion of the operation or completion of a zone in a multi-zone well, the locking mechanism 2601 may be unlocked or released. The locking mechanism 2601 may be retained in position by passing a magnetic positioning tool 2200 by the locking mechanism 2601. As illustrated in FIG. 26, a magnetic positioning tool 2200 comprising a plurality of magnets 2250, 2251, 2252 may be passed by the locking mechanism 2601. The magnetic positioning tool 2200 may be disposed in the wellbore as part of a workover string. Alternatively or in addition thereto, the magnetic positioning tool 2200 may be disposed in the wellbore on a separate conveyance means or as a separate component (e.g., as part of a ball or dart) to trigger the actuation of the actuator 2232.

The magnetic positioning tool 2200 may be configured to change the magnetic pattern of the plurality of magnets 2250, 2251, 2252 using rotation according to any of the embodiments disclosed herein. The magnetic positioning tool 2200 may be reconfigured within the wellbore to provide a magnetic pattern configured to trigger the actuation of the actuator 2232. In some embodiments, the magnetic positioning tool 2200 may be configured with a magnetic pattern that will not trigger the actuation of the actuator 2232, for example when the locking mechanism 2601 is not to be activated to release the shear joint.

Upon passing the magnetic positioning tool 2200 past the one or more sensors 2224, 2226 and/or receivers 2228, the sensors and/or receivers may detect the magnetic pattern associated with the magnetic positioning tool 2200. A signal may be generated by the one or more sensors 2224, 2226 and/or receivers 2228 in response to detecting the magnetic pattern. In some embodiments, an additional signal may be received by the one or more sensors 2224, 2226 and/or receivers 2228. For example, an acoustic signal may be received by the receiver 2228 and a signal may be generated by the receiver 2228 in response to receiving the acoustic signal. The signal may be passed to the controller 2230 along with the signal generated by the sensors 2224, 2226.

The controller 2230 may compare a received signal with a stored set of signal and response data. If the received signal corresponds to an action, the controller may then generate a signal to actuate one or more of the actuators 2330, 2332. Any of the considerations discussed above may be used to generate one or more signals to actuate one or more of the actuators 2330, 2332.

Upon the generation of the signal by the controller 2230, the actuator 2232 may actuate. In an embodiment, the actuator 2232 may open a route of fluid communication between the first chamber 2636 and the second chamber 2240 in response to receiving the signal. For example, the actuator 2232 may be configured to puncture, perforate, rupture, pierce, destroy, disintegrate, combust, open, or otherwise form a fluid passage through an actuable member 2234. Upon opening a route of fluid communication, fluid contained within the first chamber 2636 may flow into the second chamber 2240. In response to the fluid flowing into the second chamber 2240, the piston 2614 may shift towards the actuable member 2234. The piston prop 2612, may then shift with respect to the load ring 2606. As the surface features on the load ring 2606 and the piston prop 2612 shift with respect to each other, the load ring 2606 may be allowed to contract inwards due to the alignment of the peaks on the load ring 2606 aligning with the valleys on the piston prop 2612. Upon contraction of the load ring 2606 inwards, the load ring 2606 may disengage from the upper sub 2602. Once the load ring 2606 is contracted, the upper sub 2602 may be free to translate (e.g., telescope in or out) relative to the lower sub 2604. During production, the relative movement between the upper sub 2602 and the lower sub 2604 may alleviate stress in the completion string while maintaining a sealed flow path.

While the magnetic positioning tool 2200 is described above in terms of actuating a locking mechanism in a sleeve assembly and/or a locking mechanism 2601 in a shear joint, the magnetic positioning tool 2200 may also be used to actuate various other devices using a similar locking mechanism. The locking mechanism may be used to lock a sleeve in a desired position (e.g., locked open, locked closed, locked in a partially open position, etc.) and/or release various other components to release a locked component. Suitable devices may include production sleeves, safety valves, cross-over valves, and the like. For example, a production sleeve may comprise one or more inflow control devices. The locking device may be used to release a shifting sleeve or piston to change the configuration of the inflow control device. For example, one or more production ports can be open or closed, one or more pathways through independent screens or flow restrictors can be opened or closed, and/or an inflow control device can be bypassed or entirely closed off. In some embodiments, a cross-over valve may be switched to a locked closed position to prevent the inadvertent opening of the valve at a desired time. Various other uses may also be suitable with the locking mechanism as described herein.

Having described the various tools, systems, and method herein, embodiments may include, but are not limited to:

In a first embodiment, an actuation device comprises a housing, and a plurality of permanent magnets disposed about the housing. The plurality of permanent magnets is configured to selectively transition between a first position and a second position, and the plurality of permanent magnets is configured to provide a stronger magnetic field strength outside the housing than inside the housing in the first position. The plurality of permanent magnets is configured to provide a stronger magnetic field strength inside the housing than outside the housing in the second position.

In a second embodiment, the plurality of permanent magnets of the first embodiment can be configured in a Halbach Array, and/or in a third embodiment, the plurality of permanent magnets of the first embodiment can be configured in a Halbach Cylinder. In a fourth embodiment, the actuation device of any of the first to third embodiments may also include a biasing member coupled to the plurality of magnets, where the biasing member may be configured to bias the plurality of permanent magnets towards the first position. In a fifth embodiment, at least a portion of the plurality of permanent magnets of any of the first to fourth embodiments may be configured to rotate to selectively transition between the first position and the second position. In a sixth embodiment, at least a portion of the plurality of permanent magnets of any of the first to fifth embodiments may be configured to axially translate to selectively transition between the first position and the second position. In a seventh embodiment, the plurality of permanent magnets of any of the first to sixth embodiments may be disposed about an outer circumference of the housing. In an eighth embodiment, the plurality of permanent magnets of any of the first to seventh embodiments may comprise a plurality of magnetic rods. In a ninth embodiment, the actuation device of any of the first to eighth embodiments may also include at least one motor and a plurality of gear mechanisms linked to the plurality of permanent magnets, the at least one motor may be coupled to the plurality of gear mechanisms, and the at least one motor may be configured to rotate the plurality of permanent magnets using the plurality of gear mechanisms. In a tenth embodiment, the actuation device of any of the first to eighth embodiments may also include a driving member configured to axially translate in response to an applied force, and a gear mechanism coupled to one or more of the plurality of permanent magnets. The gear mechanism may be configured to rotate the one or more of the plurality of permanent magnets in response to an axial translation of the driving member. In an eleventh embodiment, the applied force in the tenth embodiment may comprise a pressure force, a mechanical force, an electro-mechanical force, or any combination thereof.

In a twelfth embodiment, a magnetic positioning tool system comprises a magnetic positioning tool disposed within an outer mandrel, and an actuable component operably associated with the outer mandrel. The magnetic positioning tool comprises: a housing, and a plurality of magnets disposed about the housing. The plurality of magnets are configured to selectively transition between a first position and a second position, and the magnetic positioning tool is configured to actuate the actuable component based on transitioning the plurality of magnets from the first position to the second position. In a thirteenth embodiment, the actuable component of the twelfth embodiment may comprise a sliding sleeve disposed about the outer mandrel, and the sliding sleeve may be configured to magnetically couple to the plurality of magnets when the plurality of magnets are in the second position. In a fourteenth embodiment, the sliding sleeve of the thirteenth embodiment may be configured not to couple with the plurality of magnets when the plurality of magnets are in the first position. In a fifteenth embodiment, the actuable component of the twelfth embodiment may comprise a locking mechanism engaging the outer mandrel and a sliding sleeve. In a sixteenth embodiment, the locking mechanism of the fifteenth embodiment may be configured to retain the sliding sleeve in position, and the locking mechanism may be configured to release the sliding sleeve for axial movement in response to the plurality of magnets transitioning to the second position. In a seventeenth embodiment, the magnetic positioning tool system of the twelfth embodiment may also include a magnetic sensor, and a controller. The magnetic sensor may be configured to detect the position of the plurality of magnets and generate a signal in response to the plurality of magnets being in the second position. The controller may be configured to actuate the actuable component based on the signal. In an eighteenth embodiment, the controller of the seventeenth embodiment may be configured to open a valve, close a valve, activate a hydrostatic chamber to shift a sleeve open, activate a hydrostatic chamber to shift a sleeve closed, set a hydraulic packer, and/or release a compaction joint in response to the signal. In a nineteenth embodiment, the magnetic sensor of the seventeenth or eighteenth embodiments may comprise at least one of a magneto-resistive sensor, hall-effect sensor, or conductive coils. In a twentieth embodiment, the magnetic sensor of any of the seventeenth to nineteenth embodiments may be configured to indicate at least the direction the magnetic positioning tool system is traveling, the time the magnetic tool system passes one or more permanent magnets, and/or the number of permanent magnets the magnetic positioning tool system passes. In a twenty first embodiment, the controller of any of the seventeenth to twentieth embodiments may be configured to actuate the actuatable component when the controller receives the signal from the magnetic sensor or after a time delay after the controller receives the signal from the magnetic sensor.

In a twenty second embodiment, A method of magnetically actuating a downhole component comprises positioning a magnetic positioning tool adjacent an actuable component within a wellbore, transitioning the plurality of magnets from the first position to a second position, magnetically coupling the plurality of magnets with the actuable components, and actuating the actuable component within the wellbore in response to the magnetic coupling. The magnetic positioning tool comprises a plurality of magnets arranged in a first position. In a twenty third embodiment, the method of the twenty second embodiment may also include detecting that the plurality of magnets are in the second position using a magnetic sensor, and generating a signal based on the detecting, wherein actuating the actuable component is based on the generating of the signal. In a twenty fourth embodiment, transitioning the plurality of magnets from the first position to the second position in the twenty second or twenty third embodiments may comprise at least one of rotating one or more of the plurality of magnets or axially translating one or more of the plurality of magnets. In a twenty fifth embodiment, actuating the actuable component in any of the twenty second to twenty fourth embodiments may comprise axially translating a sleeve within the wellbore based on the magnetic coupling. In a twenty sixth embodiment, actuating the actuable component in any of the twenty second to twenty fifth embodiments may comprise releasing a locking mechanism based on the magnetic coupling, and allowing a downhole component to translate in response to releasing the locking mechanism.

In a twenty seventy seventh embodiment, a magnetic positioning tool system comprises an outer mandrel comprising a plurality of magnets, and a magnetic positioning tool disposed within the outer mandrel. The plurality of magnets are configured to selectively transition between at least a first position and a second position. The magnetic positioning tool comprises: a magnetic sensor that is configured to detect the position of a plurality of magnets and generate a signal indicative of the position of the plurality of magnets. In a twenty eight embodiment, the magnetic positioning tool of the twenty seventh embodiment may also include a controller, where the controller may be configured to transmit the signal to another location. In a twenty ninth embodiment, the controller of the twenty eighth embodiment may be configured to open a valve, close a valve, activate a hydrostatic chamber to shift a sleeve open, activate a hydrostatic chamber to shift a sleeve closed, set a hydraulic packer, and/or release a compaction joint in response to the signal. In a thirtieth embodiment, the magnetic sensor of any of the twenty seventh to twenty ninth embodiments may comprise at least one of a magneto-resistive sensor, hall-effect sensor, or conductive coils. In a thirty first embodiment, the magnetic sensor of any of the twenty seventh to thirtieth embodiments may be configured to indicate at least of the direction the magnetic positioning tool system is traveling, the time the magnetic tool system passes one or more permanent magnets, and/or the number of permanent magnets the magnetic positioning tool system passes.

In a thirty second embodiment, a method of actuating a downhole component comprises: positioning a magnetic positioning tool adjacent an actuable component within a wellbore, transitioning the plurality of magnets from the first position to a second position, detecting the plurality of magnets using a sensor associated with the actuable component, generating a signal indicative of the plurality of magnets being in the second position, and actuating the actuable component within the wellbore in response to the signal. The magnetic positioning tool comprises a plurality of magnets arranged in a first position. In a thirty third embodiment, transitioning the plurality of magnets from the first position to the second position in the thirty second embodiment may comprise at least one of rotating one or more of the plurality of magnets or axially translating one or more of the plurality of magnets. In a thirty fourth embodiment, actuating the actuable component of the thirty second or thirty third embodiment may comprises axially translating a sleeve within the wellbore based on the magnetic coupling. In a thirty fifth embodiment, actuating the actuable component in any of the thirty second to thirty fourth embodiments may comprise releasing a locking mechanism based on the magnetic coupling, and allowing a downhole component to translate in response to releasing the locking mechanism. In a thirty sixth embodiment, actuating the actuable component in any of the thirty second to thirty fifth embodiments may comprise activating a locking mechanism based on the magnetic coupling, and locking a downhole component to translation in response to activating the locking mechanism. In a thirty seventh embodiment, actuating the actuable component in any of the thirty second to thirty sixth embodiments may comprise opening a valve, closing a valve, activating a hydrostatic chamber to shift a sleeve open, activating a hydrostatic chamber to shift a sleeve closed, setting a hydraulic packer, and/or releasing a compaction joint in response to the signal. In a thirty eighth embodiment, the method of any of the thirty second to thirty seventh embodiments may also include detecting a direction of travel of the magnetic positioning tool, where the signal may be further indicative of the direction of travel of the magnetic positioning tool. In a thirty ninth embodiment, the method of any of the thirty second to thirty eighth embodiments may also include detecting a number of times the magnetic positioning tool passes the sensor; where the signal may be further indicative of the number of times the magnetic positioning tool passes the sensor.

In a fortieth embodiment, a magnetically actuated device comprises a magnetic sensor, a first chamber comprising a fluid, a second chamber, an actuator, and a piston defining a portion of the first chamber. The actuator is configured to selectively provide fluid communication between the first chamber and the second chamber in response to the magnetic sensor detecting a magnetic pattern, and the first chamber and the second chamber are configured to allow the fluid to flow from the first chamber to the second chamber when fluid communication between the first chamber and the second chamber is provided. The piston is configured to translate in response to fluid flowing from the first chamber to the second chamber. In a forty first embodiment, the actuator of the fortieth embodiment may be disposed in a fluid pathway between the first chamber and the second chamber. In a forty second embodiment, the magnetic sensor of the fortieth or forty first embodiment may be a giant magneto-resistive sensor, a hall-effect sensor, a conductive coils, or any combination thereof. In a forty third embodiment, the magnetically actuated device of any of the fortieth to forty second embodiments may also include at least one additional sensor selected from the group consisting of: a pressure sensor, a temperature sensor, a seismic sensor, an electromagnetic sensor, a pulse detector, a flow meter, and any combination thereof, and the actuator may be further configured to selectively provide fluid communication between the first chamber and the second chamber in response to a signal generated from the at least one additional sensor. In a forty fourth embodiment, the magnetically actuated device of any of the fortieth to forty third embodiments may also include a controller in signal communication with the magnetic sensor, and the controller may be configured to receive one or more signals from the magnetic sensors and trigger the actuator. In a forty fifth embodiment, the magnetically actuated device of any of the fortieth to forty fourth embodiments may also include an outer housing, a port disposed through the outer housing, a sleeve slidingly disposed within the housing, a first locking feature on the sleeve, and a second locking feature on the outer housing. The sleeve may be configured to selectively provide fluid communication through the port, and the piston may be radially aligned with the second locking feature when the first chamber is not in fluid communication with the second chamber. In a forty sixth embodiment, the piston of the forty fifth embodiment may at least partially expose the second locking feature when the first chamber is in fluid communication with the second chamber. In a forty seventh embodiment, the first locking feature of the forty fifth or forty sixth embodiments may be configured to engage the second locking feature when the first chamber is in fluid communication with the second chamber. In a forty eighth embodiment, the first locking feature and the second locking feature of the forty seventh embodiment may be configured to retain the sleeve in position when engaged. In a forty ninth embodiment, the sleeve of the forty eighth embodiment may be configured to substantially prevent fluid flow through the port when the first locking feature is engaged with the second locking feature. In a fiftieth embodiment, the magnetically actuated device of the forty fifth embodiment may also include a flow control device housing disposed about the outer housing, a flow control device chamber defined between the flow control device housing and the outer housing, and a flow restriction disposed in fluid communication with the flow control device chamber. The chamber and the flow restriction may be configured to force fluid flow through the chamber through the flow restriction. In a fifty first embodiment, the magnetically actuated device of the fiftieth embodiment may also include a filter element disposed in fluid communication with the flow control device chamber, where the filter element and the chamber may be configured to force fluid to flow through the filter element prior to flowing into the chamber. In a fifty second embodiment, the flow restriction of the fiftieth or fifty first embodiments may comprise at least one of a nozzle or a flow tube. In a fifty third embodiment, the flow restriction of any of the fiftieth to fifty second embodiments may be disposed in the port. In a fifty fourth embodiment, the magnetically actuated device of the fortieth embodiment may also include an outer housing, a plurality of ports disposed through the outer housing, a sleeve slidingly disposed within the housing, a first locking feature on the sleeve, and a second locking feature on the outer housing. The sleeve may be configured to selectively provide fluid communication through one or more of the plurality of ports, and the piston may be radially aligned with the second locking feature when the first chamber is not in fluid communication with the second chamber. In a fifty fifth embodiment, the sleeve of the fifty fourth embodiment may be configured to assume a plurality of positions. In a first position of the plurality of positions, the sleeve may be configured to provide fluid communication through a first port of the plurality of ports, and in the first position, the first port may be configured to provide fluid communication through a filter element. In a fifty sixth embodiment, the sleeve of the fifty fifth embodiment may be configured to provide fluid communication through a second port of the plurality of ports when the sleeve is in a second position of the plurality of positions, when the sleeve is in the second position, the second port may be configured to provide fluid communication through the filter element and a flow restriction. In a fifty seventh embodiment, the sleeve of the fifty sixth embodiment may be configured to substantially block fluid flow through the plurality of ports when the sleeve is in a third position of the plurality of positions. In a fifty eighth embodiment, the sleeve may be configured to provide fluid communication through a second port of the plurality of ports when the sleeve is in a second position of the plurality of positions, and when the sleeve is in the second position, the second port may be configured to bypass the filter element. In a fifty eighth embodiment, the first port of the fifty eighth embodiment may be further configured to provide fluid communication through a flow restriction when the sleeve is in the first position. In a sixtieth embodiment, the sleeve of the fifty ninth embodiment is configured to substantially block fluid flow through the plurality of ports when the sleeve is in a third position of the plurality of positions. In a sixty first embodiment, the magnetically actuated device of the forty fifth embodiment may also include a third chamber, and a second actuator. The second actuator may be configured to selectively provide fluid communication between the first chamber and the third chamber, and the first chamber and the third chamber may be configured to allow the fluid to flow from the first chamber to the third chamber when fluid communication between the first chamber and the second chamber is provided. In a sixty second embodiment, the second chamber and the third chamber of the sixty first embodiment may be disposed in series. In a sixty third embodiment, the magnetically actuated device of the sixty first embodiment may also include a second port disposed in the outer housing, and the sleeve may be configured to substantially prevent fluid flow through the port when the first chamber is in fluid communication with the second chamber. The sleeve may be configured to allow fluid flow through the second port when the first chamber is not in fluid communication with the third chamber. In a sixty fourth embodiment, the sleeve of the sixty third embodiment may be configured to substantially prevent fluid flow through the port and the second port when the first chamber is in fluid communication with the second chamber and the third chamber. In a sixty fifth embodiment, the magnetically actuated device of the fortieth embodiment may also include an upper sub, a lower sub, a load ring, and a piston prop coupled to the piston. The load ring may be configured to engage the upper sub and the lower sub in a locked position and contract to disengage from the upper sub in an unlocked position, and the piston prop may be configured to retain the load ring in engagement with the upper sub in a locked position. In a sixty sixth embodiment, the piston prop of the sixth fifth embodiment may be configured to axially translate and allow the load ring to disengage from the upper sub when the piston translates in response to fluid flowing from the first chamber to the second chamber.

In a sixty seventh embodiment, a method of magnetically actuating a device in a wellbore comprises detecting a magnetic pattern within a wellbore, providing fluid communication between a first chamber and a second chamber in response to the detecting the magnetic pattern, allowing fluid to flow from the first chamber to the second chamber in response to the providing of the fluid communication between the first chamber and the second chamber, and translating a piston to a first position in response to fluid flowing from the first chamber to the second chamber. In a sixty eighth embodiment, detecting the magnetic pattern in the sixty seventh embodiment may comprise receiving a magnetic signal from a magnetic tool disposed in a flowbore of a housing. In a sixty ninth embodiment, the magnetic tool of the sixty eighth embodiment may be configured to change the magnetic pattern of a plurality of magnets in the wellbore. In a seventieth embodiment, detecting the magnetic pattern in any of the sixty seventh to sixty ninth embodiments may comprise at least one of detecting a direction of travel of the magnetic pattern, detecting a speed of a passing magnetic tool comprising the magnetic pattern, and/or detecting the number of times the magnetic tool comprising the magnetic pattern passes a magnetic sensor. In a seventy first embodiment, providing fluid communication between the first chamber and the second chamber in any of the sixty seventh to seventieth embodiments may comprise actuating an actuator in response to detecting the magnetic pattern, and opening a fluid pathway between the first chamber and the second chamber. In a seventy second embodiment, the method of any of the sixty seventh to seventy first embodiments may also include exposing a first locking feature in response to translating the piston, engaging a second locking feature on a sliding sleeve with the first locking feature, and retaining the sliding sleeve in a position based on the engaging of the second locking feature with the first locking feature. In a seventy third embodiment, the position of the seventy second embodiment may be a closed position. In a seventy fourth embodiment, the method of the seventy second or seventy third embodiments may also include passing fluid through a port in a housing, aligning the sliding sleeve with the port, and preventing fluid flow through the port based on the sliding sleeve aligning with the port. In a seventy fifth embodiment, the method of any of the seventy second to seventy fourth embodiments may also include providing fluid communication between the first chamber and a third chamber in response to the detecting a second magnetic pattern, allowing fluid to flow from the first chamber to the third chamber in response to the providing of the fluid communication between the first chamber and the second chamber, and further translating the piston to a second position in response to fluid flowing from the first chamber to the third chamber. In a seventy sixth embodiment, the method of the seventy fifth embodiment may also include substantially blocking fluid flow through a first port when the piston is in the first position, and providing fluid flow through a second port when the piston is in the first position. In a seventy seventh embodiment, the second port of the seventy sixth embodiment may be in fluid communication with a flow restriction, and providing fluid flow through the second port when the piston is in the first position may comprise providing fluid flow through the flow restriction when the piston is in the first position. In a seventy eighth embodiment, the method of the seventy sixth or seventy seventh embodiment may also include substantially blocking fluid flow through the first port and the second port when the piston is in the second position. In a seventy ninth embodiment, the first magnetic pattern and the second magnetic pattern in any of the seventy fifth to seventy eighth embodiments may be the same pattern. In an eightieth embodiment, the method of the seventy sixth embodiment may also include translating a piston prop coupled to the piston in response to the fluid flowing from the first chamber to the second chamber, releasing a load ring based on translating the piston prop, disengaging the load ring from an upper sub, and decoupling the upper sub from a lower sub. In an eighty first embodiment, the method of the eightieth embodiment may also include telescoping the upper sub with respect to the lower sub when the upper sub is decoupled from the lower sub. In an eighty second embodiment, releasing the load ring in the eightieth or eighty first embodiments may comprise allowing the load ring to contract inwards.

In an eighty third embodiment, a method of performing a workover procedure in a multi-zone well comprises passing fluid through a first port in a first sleeve disposed in a first zone of a multi-zone well, passing fluid through a second port in a second sleeve disposed in a second zone of the multi-zone well, detecting a magnetic pattern with a first magnetic sensor in the first zone, and locking the first sleeve in a closed position in response to detecting the magnetic pattern. In an eighty fourth embodiment, the fluid of the eighty third embodiment may be prevented from passing through the first port when the first sleeve is in the closed position. In an eighty fifth embodiment, the fluid of the eighty third or eighty fourth embodiments may comprise a gravel slurry, and further comprising disposing a gravel pack adjacent a screen in response to passing the fluid through the first port, the second port, or both. In an eighty sixth embodiment, locking the first sleeve in the closed position in any of the eighty third to eighty fifth embodiments comprises: providing fluid communication between a first chamber and a second chamber in response to the detecting the magnetic pattern with the first magnetic sensor in the first zone, allowing fluid to flow from the first chamber to the second chamber in response to the providing of the fluid communication between the first chamber and the second chamber, translating a piston to a first position in response to fluid flowing from the first chamber to the second chamber, and retaining the first sleeve in the closed position in response to translating the piston to the first position. In an eighty seventh embodiment, the method of any of the eighty third to eighty sixth embodiments may also include detecting the magnetic pattern with a second magnetic sensor in the second zone, and locking the second sleeve in a closed position in response to detecting the magnetic pattern. In an eighty eighth embodiment, the method of the eighty third embodiment may also include detecting a second magnetic pattern with a second magnetic sensor in the second zone, and locking the second sleeve in a closed position in response to detecting the second magnetic pattern. In an eighty ninth embodiment, detecting the magnetic pattern in any of the eighty third to eighty eighth embodiments may comprise at least one of detecting a direction of travel of the magnetic pattern, detecting a speed of a passing magnetic tool comprising the magnetic pattern, detecting the number of times the magnetic tool comprising the magnetic pattern passes a magnetic sensor, or any combination thereof.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An actuation device, comprising:

a central mandrel; and a plurality of permanent magnets disposed about an outer surface of the central mandrel, wherein the plurality of permanent magnets is configured to selectively transition between a first position and a second position, wherein the plurality of permanent magnets is configured to provide a stronger magnetic field strength outside the central mandrel than inside the central mandrel in the first position, and wherein the plurality of permanent magnets is configured to provide a stronger magnetic field strength inside the central mandrel than outside the central mandrel in the second position.

2. The actuation device of claim 1, wherein the plurality of permanent magnets are configured in a Halbach Array.

3. The actuation device of claim 1, further comprising a biasing member coupled to the plurality of magnets, wherein the biasing member is configured to bias the plurality of permanent magnets towards the first position.

4. The actuation device of claim 1, wherein at least a portion of the plurality of permanent magnets are configured to rotate to selectively transition between the first position and the second position.

5. The actuation device of claim 1, wherein at least a portion of the plurality of permanent magnets are configured to axially translate to selectively transition between the first position and the second position.

6. The actuation device of claim 1, further comprising at least one motor and a plurality of gear mechanisms linked to the plurality of permanent magnets, wherein the at least one motor is coupled to the plurality of gear mechanisms, and wherein the at least one motor is configured to rotate the plurality of permanent magnets using the plurality of gear mechanisms.

7. The actuation device of claim 1, further comprising:

a driving member configured to axially translate in response to an applied force; and a gear mechanism coupled to one or more of the plurality of permanent magnets, wherein the gear mechanism is configured to rotate the one or more of the plurality of permanent magnets in response to an axial translation of the driving member.

8. The actuation device of claim 7, wherein the applied force comprises a pressure force, a mechanical force, an electro-mechanical force, or any combination thereof.

9. The actuation device of claim 1, further comprising a driving system operably coupled to the plurality of permanent magnets and configured to rotate one or more of the plurality of permanent magnets, to axially translate one or more of the plurality of permanent magnets, or both, to transition the plurality of permanent magnets between the first position and the second position.

10. A magnetic positioning tool system, comprising:

a magnetic positioning tool disposed within an outer mandrel, wherein the magnetic positioning tool comprises:

a housing;

a plurality of magnets disposed about the housing, wherein the plurality of magnets are configured to selectively transition between a first position and a second position; and a driving system operably coupled to the plurality of magnets and configured to rotate one or more of the plurality of magnets, to axially translate one or more of the plurality of magnets, or both, to selectively transition the plurality of permanent magnets between the first position and the second position; and an actuable component operably associated with the outer mandrel, wherein the magnetic positioning tool is configured to actuate the actuable component based on transitioning the plurality of magnets from the first position to the second position.

11. The magnetic positioning tool system of claim 10, wherein the actuable component comprises a sliding sleeve disposed about the outer mandrel, wherein the sliding sleeve is configured to magnetically couple to the plurality of magnets when the plurality of magnets are in the second position.

12. The magnetic positioning tool system of claim 11, wherein the sliding sleeve is configured not to couple with the plurality of magnets when the plurality of magnets are in the first position.

13. The magnetic positioning tool system of claim 10, wherein the actuable component comprises a locking mechanism engaging the outer mandrel and a sliding sleeve.

14. The magnetic positioning tool system of claim 13, wherein the locking mechanism is configured to retain the sliding sleeve in position, and wherein the locking mechanism is configured to release the sliding sleeve for axial movement in response to the plurality of magnets transitioning to the second position.

15. The magnetic positioning tool system of claim 10, further comprising:

a magnetic sensor, wherein the magnetic sensor is configured to detect the position of the plurality of magnets and generate a signal in response to the plurality of magnets being in the second position; and a controller, wherein the controller is configured to actuate the actuable component based on the signal.

16. The magnetic positioning tool system of claim 15, wherein the controller is configured to open a valve, close a valve, activate a hydrostatic chamber to shift a sleeve open, activate a hydrostatic chamber to shift a sleeve closed, set a hydraulic packer, or release a compaction joint in response to the signal.

17. The magnetic positioning tool system of claim 15, wherein the magnetic sensor is configured to indicate at least one of the direction the magnetic positioning tool system is traveling, the time the magnetic tool system passes one or more permanent magnets, or the number of permanent magnets the magnetic positioning tool system passes.

18. The magnetic positioning tool system of claim 15, wherein the controller is configured to actuate the actuatable component when the controller receives the signal from the magnetic sensor or after a time delay after the controller receives the signal from the magnetic sensor.

19. A method of magnetically actuating a downhole component, the method comprising:

positioning a magnetic positioning tool adjacent an actuable component within a wellbore, wherein the magnetic positioning tool comprises a plurality of magnets arranged in a first position;

transitioning the plurality of magnets from the first position to a second position, wherein transitioning the plurality of magnets from the first position to the second position comprises rotating one or more of the plurality of magnets, axially translating one or more of the plurality of magnets, or both;

magnetically coupling the plurality of magnets with the actuable components; and actuating the actuable component within the wellbore in response to the magnetic coupling.

20. The method of claim 19, further comprising:

detecting that the plurality of magnets are in the second position using a magnetic sensor;

generating a signal based on the detecting, wherein actuating the actuable component is based on the generating of the signal.

21. The method of claim 19, wherein actuating the actuable component comprises axially translating a sleeve within the wellbore based on the magnetic coupling.

22. The method of claim 19, wherein actuating the actuable component comprises releasing a locking mechanism based on the magnetic coupling, and allowing a downhole component to translate in response to releasing the locking mechanism.

* * * * *